US006753523B1

(12) United States Patent
Whitehouse et al.

(10) Patent No.: US 6,753,523 B1
(45) Date of Patent: Jun. 22, 2004

(54) MASS SPECTROMETRY WITH MULTIPOLE ION GUIDES

(75) Inventors: Craig M. Whitehouse, Branford, CT (US); Bruce A. Andrien, Jr., Branford, CT (US); Erol E. Gulcicek, Cheshire, CT (US)

(73) Assignee: Analytica of Branford, Inc., Branford, CT (US)

( * ) Notice: Subject to any disclaimer, the term of this patent is extended or adjusted under 35 U.S.C. 154(b) by 0 days.

(21) Appl. No.: 10/236,750

(22) Filed: Sep. 6, 2002

Related U.S. Application Data

(63) Continuation of application No. 09/672,362, filed on Sep. 28, 2000, now abandoned, which is a continuation of application No. 09/235,946, filed on Jan. 22, 1999, now abandoned.

(60) Provisional application No. 60/087,246, filed on May 29, 1998, and provisional application No. 60/072,374, filed on Jan. 23, 1998.

(51) Int. Cl.[7] ..... H01J 49/42
(52) U.S. Cl. ..... 250/292
(58) Field of Search ..... 250/292

(56) References Cited

U.S. PATENT DOCUMENTS 3,371,204 A * 2/1968 Brubaker et al. ..... 250/292
3,410,997 A * 11/1968 Brubaker ..... 250/290
4,328,420 A * 5/1982 French ..... 250/282
4,963,736 A * 10/1990 Douglas et al. ..... 250/292
5,192,865 A * 3/1993 Zhu ..... 250/288
5,652,427 A * 7/1997 Whitehouse et al. ..... 250/288

* cited by examiner

*Primary Examiner*—Jack Berman
(74) *Attorney, Agent, or Firm*—Levisohn, Berger & Langsam, LLP

(57) ABSTRACT

Multipole ion guides configured with one or more segments and positioned in a higher pressure vacuum region, are operated in mass to charge selection and ion fragmentation modes. Individual multipole ion guides are mounted in a linear assembly with no electrodes configured in between each multipole ion guide. At least a portion of each multipole ion guide mounted in a linear assembly resides in a vacuum region with higher background pressure. At least one ion guide can be configured to extend continuously from one vacuum stage into another. Individual sets of RF, +/− DC and secular frequency voltage supplies provide potentials to the rods of each multipole ion guide allowing the operation of ion transmission, ion trapping, mass to charge selection and ion fragmentation functions independently in each ion guide. The presence of higher background pressure along a portion of the multiple ion guide linear assembly allows the Collisional Induced Dissociation (CID) fragmentation of ions by axially accelerating ions from one multipole ion guide to an adjacent ion guide, analogous to a triple quadrupole function. A variety of MS and MS/MS$^n$ analysis functions can be achieved with a mass analyzer configured with multiple ion guide linear assembly operated in a higher background pressure.

37 Claims, 21 Drawing Sheets

MASS SPECTROMETRY WITH MULTIPOLE ION GUIDES

RELATED APPLICATIONS

This is a continuation of Ser. No. 09/672,362, filed Sep. 28, 2000 now abandoned, which itself was a continuation of Ser. No. 09/235,946 which was filed on Jan. 22, 1999 now abandoned which relates to provisional patent applications No. 60/072,374, filed Jan. 23, 1998 and No. 60/087,246, filed May 29, 1998, all of the specifications of which are incorporated herein.

FIELD OF INVENTION

This invention relates to the field of mass spectrometric analysis of chemical species. More particularly it relates to the configuration and operation use of multiple multipole ion guide assemblies in higher pressure vacuum regions.

BACKGROUND OF THE INVENTION

Mass Spectrometers (MS), have been used to solve an array of analytical problems involving solid, gas and liquid phase samples with both on-line and off-line techniques. On-line Gas Chromatography (GC), Liquid Chromatography (LC), Capillary Electrophoresis (CE) gas and other solution sample separation systems have been interfaced on-line to mass spectrometers configured with a variety of ion source types. Some ion source types operate at or near atmospheric pressure and other ion source types produce ions in vacuum. Mass spectrometers operate in vacuum with different mass analyzer types requiring different vacuum background pressure for optimal performance. The present invention comprises a configuration of one or more multipole ion guides configured in a mass spectrometer. Although the invention can be applied to multipole ion guides comprising any number of poles, the description of the invention given below will present quadrupole or four pole ion guide assemblies. Higher mass to charge separation resolution can be achieved with quadrupole ion guides when compared with the performance of ion guides configured with more that four poles. Quadrupole ion guides have been configured as the primary elements in single and triple quadrupole mass analyzers or as part of hybrid mass spectrometers that include Time-Of-Flight, Magnetic Sector, Fourier Transform and even three dimensional quadrupole ion trap mass analyzers. Typically, quadrupole ion guides operated in mass to charge selection mode, are run in background vacuum pressures that avoid or minimize ion to neutral background gas collisions. A wider range of background pressures have been used when operating quadrupoles in RF only ion transmission mode. For some applications, pressure in a quadrupole ion guide operating in RF only ion transmission mode is maintained sufficiently high to promote collisional damping of ion kinetic energy or Collisional Induced Dissociation (CID) fragmentation of ions traversing the ion guide length.

Commercially available; quadrupole mass analyzers with electron multiplier or photomultiplier detectors are operated in analytical mass to charge selection mode at background pressures typically below $2\times10^{-4}$ torr range. There are examples of multipole ion guides operated at elevated background pressures I vacuum with some degree of ion mass to charge separation. U.S. Pat. Nos. 5,401,962 and 5,613,294 describe a small quadrupole array with an electron ionization (EI) ion source and a faraday cup detector which can be operated as a low mass to charge range gas analyzer at background pressures up to $1\times10^{-2}$ torr. Performance of this short quadrupole array begins to decrease when the background pressure increases to the point where the mean free path of an ion is shorter than the quadrupole rod length. U.S. Pat. No. 5,179,278 describes a quadrupole ion guide configured to transmit ions from an Atmospheric Pressure Ionization (API) source into a three dimensional quadrupole ion trap. The quadrupole ion guide described in U.S. Pat. No. 5,179,278 can be operated as a trap to hold ions before releasing the trapped ions into the three dimensional quadrupole ion trap. During ion trapping, the potentials applied to the rods or poles of this quadrupole ion guide can be set to limit the range of ion mass to charge values released to the ion trap. The quadrupole ion guide can also be operated with resonant frequency excitation collisional induced dissociation fragmentation of trapped ions prior to introducing the trapped fragment ions into the three dimensional ion trap. After the quadrupole ion guide has released its trapped ions to the three dimensional ion trap, it is refilled during the three dimensional ion trap mass analysis time period. A quadrupole ion guide that extends continuously through multiple vacuum pumping stages is described in pending U.S. patent application Ser. No. 08/694,542. A portion of the quadrupole ion guide length is positioned in a vacuum region that pressures greater than one millitorr insuring ion and neutral gas background collisions. Pending U.S. patent application Ser. No. 08/694,542 describes a hybrid mass spectrometer wherein the multiple vacuum stage multipole ion guide is configured with a Time-Of-Flight (TOF) mass analyzer. As described, the quadrupole ion guide is operated in combinations of ion transmission, ion trapping, mass to charge selection and CID fragmentation modes coupled with Time-Of-Flight mass to charge analysis. The hybrid quadrupole Time-Of-Flight apparatus and method described provides a range of $MS/MS^n$ mass analysis functions. In an improvement over the prior art, one embodiment of the present invention comprises multiple quadrupole ion guides configured and operated in a higher pressure vacuum region of a hybrid TOF mass analyzer improving the mass analyzer $MS/MS^n$ performance and analytical capability.

Multipole ion guides operated in RF only mode at elevated pressures have been used as an effective means to achieve damping of ion kinetic energy during ion transmission from Atmospheric Pressure Sources to mass analyzers. A quadrupole ion guide, operated in RF only mode in background pressures greater than $10^{-4}$ torr, configured to transport ions from an API source to a quadrupole mass analyzer is described in U.S. Pat. No. 4,963,736. Ion collisions with the neutral background gas serve to damp the ion kinetic energy during ion transmission through the ion guide. This potentially can reduce the primary ion beam energy spread and improve ion transmission efficiency. Multipole ion guides operated in elevated background pressures have been used extensively as collision cells for the CID fragmentation of ions in triple quadrupoles and hybrid magnetic sector and TOF mass analyzers. Ion guides configured and operated as collision cells are run in RF only mode with a variable DC offset potential applied to all rods. U.S. Pat. No. 5,847,386 describes the configuration a multipole ion guide assembly configured to create an electric field along the ion guide axis to move ions axially through a collision cell or to promote CID fragmentation within a collision cell by oscillating ions axially back and forth within the individual ion guide assembly length. As described, the ion guide assembly with an axial field is operated in RF only mode with a common RF applied to all poles of the quadrupole ion guide assembly. Multipole ion guide collision cells that have been incorporated in commercially available mass analyzers and that have been described in the literature are configured as individual ion guide assemblies isolated in a vacuum pumping stage or contained in a surrounding enclosure. The ion guide surrounding enclosure, generally located in a lower pressure vacuum region, is configured to minimize the higher pressure collision cell background pressure from entering the surrounding lower vacuum pressure chamber. Commercially available triple quadrupoles, shown as prior art in FIG. 20 generally are configured with three multipole ion guides in one vacuum pumping stage. The elevated pressure within the collision cell is maintained by leaking collision gas into the enclosure surrounding the collision cell multipole ion guide. Gas leaks out of the collision cell through the enclosure entrance and exit apertures configured along the triple quadrupole centerline. One aspect of the present invention is the configuration of multiple quadrupole ion guides positioned in a common region of higher vacuum pressure higher pressure run in ion mass to charge selection and CID fragmentation operating modes. A further aspect of the invention is the configuration of multiple quadrupole ion guides in a vacuum region of elevated pressure wherein each quadrupole can be operated in mass to charge selection and/or ion fragmentation modes to achieve $MS/MS^n$ mass analysis functions.

Conventional triple quadrupole mass analyzers interfaced to API sources must be configured with sufficient vacuum pumping speed in the mass analyzer vacuum stage region to maintain a vacuum level that prevents ion collisions with the background gas. The low pressure vacuum must be maintained while gas leaks into the chamber from the collision cell and the ion source. Vacuum pressure in the collision cell enclosure is generally maintained at 5 to 8 millitorr and the analyzer vacuum stage is maintained in the low $10^{-5}$ to $10^{-6}$ torr range. FIG. 20 is a diagram of the multipole ion guide configuration of a typical triple quadrupole mass analyzer 150 interfaced to an Atmospheric Pressure Ion source. Individual multipole ion guide assemblies 158, 154, 155 and 156 are configured along the same centerline axis in a three stage vacuum pumping system. Orifice plate 164 provides a leak from atmospheric pressure region 160 into first vacuum stage 151. Ions produced in atmospheric pressure region 160 are transferred into vacuum through a supersonic free jet expansion formed on the vacuum side of orifice 169. A portion of the ions introduced into vacuum continue through the orifice in skimmer, multipole ion guide 158, the orifice in electrode 161, multipole ion guide 154, the orifice in electrode 166, multipole ion guide 155, the orifice in electrode 167, multipole ion guide 156, the orifice in electrode 168 to detector 165. The pressures in vacuum stages 151, 152 and 153 are typically maintained at 1 torr, 5 millitorr and $<1\times10^{-5}$ torr respectively while the pressure inside collision cell 157 is maintained at 5 to 8 millitorr. Triple quadrupoles are configured to perform Ms or a single MS/MS sequence mass analysis function. In an MS/MS experiment, ions start at or near atmospheric pressure, are transported through multiple vacuum stages to a low pressure vacuum region where mass to charge selection occurs in multipole ion guide 154 with little or no ion to neutral collisions. Mass to charge selected ions are then are accelerated into a region of elevated pressure in collision cell multipole ion guide 155. The resulting fragment ion population are directed the low pressure region in quadrupole 156 where mass to charge separation is conducted with few or no ion to neutral collisions prior to detection by ion detector 165. A similar analytical ion sequence occurs in prior art hybrid quadrupole, quadrupole TOF mass analyzers where third quadrupole 156 is replaced by a TOF mass analyzer residing in a fourth vacuum pumping stage.

The placement of a multipole ion guide collision cell in a low pressure vacuum stage increases the cost and complexity of an API MS/MS mass analyzer. One aspect of the invention is the configuration of multiple quadrupole ion guides in a higher pressure vacuum pumping stage of an API source using the background pressure formed by the gas leak from atmospheric pressure to perform CID ion fragmentation. Mass to charge selection and CID ion fragmentation is performed in the second vacuum stage of an Atmospheric Pressure Ion Source mass analyzer, eliminating the need for a separate collision cell with its additional gas loading on the vacuum system. The configuration of multiple quadrupoles in the second vacuum stage reduces the system vacuum pumping speed requirements and its associated costs for API quadrupole and hybrid mass analyzers. Another aspect of the invention is the configuration of multiple quadrupole ion guides that have pole dimensions considerably reduced in size from quadrupole assemblies typically found in commercially available triple quadrupoles or hybrid quadrupole TOF mass analyzers. The smaller pole dimensions and reduced quadrupole length minimizes the ion transmission time along each quadrupole assembly axis. This increases the analytical speed of the mass spectrometer for a range of mass analysis functions. The reduced quadrupole size require less space and power to operate, decreasing system size and cost without decreasing performance. Another aspect of the invention is the configuration of a multipole ion guide that extends continously into multiple vacuum stages into the multiple quadrupole assembly positioned in the higher pressure region of an API MS instrument. Multiple vacuum pumping stage ion guides are described in U.S. Pat. No. 5,652,427. As will be described below, configuring a multiple vacuum stage quadrupole ion guide with additional quadrupole ion guides enables operation over a wide range of mass analysis functional sequences.

Individual quadrupole ion guide assemblies require individual RF, +/− DC and supplemental resonant frequency voltage supplies to achieve ion mass to charge selection, CID ion fragmentation and trapping functions. Quadrupole ion guides have been configured with segments where common RF voltage from a single RF supply is applied to all segments of the ion guide assembly or rod set. Typically, an RF only entrance and exit segment will be configured in a quadrupole rod set to minimize fringing field effects on ions entering or leaving the quadrupole. The RF voltage is applied to the entrance and exit sections through capacitive coupling with the primary RF supplied to the central rod segment. Offset potentials, that is the common DC voltage applied to all four poles of a given segment, can be set individually on each segment to accelerate ions from one ion guide segment to the next within a quadrupole ion guide assembly. The offset potential applied to segments of an ion guide can be set to trap ions within an ion guide as well. In the prior art, electrodes are positioned between individual multipole ion guides when multiple ion guide assemblies are configured in a mass analyzer. Referring to the prior art triple quadrupole example diagrammed in FIG. 20 each quadrupole ion guide is separated from an adjacent ion guide by an electrode. Electrodes are configured to minimize the fringing field effects as ions pass from one ion guide assembly to the next. They minimize any capacitive coupling between different ion guide sets avoiding beat frequency distortions of the RF fields. The electrodes also serve the additional purpose of providing a reduced orifice between vacuum pumping stages or between a collision cell and the vacuum stage in which it resides to minimize gas conductance. When conducting MS/MS experiments, i.e. the collision cell is maintained at a pressure of 5 to 8 millitorr, ions transferred from one quadrupole to another in the prior art must pass through a background pressure gradient. The collisional effects that occur in the fringing field region between multipole ion guides may cause ion losses due to scattering effects.

Referring to FIG. 20, multipole ion guide 158 is separated from quadrupole assembly 154 by vacuum partition and electrode 161. Quadrupole 154 is diagrammed with RF only segments or sections 162 and 170 and analytical segment 163. Multipole ion guide 158 may be configured as a quadrupole, hexapole or octapole and may have a different RF voltage supply from that of quadrupole 154. The RF frequency, amplitude, phase and different RF related electric fields produced by a difference in the number of poles between ion guide 158 and quadrupole 154 create fringing fields that can negatively effect the efficiency of ion transport from ion guide 158 into quadrupole 154. The effect on ion trajectories of exit fringing fields of multipole ion guide 158 and the entrance fringing fields of quadrupole 154 are reduced by electrode 161 and RF only segments 162. Electrodes 166 and 167 serve the similar factions of reducing fringing field effects and acting as a vacuum partitions. Collision cell multipole ion guide may be configured with four, six or eight poles and have RF fields at its entrance and exit ends that differ from the RF and DC fields of the adjacent quadrupole ion guides. Ion losses occur at each transfer from one multipole ion guide assembly to the next due to ion collisional scattering, fringing field effects and ion collisions with the electrodes. One aspect of the invention is the configuration of multiple quadrupole assemblies along a common axis with no electrode partitions in between. Each quadrupole assembly configured according to the invention can individually conduct mass selection and CID fragmentation of ions. One or more multiple vacuum stage quadrupole can be configured, according to the invention in a multiple quadrupole assembly. Ijames, Proceedings of the 44th ASMS Conference on Mass Spectrometry and Allied Topics, 1996, p 795, proposes a linear combination of four quadrupole ion guides operated in RF only ion transport and trapping mode with ion pulsing into a TOF mass analyzer. Two of the quadrupoles in the proposed assembly extend continuously into two vacuum pumping stages. The extended abstract does not teach applying different RF potentials to quadrupoles one through four. Nor does it teach conducting mass to charge selection or CID fragmentation operation with the proposed multiple quadrupole assembly as is included as aspects of the present invention.

Separate RF voltage supplies providing RF voltage to individual multipole ion guide assemblies in the present invention can be operated with a common frequency and phase to minimize RF fringing field effects. Each quadrupole assembly can have different RF amplitude applied during mass to charge selection and/or ion CID fragmentation operation. Eliminating the electrodes between quadrupole ion guide assemblies increases ion transmission efficiency and allows ions to be directed forward and backward between quadrupole ion guide assemblies. Efficient bidirectional transport of ions along the axis of a multiple quadrupole assembly allows a wide range analytical functions to be run on a single instrument. A equivalent array of analytical functions would require more than one prior art mass analyzer to achieve. One aspect of the invention includes RF quadrupoles configured between each analytical quadrupole assembly to minimize any fringing fields due to interquadrupole differences in RF amplitude, +/− DC voltage and resonant frequency voltages. The RF only segments, configured with individual RF supplies, also serve to minimize RF or resonant frequency coupling between analytical quadrupole ion guide assemblies. In another aspect of the invention, the RF only quadrupoles may be configured as RF only segments of each quadrupole assembly capacitively coupling to the adjacent quadrupole ion guide RF supply. In yet another aspect of the invention, the junctions between individual quadrupole assemblies are located in the higher pressure vacuum region where little pressure gradient exists at the junction between quadrupole assemblies. Ion collisions with the background gas serve to damp stable ion trajectories to the quadrupole centerline where fringing field effects between quadrupoles are minimized. This collisional damping of ions trajectories by the background gas serves to maximize ion transmission in the forward and backward direction between individual quadrupole ion guide assemblies.

Triple quadrupoles, three dimensional ion traps, hybrid quadrupole-TOFs, hybrid magnetic sector and Fourier Transform (FTMS) mass analyzers can perform MS/MS analysis. Ion traps and FTMS mass analyzers can perform $MS/MS^n$ analysis, however, ion CID fragmentation is performed with relatively low energy resonant frequency excitation. CID fragmentation in triple quadrupoles and hybrid quadrupole-TOF mass analyzers is achieved by acceleration of ions along the quadrupole axis referred to herein as DC acceleration CID fragmentation. Ions are generally accelerated with a few to tens of eV in quadrupole DC acceleration CID fragmentation. Hybrid or tandem magnetic sector mass analyzers can perform high energy DC acceleration ion fragmentation with ions accelerated into gas phase collisions with hundreds or even thousands of eV. Single mass range mass to charge selection in triple quadrupoles is achieved by applying RF and +/− DC to the non collision cell quadrupole assemblies 154 and 156 in FIG. 21. Single or multiple range mass to charge selection in three dimensional ion traps is achieved using RF voltage amplitude scanning coupled with resonant frequency ejection of unwanted ions. Triple quadrupoles operate with a continuous ion beam delivered from an API source. Ion traps must analyze ions provide in a continuous ion beam in batch-wise manner. The space charge of trapped ions in a three dimensional ion trap imposes performance restrictions not encountered in triple quadrupole operation. The effects of space charge in an ion trap potentially limit its utility in quantitative analysis applications. The mass to charge selection resolution in quadrupole ion guides operated in low vacuum pressures is limited in part by the ion transit time. Each mass analyzer type performs ion mass to charge selection and CID fragmentation through a different means each with its own advantages and disadvantages depending on the analytical problem to be solved.

Quadrupoles and three dimensional ion trap mass analyzers and recently hybrid quadrupole-TOF mass analyzers have become the most widely used mass analyzer types interfaces with Atmospheric Pressure Ion Sources such as Electrospray (ES) and Atmospheric Pressure Chemical Ionization (APCI) sources. FTMS instruments provide very high resolution and mass accuracy but price and operational complexity have limited the number of units currently in use. It is one aspect of the present invention to combine the functional capabilities of triple quadrupoles, three dimensional ion traps and hybrid quadrupole-TOF mass analyzers into a single instrument. The invention includes but is not limited to resonant frequency CID ion fragmentation, DC acceleration CID fragmentation even for energies over one hundred eV, RF and +/− DC mass to charge selection, single or multiple mass range RF amplitude and resonant frequency ion ejection mass to charge selection, ion trapping in quadrupole ion guides and TOF mass analysis. The invention enables mass spectrometric analytical functions that can not be performed any prior art mass analyzer type. For example, $MS/MS^n$ where n>1 can be performed on a hybrid quadrupole-TOF's configured according to the invention, using DC acceleration fragmentation for each CID step or combinations of resonant frequency excitation and DC acceleration CID ion fragmentation. Ion trapping with mass to charge selection of CID ion fragmentation can be performed in each individual quadrupole assembly without stopping a continuous ion beam. These techniques, according to the invention, as described below increase the duty cycle and sensitivity of a hybrid quadrupole-TOF during MS/MS experiments.

The hybrid quadrupole-TOF configured according to the inventions is a lower cost bench-top instrument that includes all the performance capability as described in U.S. Pat. Nos. 5,652,427 and 5,689,111 and U.S. patent application Ser. Nos. 08/694,542 and 60/021,184 included herein by reference. Emulation and improved performance of prior art API triple quadrupole, three dimensional ion trap, TOF and hybrid quadrupole-TOF mass analyzer functions can be achieved with the hybrid quadrupole-TOF mass analyzer configured according to the invention. The assemblies of multiple quadrupole ion guides configured according to the invention can be interfaced to all mass analyzer types tandem an hybrid instruments and most ion source types that produce ions from gas, liquid or solid phases.

SUMMARY OF THE INVENTION

The invention, as described below includes a number of embodiments. Each embodiment contains at least one multipole ion guide located in and operated in higher background pressure vacuum regions where multiple collisions between ions and neutral background gas occur. Although the invention can be applied to multipole ion guides with any number of poles, the description will primarily refer to quadrupole ion guides. In one embodiment of the invention, the quadrupole ion guide is configured in a vacuum region with background pressure maintained sufficiently high to cause collisional damping of the ions traversing the ion guide length. The quadrupole ion guide, positioned in the higher pressure vacuum region, can be operated in trapping mode, single pass ion transmission mode, single or multiple mass to charge selection mode and/or resonant frequency CID ion fragmentation mode with or without stopping a continuous primary ion beam. In one embodiment of the invention, a high pressure quadrupole ion guide is operated to achieve single or multiple mass to charge range selection by ejected unwanted ions traversing or trapped in the ion quadrupole volume. Unwanted ion ejection is achieved by applying resonant or secular frequency waveforms to the ion quadrupole rods over selected time periods with or without ramping or stepping of the RF amplitude. In yet another embodiment of the invention ion, +/− DC potentials are applied to the poles of the quadrupole ion guide during mass to charge selection. The +/− DC potential is applied to the quadrupole rods or poles while ramping or stepping the RF amplitude and applying resonant frequency excitation waveforms to eject unwanted mass to charge values. In another embodiment of the invention, at least one quadrupole ion guide positioned in a higher pressure region and operated in mass to charge selection and/or ion CID fragmentation mode is configured as a segmented or sectioned multipole ion guide. The segmented ion guide may include two or more sections where the RF voltage is applied to all segments from a common RF voltage supply. In one embodiment of the invention at least one segment of the segmented quadrupole is operated in RF only mode while at least one other segment is operated in mass to charge selection and/or CID ion fragmentation mode. Individual DC offset potentials can applied to each segment independently allowing trapping of ions in the segmented quadrupole assembly or moving of ions from one segment to the an adjacent segment size.

In another embodiment of the invention a segmented multipole ion guide is configured such that at least one segment extends continuously into multiple vacuum stages. A portion of the multiple vacuum stage multipole ion guide is positioned in a vacuum region where the pressure in the ion guide volume is maintained sufficiently high to cause multiple ion to neutral collisions as the ions traverse the segmented ion guide length. The RF voltage is applied from a common RF voltage supply to all segments or sections of the multiple vacuum stage multipole ion guide. At least one section of the segmented multiple vacuum stage multipole ion guide can be operated in trapping mode, single pass ion transmission mode, single or multiple mass to charge selection mode and/or resonant frequency CID ion fragmentation mode with or without stopping a continuous primary ion beam. In one embodiment of the invention, one or more segments of the multiple vacuum pumping stage ion guide are operated in RF only mode while at least one segment is operated in mass to charge selection or CID ion fragmentation mode. Mass to in at least one segment of the multiple vacuum stage segmented ion guide can be achieved by applying RF and +/− DC potentials to the ion guide poles. Alternatively, ejection of unwanted ions in mass to charge selection mode can be achieved by applying resonant frequency waveforms with or without stepping the RF amplitude. The range of frequency components required to eject unwanted ion mass to charge values can be reduced by adding +/− DC voltage to the rods with or without varying the RF amplitude during ion mass to charge selection operation. In one embodiment of the invention, individual offset potentials can be applied to different segments of the multiple vacuum stage multipole ion guide. Offset potentials can be set on individual ion guide segments to trap ions within the volume defined by the surrounding segmented ion guide poles or to move ions from one segment to the next. The vacuum pressure along at least one segment of the multiple vacuum stage ion guide varies along the axial length of said segment.

The invention can be configured with several types of ion sources, however, the embodiments of the invention described herein comprise mass analyzers interfaced to atmospheric pressure ion sources including but not limited to Electrospray, APCI, Inductively Coupled Plasma (ICP) and Atmospheric Pressure MALDI. In the embodiments described, the primary source of background gas in the multipole ion guides configured in higher pressure vacuum regions is the Atmospheric Pressure Ion source itself. This configuration avoids the need to add additional collision gas to a separate collision cell positioned in a lower pressure vacuum region. Elimination of a separate collision cell in an API mass analyzer, reduces the vacuum pumping speed requirements, system size and complexity. Reduced size and complexity lowers the mass analyzer cost without decreasing performance or analytical capability. As will become clear from the description given below, a mass analyzer configured and operated according to the invention has increased performance and analytical range over the prior art.

In another embodiment of the invention, individual multipole ion guide assemblies are configured along a common centerline where the junction between two ion guides is positioned in a higher pressure vacuum region. Ion collisions with the background gas on both sides the junction between two axially adjacent multipole ion guides serve to damp stable ion radial trajectories toward the centerline where fringing fields are minimized. Forward and reverse direction ion transmission transmission efficiency between multipole ion guides is maximized by minimizing the fringing fields effects between at junction between two ion guides. In anther aspect of the invention, no electrode is configured in the junction between two adjacent quadrupole ion guides configured along the common quadrupole axis. The two adjacent quadrupole assemblies, configured according to the invention have the same radial cross section pole dimensions and pole elements are axially aligned at the junction between the two quadrupole ion guides. Each quadrupole assembly has an independent set of RF, resonant frequency, +/− DC and DC offset voltage supplies. In another aspect of the invention, common RF frequency and phase is maintained on adjacent and axially aligned poles of adjacent axially aligned quadrupole ion guides. The RF amplitude, resonant frequency waveforms, +/− DC amplitude and the DC offset potentials applied to the poles of adjacent quadrupole ion guides can be independently adjusted for each quadrupole ion guide assembly. Adjustment of relative DC offset potentials allows ions with stable trajectories to move in the forward or reverse direction between the two quadrupoles high transmission efficiency due to minimum fringing field effects. In another aspect of the invention, at least one segmented quadrupole ion guide assembly is configured in axial alignment with another quadrupole ion guide where the junction between the two quadrupole ion guide assemblies is positioned in a region of higher background pressure. The junction between the adjacent quadrupole ion guides may or may not be configured with an additional electrode. In another aspect of the invention at least one quadrupole ion guide that extends continously into multiple vacuum pumping stages is configured in axial alignment adjacent to another quadrupole ion guide assembly. It is another aspect of the invention that at least one section of at least one quadrupole in the above listed axially aligned quadrupole combinations is operated in mass to charge selection and/or CID ion fragmentation mode. Mass to charge selected ions traversing one quadrupole assembly can be accelerated from one quadrupole into an adjacent quadrupole through an offset voltage amplitude difference sufficient to cause CID ion fragmentation. The background gas present in the region of the junction between the two adjacent quadrupole ion guides serves as the collision gas for ions axially accelerated from one quadrupole ion guide into the next. Forward or reverse direction ion acceleration with sufficient offset voltage amplipltude differential applied can be used to fragment ions through Collisional Induced Dissociation.

At least one section of each quadrupole ion guide configured in a multiple quadrupole axially aligned assembly is configured to operate in ion trapping or single pass transmission mode, single or multiple mass to charge selection mode and resonant frequency CID ion fragmentation modes. $MS/MS^n$ analytical functions can be achieved by running mass to charge selection in conjunction with DC acceleration CID ion fragmentation. DC acceleration fragmentation is achieved by accelerating mass to charged ions in the forward or reverse direction between adjacent ion guides. Alternatively ions can be fragmented using resonant frequency excitation CID fragmentation in the volume defined within an ion guide segment in at least one quadrupole ion guide. Combinations of mass to charge selection with DC acceleration and resonant frequency excitation CID fragmentation can be run in the axially aligned multiple quadrupole ion guide assembly configured in a higher pressure vacuum region to achieve a wide range of $MS/MS^n$ analytical functions. In one aspect of the invention, the final mass analysis step in an $MS/MS^n$ analysis sequence can be conducted using a quadrupole mass analyzer. A dual quadrupole ion guide assembly can be configured according to the invention as part of a triple quadrupole mass analyzer. Alternatively, a three quadrupole ino guide assembly can be configured according to the invention encompassing the entire triple quadrupole mass analyzer MS and MS/MS functionality with continuous ion beams.

In another embodiment of the invention, a multiple quadrupole ion guide axially aligned assembly where at least one junction between two adjacent ion guides is located in a higher pressure vacuum region, is configured with a TOF mass analyzer. At least one quadrupole ion guide in the multiple quadrupole assembly is configured to be operated in mass to charge selection and/or CID ion fragmentation mode. In on aspect of the invention, TOF mass analyzer is configured and operated to conduct the last mass analysis step in any $MS/MS^n$ analytical sequence. Single step MS/MS analysis can be achieved by first conducting a mass to charge analysis step and second an ion fragmentation step with resonant frequency excitation or DC acceleration CID within the multiple quadrupole ion guide assembly configured according to the invention. The mass to charge analysis of the resulting product ions is conducted in the Time-Of-Flight mass analyzer. The mass to charge selection and ion fragmentation steps in the MS/MS analysis can be conducted with or without ion trapping and without stopping the primary in beam. $MS/MS^n$ analysis, where $n>1$, can be achieved by conducting sequential mass to charge selection and ion fragmentation steps using the multiple quadrupole ion guide assembly configured according to the invention. Different methods for conducting mass to charge selection and ion fragmentation can be combined in a given $MS/MS^n$ sequence wherein the final mass to charge analysis step is conducted using the TOF mass analyzer. In one embodiment of the invention, an API source is interfaced to the multiple quadrupole-TOF hybrid mass analyzer configured according to the invention.

In yet another embodiment of the invention, a segmented ion guide wherein at least one segment extends continuously into multiple vacuum pumping stages is configured with a TOF mass analyzer. At least one segment of the multiple vacuum pumping stage segmented multipole ion guide is configured to conduct ion mass to charge selection and CID fragmentation with or without trapping of ions. In one embodiment of the invention at least one multiple vacuum stage segmented quadrupole ion guide is included in a multiple quadrupole ion guide assembly configured with a TOF mass analyzer. $MS/MS^n$ analytical functions can be achieved by conducting one or more ion mass to charge selection and CID fragmentation steps in the multiple quadrupole ion guide assembly prior to conducting mass to charge analysis of the product ion population using the Time-Of-Flight mass analyzer. In one embodiment of the invention, the size of the quadrupole assembly is reduced resulting in decreased cost and size of a benchtop API multiple quadrupole-TOF mass analyzer. In one aspect of the invention, the multiple quadrupole-TOF hybrid mass analyzer can be operated whereby ion mass to charge selection and fragmentation can be conducted in a manner that can duplicate and improve the performance of triple quadrupole MS and MS/MS mass analysis routines. Alternatively, the same multiple quadrupole-TOF hybrid mass analyzer can be operated whereby ion trapping, single or multiple steps of ion mass to charge selection and ion fragmentation can be conducted in a manner that can duplicate and improve the performance of three dimensional ion trap MS and $MS/MS^n$ mass analysis routines. The same multiple quadrupole-TOF mass analyzer configured according to the invention can run MS and $MS/MS^n$ routines that can not be conducted by any mass spectrometer described in the prior art.

In another embodiment of the invention, multiple quadrupole ion guide assemblies configured and operated according to the invention, are configured in hybrid mass analyzer that include Fourier Transform, three dimensional ion trap or magnetic section mass analysis. In one aspect of the invention, segmented multipole ion guides that extend continuously into multiple vacuum pumping stages are configured with Fourier Transform, three dimensional ion trap or magnetic sector mass analyzers.

High ion transmission efficiencies can be achieved in segmented multiple vacuum pumping stage multipole ion guides or multiple quadrupole ion guide assemblies configured according to the invention. Ions can traverse between multiple ion guides configured with the junction between adjacent axially aligned quadrupole ion guides located in a higher pressure vacuum region while remaining in stable radial trajectories. Consequently minimum loss of desired mass to charge value ions occur during trapping in or traversing through the multiple quadrupole ion guide assembly configured according to the invention. In one embodiment of the invention, the individual RF voltage supplies applying potentials to each individual quadrupole assembly of the multiple quadrupole assembly have variable amplitudes but the same frequency and phase RF output. Consequently, ions whose m/z values have stable trajectories traversing the multiple quadrupole ion guide assembly length can selectively remain in a stable trajectory through the entire multiple quadrupole ion guide assembly length. Ions with low axial translational energies can be efficiently transported through multiple segmented or non segmented quadrupole ion guides enabling higher resolution in mass selection or mass analysis operation. Ions can also be trapped in selected sections of each segmented or non segmented quadrupole ion guide and transferred when required to improve duty cycle and achieve a wide range of mass analysis operations. An important feature of multipole ion guides or individual segments of a segmented ion guide operated in trapping mode is that ions can be released from one end of an ion guide or segment simultaneously while ions are entering the opposite end of the ion guide or individual segment. Due to this feature, a segmented ion guide receiving a continuous ion beam can selectively release only a portion of the ions located in the ion guide into an axially aligned adjacent ion guide or other mass analyzer such as TOF. In this manner ions are not lost in between mass analysis steps. Ions can also be transferred back and forth between multipole ion guide assemblies or between segments within multipole ion guide assemblies allowing the performing of an array of mass analysis operations that are not possible with prior art mass analyzer configurations.

BRIEF DESCRIPTION OF THE FIGURES

Ion Guide Mass Selection TOF

DETAILED DESCRIPTION OF THE INVENTION AND THE PREFERRED EMBODIMENTS

Figure 1:
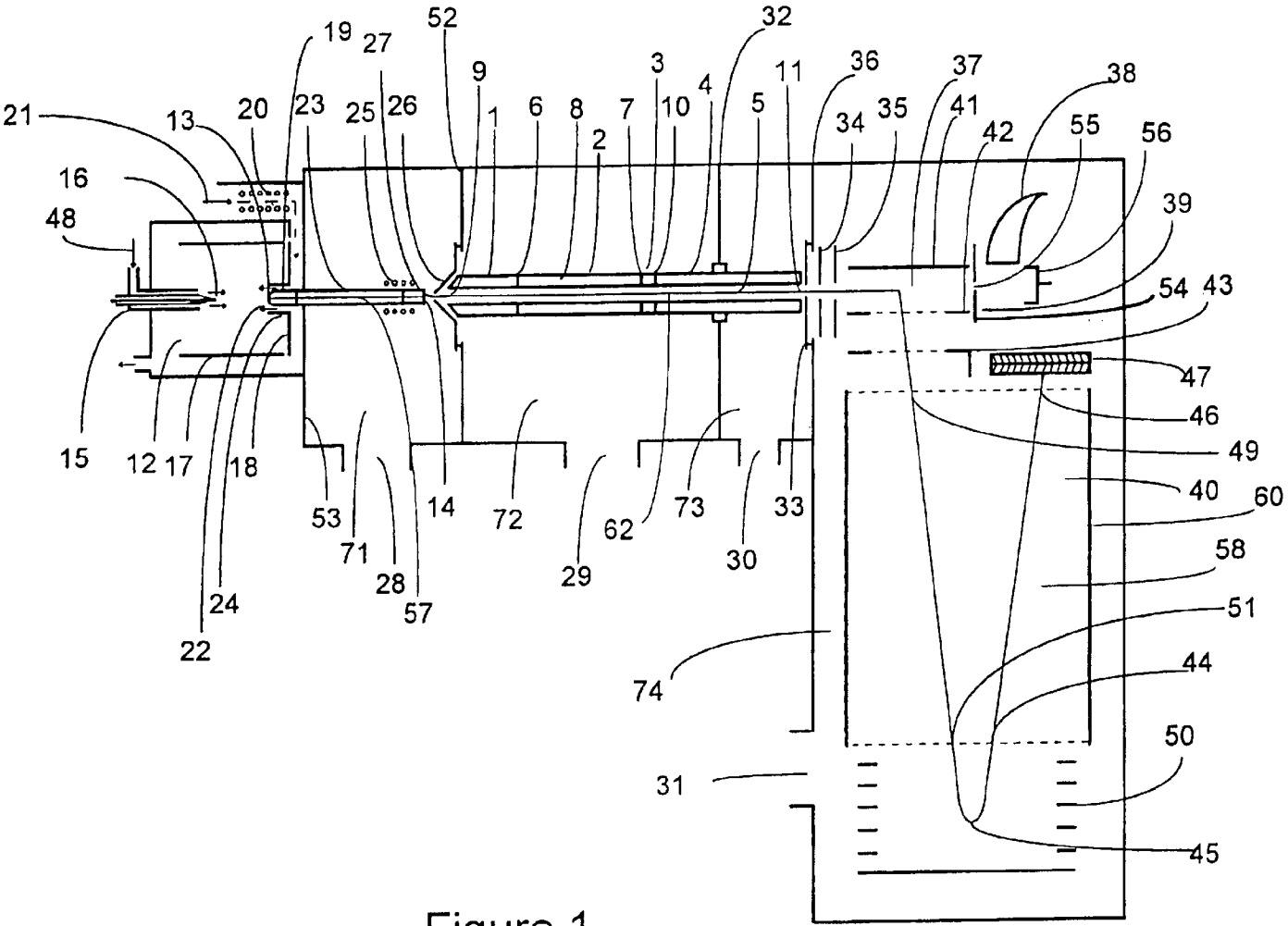
FIG. 1 is a diagram of an Electrospray ion source orthogonal pulsing Time-Of-Flight mass analyzer with an ion reflector configured with three independent multipole ion guides configured along a common axis. The third multipole ion guide extends continuously from vacuum stage two into vacuum stage three.

A multipole ion guide which extends continuously from one vacuum pumping stage into at least one additional vacuum pumping stage configured in a mass analyzer apparatus has been described in U.S. Pat. No. 5,652,427. Ion trapping within a multipole ion guide coupled with release of at least a portion of the ions trapped within the multipole ion guide followed by pulsing of the released ions into the flight tube of a Time-Of-Flight mass analyzer flight tube is described in U.S. Pat. No. 5,689,111. The operation of a multipole ion guide configured in an API TOF mass analyzer to achieve MS and $MS/MS^n$ analytical capability has been described in U.S. patent application Ser. No. 08/694,542. The inventions described in the following sections include new embodiments of multipole ion guides, new configurations multiple ion guide assemblies and their incorporation into mass analyzers with new methods of operating said ion guides and mass analyzers. The inventions improve the performance and analytical capability of the mass analyzers in which they are configured while in some embodiments reducing the size and cost of said instruments when compared to prior art configurations.

Multipole ion guides have been employed for a wide range of functions including the transport of ions in vacuum and for use as ion traps, mass to charge filters and as a means to fragment ion species. A conventional multipole ion guide consists of a set of parallel electrodes, poles or rods evenly spaced at a common radius around a center point. Sinusoidal voltage or alternating current (AC or RF) potentials and +/− DC voltages are applied to the ion guide rods or electrodes during operation. The applied AC and DC potentials are set to allow a stable ion trajectory through the internal volume of the rod length for a selected range of mass to charge (m/z) values. These same AC and DC voltage components can be set to cause an unstable ion trajectory for ion mass to charge values which fall outside the operating stability window. An ion with an unstable trajectory will be rejected from the ion guide volume before the ion traverses the ion guide length. Multipole ion guides are typically configured with an even set of poles, 4 poles (quadrupole), 6 poles (hexapole), 8 poles (octapole) and so on. Odd number multipole ion guides have also been described but have not been commonly used in commercial instruments. Quadrupoles, hexapoles and octapoles operating with RF or AC only voltages applied only have been used in ion guides in mass spectrometer instruments. Where m/z selection is required, quadrupoles can achieve higher mass to charge selection resolution than hexapoles or octapoles. Quadrupole ion guides operated as mass analyzers have been configured with round rods or with the more ideal hyperbolic rod shape. For a given internal rod to rod spacing ($r_0$), the effective entrance acceptance area through which an ion can successfully enter the multipole ion guide without being rejected or driven radially out of the center volume, increases with an increasing number of poles. A multipole ion guides configured a higher numbers of poles, operated in RF only mode, can transfer a wider range of ion mass to charge values in a stable trajectory than a multipole ion guide configured with a lower number of poles. Due to the performance differences in multipole ion guides with different numbers of poles, a suitable choice of ion guide will depend to a large measure on its application. The term triple quadrupole is conventionally used to describe a configuration of three multipole ion guides axially aligned and separated by electrodes in a single vacuum pumping stage with MS/MS operating capability. The collision cell in such "triple quadrupoles" is often a hexapole or octopole operated in RF only mode.

The multipole ion guides described in the invention can be configured with any number of poles. Where an assembly of individual ion guides are configured, a mixture of quadrupole and hexapole or octapoles may be preferred for optimal performance. Multipole ion guide rod assemblies have been described which are configured with non parallel and conical rods that can produce an asymmetric electric field on the z or axial direction during operation. This axial electric field can aid in pushing the ions through the length of the ion guide more rapidly than can be achieved with a parallel set of rods for a given application, usually involving high background pressure. Although, adding an axial field can aid in ion movement through the multipole ion guide assembly, the rod geometry configured to provide an axial field can compromise mass to charge selection resolution and increase the complexity and cost of fabrication. To aid in the clarity of the description, the inventions described below are configured with parallel rod or electrode assemblies. Axial fields within a given multipole ion guide assembly are configured in some embodiments using RF only entrance and exit pole sections or segments.

Single section or segmented multipole ion guide assemblies can be configured such that at least one segment to extends from one vacuum pumping stage continuously into at least one adjacent vacuum pumping stage. Individual multipole ion guides with like cross sectional geometries can be configured as axially aligned assemblies with at least one junction between ion guides located in a higher pressure vacuum pumping region where multiple ion to neutral gas collisions occur. The higher background vacuum pressure region can be used effectively to achieve analytical functions such as collisional induced dissociation (CID) of ions in the same vacuum pumping stage where ion mass to charge selection is also performed. Segmented or non segmented multipole ion guides which extend continuously from one vacuum pumping stage into another in an atmospheric pressure ion source mass spectrometer instrument can efficiently transport ions over a wide range of background pressures. Multipole ion guides can deliver ions from an atmospheric pressure ion source to a mass analyzers including but not limited to TOF, FTMS, Quadrupoles, Triple Quadrupoles, magnetic sector or three dimensional ion traps. Alternatively, assemblies of segmented or non segmented multipole ion guides configured with at least portion of the multiple ion guide assembly positioned in a higher vacuum pressure region can be operated directly as a mass analyzer with MS and MS/MS analytical capability.

An important feature of multipole ion guides is that ions can be released from one end of an ion guide assembly or segment simultaneously while ions are entering the opposite end of the ion guide assembly or individual segment. Due to this feature, a multipole ion guide receiving a continuous ion beam operataing in trapping mode can selectively release only a portion of the ions located in the ion guide into another ion guide, ion guide segment or another mass analyzer which performs mass analysis on the released ions. In this manner ions from a continuous ion beam are not lost in during discontinuous between mass analysis steps. One preferred embodiment of the invention is the configuration of a hybrid API-quadrupole-TOF mass analyzer comprising an API source, an assembly of three quadrupole ion guides with two quadrupole mass analyzers operated in mass to charge selection and ion fragmentation modes and a Time-Of-flight mass analyzer. With a multiple quadrupole ion guide assembly configured in such a hybrid API-quadrupole-TOF mass analyzer, a wide range of MS and $MS/MS^n$ analytical functions can be high duty cycle with high duty cycle, mass to charge resolution and mass measurement accuracy.

In the following description of the invention, three primary configurations are shown with alternative embodiments described for each configuration. The first embodiment is the configuration of a multiple quadrupole ion guide Time-Of-Flight hybrid mass spectrometer apparatus. Although the hybrid instrument as described includes a TOF mass analyzer, an FTMS, magnetic sector, three dimensional ion trap or quadrupole mass analyzer can be substituted for the TOF MS. The second embodiment is the configuration of an assembly of individual quadrupole ion guides with at least one junction between ion guides located in a higher pressure vacuum region to achieve the MS and MS/MS analytical functions of prior art configurations of triple quadrupole mass analyzers. The third embodiment described is the configuration of a quadrupole ion guide positioned in a higher vacuum background pressure region and operated in mass to charge selection mode. The third embodiment can be operated to achieve the API MS functions of prior art configurations of low vacuum pressure single quadrupole mass analyzers. The small size higher pressure quadrupole ion guide can be configured as a smaller an lower cost when compared to prior art API MS instruments.

Figure 2:
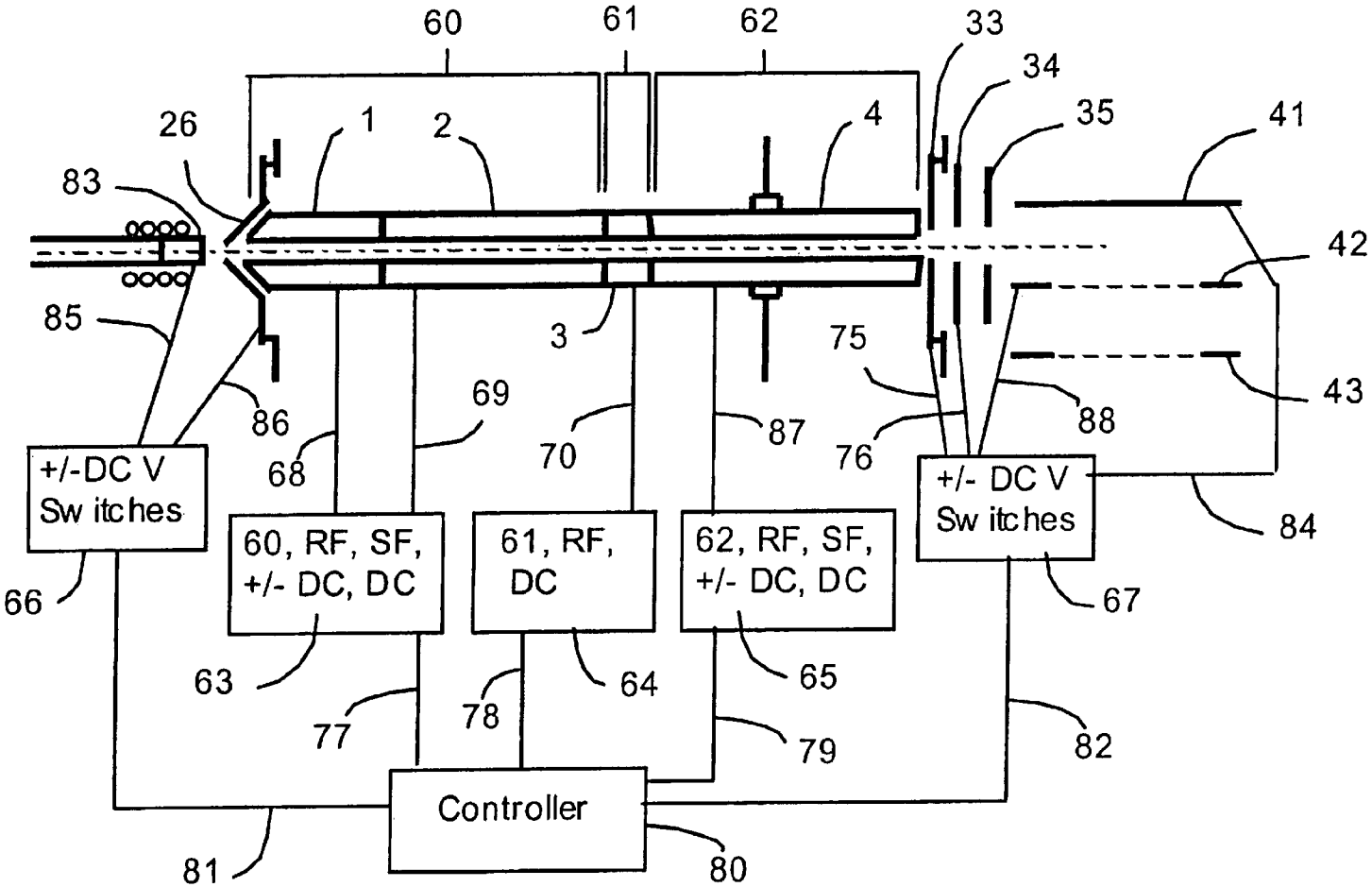
FIG. 2 is a diagram of the configuration of electronic voltage and control modules for the three multipole ion guide assembly and surrounding electrodes diagrammed in FIG. 1.

A preferred embodiment of the invention is diagrammed in FIG. 1. A linear assembly 8 of three independent quadrupole ion guides is configured in a four vacuum pumping stage hybrid API source-multiple quadrupole-TOF mass analyzer. Referring to FIGS. 1 and 2, multiple quadrupole ion guide assembly 8 comprises three independent quadrupole ion guide assemblies 60, 61 and 62, positioned along common axis 5. Alternatively, quadrupole ion guide assemblies 60, 61 and 62 pole ion guide can be configured with six, eight or more rods or poles, however, the ion mass to charge selection resolving power that can be achieved using multipole ion guides decreases as the number of poles increases. Higher ion mass to charge selection resolution can be achieved with quadrupoles (four poles) when compared with hexapoles (six poles), octapoles (eight poles) or ion guides with more than eight poles or odd numbers of poles. Consequently, quadrupoles have been commonly used as mass analyzers. Hexapoles and octapoles which have a broader m/z stability window and a larger effective entrance acceptance area, when compared to quadrupoles, are often used in RF only mode to efficiently transport and trap ions in low and higher pressure vacuum regions. The multipole ion guides diagrammed in the preferred embodiments presented will be described as quadrupoles as this configuration can achieve increased ion mass to charge selection resolution compared with the performance of multipole ion guides with higher numbers of poles. However, for some functions and methods of invention, multipole ion guides configured with six or more poles can be readily substituted for the quadrupole ion guides used in the embodiments diagrammed.

Quadrupole ion guide assembly 60 comprises four parallel electrodes, poles or rods equally spaced around a common centerline 5. Each pole comprises two sections. Each electrode of section 1 has a tapered entrance end contoured to match the angle of skimmer 26. Power supply 63 applies RF, AC and DC potentials to both segments of segmented quadrupole 60. Quadrupole assembly 60, 61 and 62 are configured along common axis 5 where the junctions 7 and 10 between each independent quadrupole assembly are positioned in higher pressure vacuum stage 72. Vacuum stages 71, 72, 73 and 74 are typically maintained at pressures 1 to 2 torr, 1 to 10 millitorr, 1 to $8\times10^{-5}$ torr and 1 to $5\times10^{-7}$ torr respectively. Ions experience several collisions with the neutral background gas molecules as they traverse the volume defined by quadrupoles 60, 61 and 62 in vacuum stage 72. Unlike the prior art, no electrodes are configured in junctions 7 and 10 between independent quadrupole assemblies 60, 61 and 62. To avoid fringing field effects and maximize ion transmission between quadrupole assemblies, quadrupole ion guide assemblies 60, 61 and 62 are configured with the same radial cross section geometries with poles aligned. In addition, independent RF generators configured in power supplies 63, 64 and 65 are sychronized to apply the same RF frequency and phase to axially aligned adjacent quadrupole electrode. As will be described below individual quadrupole ion guide assemblies 60 and 62 can be independently operated in mass to charge selection and ion fragmentation modes to achieve $MS/MS^n$ functions with Time-Of-Flight mass analysis. Segmented ion guides are configured such that the same RF voltage supply applies voltage to all segments of the ion guide assembly. Junction 6 between segments 1 and 2 is configured to of maximize capacitive coupling between adjacent axially aligned poles. RF is typically capacitively coupled to each quadrupole section in a segmented ion guide. This allows different DC offset potentials to be applied to different sections of a segmented ion guide to affect ion movement through the segmented multipole ion guide. Typically sections positioned at a quadrupole entrance end are operated in RF only mode to minimize fringing field effects when the analytical section of the segmented quadrupole is operated in mass to charge selection mode. Junctions 7 and 10 between quadrupole assemblies 60 and 61 and 61 and 62 respectively are configured according to the invention to eliminate or minimize capacitive coupling between independently operating quadrupole assemblies. Beat frequency or constructive of destructive interference between waveforms between quadrupole assemblies 60 and 62 during ion mass to charge selection and fragmentation operation is prevented by eliminating capacitive coupling between the two quadrupole assemblies. Quadrupole assembly 61 with independent RF and DC power supply 64 prevents or minimizes capacitive coupling between quadrupole assemblies 60 and 62 while maximizing ion transfer efficiency along the multiple quadrupole assembly axis 5. Alternatively, quadrupole 61 can be configured as a single flat electrode with an aperture centered on centerline 5 with DC applied to isolate quadrupole assemblies 60 and 62. The preferred embodiment is the configuration of quadrupole 61 having the same radial cross section as quadrupoles 60 and 62 with poles axially aligned.

Figure 9:
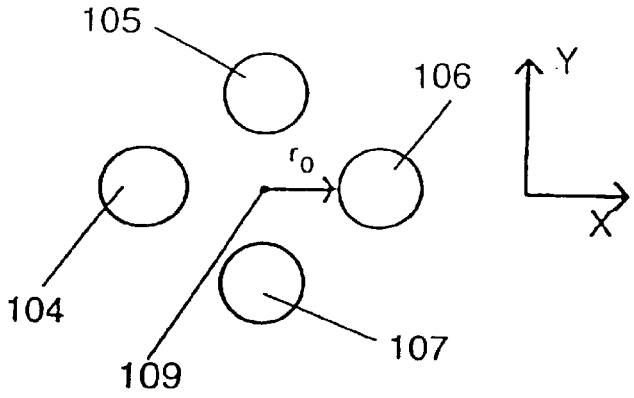
FIG. 9 is a diagram of the cross section of a quadrupole ion guide configured with round rods.

In an ideal quadrupole ion guide the pole shapes would be hyperbolic but commonly, for ease of manufacture, round rods are used. A cross section of a quadrupole with round rods 104, 105, 106, and 107 is diagrammed in FIG. 9. The same AC and DC potentials are applied to opposite pole sets (104, 106 and 105, 107) for most quadrupole operating modes. Adjacent poles have the same primary RF frequency and amplitude but a phase difference of 180 degrees. When the offset or common DC potential is subtracted, adjacent poles generally have the same amplitude but opposite polarity DC potentials applied. In addition to the primary RF electrical component resonant frequency AC voltage can be applied to the quadrupole rods to achieve m/z selection and ion fragmentation functions. A common DC offset can be applied to all rods 104, 105, 106, and 107 as well. The primary RF, opposite polarity DC, common DC and resonant frequency potentials can be applied simultaneously or in part to the poles of a segmented quadrupole ion guide to achieve a range of analytical functions. When an ion guide is segmented into sections, each pole or rod is broken up into electrically insulated sections which, when assembled, align as a single continuous rod. Each segment within a rod assembly is electrically insulated from its adjacent segments. The insulation is configured between each rod section to minimize space charge effects which could distort the electric fields within the region bounded by the rods. Junctions 7 and 10 between quadrupole assemblies 60 and 61 and 61 and 62 respectively are configured to minimize space charge effects and RF field distortion to maximize stable ion transmission efficiency between individual quadrupole ion guides 60, 61 and 62 multiple quadrupole ion guide assembly 8.

In the embodiment shown in FIG. 1, segmented quadrupole assembly 60, quadrupole assembly 61 and the entrance end of multiple vacuum stage quadrupole assembly 62 are positioned in second vacuum pumping stage 72 where the operating background pressure is greater than $1\times10^{-4}$ torr. At background pressures greater than $1\times10^{-4}$ torr, typically maintained in the 1 to 10 millitorr range, ions traversing the multiple quadrupole assembly length will encounter collisions with the neutral background gas. One or more quadrupole assemblies of multiple quadrupole ion guide assembly 8 can be operated in mass to charge selection mode. Mass to charge selection operation can be achieved by applying a combination of RF and DC potentials, applying specific resonant frequencies at sufficient amplitude to reject unwanted ion m/z values, ramping the RF frequency or amplitude with or without +/− DC ramping or combinations of these techniques. Those portions multiple quadrupole assembly 8 located in the higher pressure region of vacuum stage 72 can also be configured to operate in ion transfer, ion trapping, and Collisional Induced Dissociation fragmentation modes as well as m/z selection mode or with combination of these individual operating modes. Operating a portion of multipole ion guide in higher background pressure in an API MS system can improve ion transmission efficiencies as was described in U.S. Pat. Nos. 5,652,427 and 4,963,736. In m/z analysis or m/z selection operating mode, ion collisions with the background gas slow down the selected ion m/z trajectories in the radial and axial directions as the ions traverse the multipole ion guide length in single pass or multiple pass ion trapping mode. Ions spending increased time in the multipole ion guide are exposed to an increased number of RF cycles. In this manner higher m/z selection resolution can be achieved for shorter multipole ion guide lengths than can be attained using a quadrupole mass analyzer with the more conventional method of operating in low background pressure single pass non trapping mode. Operating multipole ion guides in mass selection mode in higher pressure background gas allows the configuration of smaller more compact systems with reduced vacuum pumping speed requirements. A smaller multipole ion guide configuration reduces the cost of driver electronics and the higher pressure operation reduces the vacuum system costs. An instrument configured with a segmented multipole ion guide, a portion of which is configured in a higher vacuum pressure region can achieve improvement in the API MS system performance at lower cost when compared to an instrument which includes one or more quadrupole mass analyzer operating at background pressure maintained low enough to avoid or minimize ion collisions with neutral background gas.

Electrospray probe 15 in FIG. 1 can be configured to accommodate solution flow rates to probe tip 16 ranging from below 25 nl/min to above 1 ml/min. Alternatively, the API MS embodiment diagrammed in FIG. 1 can be configured with but is not limited to Atmospheric Pressure Chemical Ionization (APCI), Inductively Coupled Plasma (ICP), Glow Discharge (GD) source, multiple probes in one source, or combinations of different probes in one source. Ion sources which operate in vacuum or partial vacuum such as but not limited to Chemical Ionization (CI), Electron Ionization (EI), Fast Atom Bombardment (FAB), Flow FAB, Laser Desorption (LD), Matrix Assisted Laser Desorption Ionization (MALDI), Thermospray (TS) and Particle Beam (PB) can also be configured with the hybrid mass analyzer configuration diagrammed in FIG. 1. Sample bearing solution can be introduced into ES probe 15 using a variety of liquid delivery systems. Liquid delivery systems may include but are not limited to, liquid pumps with or without auto injectors, separation systems such as liquid chromatography or capillary electrophoresis, syringe pumps, pressure vessels, gravity feed vessels or solution reservoirs. ES source 12 is operated by applying potentials to cylindrical electrode 17, endplate electrode 18 and capillary entrance electrode 19. Counter current drying gas 21 is directed to flow through heater 20 and into ES source chamber 12 through endplate nosepiece 24 opening 22. Orifice 57 into vacuum as shown in FIG. 1 is the bore through dielectric capillary tube 23 with entrance orifice 13. The potential of an ion being swept through dielectric capillary tube 23 into vacuum is described in U.S. Pat. No. 4,542,293. Ions enter and exit the dielectric capillary tube with potentials toughly equivalent to the entrance and exit electrode potentials respectively. The use of dielectric capillary 23 allows different potentials to be applied to the entrance and exit ends of the capillary during operation. This effectively decouples the API source from the vacuum region both physically and electrostatically allowing independent tuning optimization of both regions. To produce positive ions, negative kilovolt potentials are applied to cylindrical electrode 17, endplate electrode 18 with attached electrode nosepiece 24 and capillary entrance electrode 19. ES probe 12 remains at ground potential during operation. To produce negative ions, the polarity of electrodes 17, 18 and 19 are reversed with ES probe 12 remaining at ground potential. Alternatively, if a nozzle or conductive (metal) capillaries are used as orifices into vacuum, kilovolt potentials can be applied to ES probe 12 with lower potentials applied to cylindrical electrode 17, endplate electrode 18 and the orifice into vacuum during operation. With conductive orifices or capillaries, the entrance and exit potentials are equal, so the API source potentials are no longer decoupled from the vacuum region potentials. Heated capillaries can be configured as the orifice into vacuum used with or without counter current drying gas.

With the appropriate potentials applied to elements in ES source chamber 12, Electrosprayed charged droplets are produced from a solution or solutions delivered to ES probe tip 16. The charged droplets Electrosprayed from solution exiting ES probe tip 16 are driven against the counter current drying gas 21 by the electric fields formed by the relative potentials applied to ES probe 15 and ES chamber 12 electrodes 17, 18, and 19. A nebulization gas 48 can be applied through a second layer tube surrounding the sample introduction first layer tube to assist the Electrospray process in the formation of charged liquid droplets. As the droplets evaporate, ions are formed and a portion of these ions are swept into vacuum through capillary orifice 57. If a heated capillary is configured with heater 25 as an orifice into vacuum with or without counter current drying gas, charged droplet evaporation and the production of ions can occur in the capillary as charged droplets traverse the length of capillary orifice 57 towards first vacuum pumping stage 71. A portion of the ions entering first stage vacuum 71 are directed through the skimmer orifice 27 and into second vacuum stage 72.

Ions produced at or near atmospheric pressure from sample bearing liquid in atmospheric pressure ion source 12 are delivered into vacuum through dielectric capillary tube 23 carried along by the neutral background gas. Vacuum partition 53 includes a vacuum seal with dielectric capillary 23. The neutral background gas forms a supersonic jet as it expands into vacuum through capillary exit orifice 14 and sweeps the entrained ions along through multiple collisions during the expansion. The hybrid mass analyzer diagrammed in FIG. 1 is configured with four vacuum pumping stages to remove background neutral gas as the ions of interest traverse from the API source through each vacuum stage during operation. The cost and size of an API/MS instrument can be reduced if it is configured with multiple vacuum pumping stages and the pumping speed required for each stage is minimized. Typically, three to four and in some cases more than four pumping stages are employed in API/MS instruments. With the development of multiple vacuum stage (interstage) turbomolecular vacuum pumps, three and even four stage vacuum systems require only one rotary and one or two turbomolecular pumps to achieve satisfactory background pressures in each stage. Multipole ion guides operated in the AC or RF only mode have been configured in API/MS instruments to transport ions efficiently through second and/or third vacuum pumping stages 72 and 73. In the four vacuum pumping stage embodiment diagrammed in FIG. 1, a rotary vacuum pump is used to evacuate first vacuum stage 71 through pumping port 28 and the background pressure is maintained in first vacuum stage 71 is maintained typically between 0.2 and 2.5 torr. A portion of the free jet expansion and the entrained ions pass through skimmer orifice 27 and into second vacuum pumping stage 72. Skimmer 26 forms a part of vacuum partition 52 dividing first and second vacuum pumping stages 71 and 72. Background pressures in second vacuum stage 72 can typically range from $10^{-4}$ to $2\times10^{-1}$ torr depending on skimmer orifice 27 size and the pumping speed employed in second vacuum stage 72 through vacuum pumping port 29.

Ions entering second vacuum stage 72 through skimmer orifice 27 enter segmented multipole ion guide 8 where they are trapped radially by the electric fields generated from the multipole rod assembly. The locally higher pressure at the entrance region 9 of segmented multipole ion guide 8 damps the ion trajectories as they pass through the fringing fields of the at the entrance end 9 of multipole ion guide 8. This locally higher pressure region at entrance region 9 results in a high capture efficiency for ions entering multipole ion guide 8. Ion m/z values that fall within the operating stability window will remain radially confined within the internal volume described by the rods of segmented multipole ion guide 8. If segment 1 of multipole ion guide 8 is operated in RF only mode, a broad range of m/z values can be efficiently transferred into ion guide segment 2 when the appropriate relative bias voltages are applied between segments 1 and 2. Similarly, when the appropriate relative bias voltages are applied between multipole ion guide segments 2, 3 and 4. ions traversing multipole ion guide segment 2 can pass into segment 4. Ions pass into third vacuum pumping stage 73 while traversing the length of segment 4 of segmented multipole ion guide 8. Multipole ion guide segment 4 passes through but is electrically insulated from vacuum partition 32. Third vacuum stage 73 is evacuated through vacuum pumping port 30. Ions exit segmented multipole ion guide assembly 8 at exit end 10 and pass through electrostatic lenses 33, 34, and 35 into pulsing region 37 of Time-Of-Flight mass analyzer 40. Lens 33 is configured as part of vacuum partition 36 between pumping third and fourth vacuum stages 73 and 74.

Time-Of-Flight mass analyzer 40 is configured in fourth vacuum stage 74 and this vacuum stage is evacuated through pumping port 31. Fourth vacuum stage 74 is typically maintained in the low $10^{-6}$ to $10^{-7}$ torr vacuum pressure region. TOF pulsing region 37 is bounded by electrostatic lenses 41 and 42. Ions which exit from multipole ion guide 8 move into TOF pulsing region 37 can be pulsed into the TOF mass analyzer or can continue through pulsing region 40 passing through orifice 55 in lens 54. By applying appropriate voltages to lens 54, channeltron detector 38, conversion dynode 39 and Faraday cup 56, ions passing through orifice 55 can be directed to impact on conversion dynode 39 or be collected in Faraday cup 56. In the mass analyzer embodiment diagrammed in FIG. 1, ions entering TOF pulsing region 37 can be either TOF mass analyzed, detected by channeltron detector 38 or detected with Faraday cup 56. Ions enter TOF pulsing region 37 when lenses 41, 42 and 43 are set at the approximately the same potential. In the TOF configuration diagrammed in FIG. 1, TOF flight drift region 58 is maintained at kilovolt potentials when the appropriate voltage is applied to lens 60. Negative voltage is applied to lens 60 for positive polarity ions and positive voltage is applied for negative polarity ions TOF during operation. With TOF drift region 58 maintained at kilovolt potentials, a voltage value at or near ground can be applied to pulsing lenses 41, 42 and 43 when ions are entering and pulsing region 37. Positive ions are pulsed into TOF drift region 56 by raising the potential of pulsing lens to 41 some positive voltage, raising 42 to approximately half that positive voltage, and leaving lens 43 at ground potential. The positive ions are accelerated out of pulsing region 37 and to entrance 49 of TOF drift region 58. The velocity of ions traversing drift region 58 remains constant until ions enter ion reflector 50 at entrance point 51. Ions entering ion reflector 50 are initially decelerated and then re-accelerated beginning at point 45, exiting the reflector at point 44. Once again, the velocity of the ions traversing drift region 58 is constant until the ions through flight tube lens 60 grid at point 46. Ions are post accelerated from point 46 onto the surface of multichannel plate detector 47 where they are detected. Negative ions are pulsed from pulsing region 37 and directed to the surface of detector 47 in a similar manner by reversing the voltage polarities. Limited by the flight time of the highest m/z value ion being detected, ions can typically be pulsed from pulsing region 37 at a pulsing rate of up to 20,000 times per second. The full mass spectrum pulsed ion signals detected can be added to produce over 100 spectra per second saved to disk. Signal from detector 47 can be recorded with data acquisition systems using Analog to Digital (A/D) converters or Time to Digital converters (TDC). Time-Of-Flight mass analyzer 40 has the capability of detecting full mass spectra of all m/z value ions traversing pulsing region 37. The TOF mass analysis step, initiated with orthogonal pulsing of ions into drift region 58, is decoupled from any trapping, nontrapping, mass selection or ion fragmentation steps which occur prior to the resulting ion population entering pulsing region 37. Using the embodiment diagrammed in FIG. 1, full mass spectra is generated at maximum resolution and sensitivity and if required, at rapid spectra acquisition rates.

Provided that the ion population delivered to pulsing region 37 is properly focused with a minimum off axis component of energy, a range of analytical functions can be achieved upstream of pulsing region 37 without modifying optimal tuning of TOF mass analyzer 40. The hybrid mass analyzer embodiment diagrammed in FIG. 1 is configured to allow a variety of MS and MS/MS$^n$ experiments to be conducted using a number of different techniques. Several combinations of m/z selection and ion fragmentation and mass analysis can be performed sequentially or simultaneously using the embodiment diagrammed in FIG. 1. At least five types of collisionally induced ion fragmentation can be performed. These include:

1. ion acceleration through higher pressure gas in the capillary to skimmer region,
2. single or multiple ion resonant frequency excitation fragmentation a multipole ion guide segments 1, 2 or 4 with or without trapping.
3. ion acceleration from one segment to another in multipole in guide 8 with or without trapping or,
4. higher energy ion acceleration into multipole ion guide 8 from ion guide exit lenses 36 and 34.
5. overfilling of an ion guide segment until CID fragmentation occurs.

At least four types of single or multiple ion mass to charge value selection techniques can be used with multipole ion guide 8 including:

1. Resonant frequency rejection of unwanted ion m/z values with or without trapping in a given ion guide segment.
2. Applying AC and DC potentials to the rods of an ion guide segment to achieve ion m/z selection with or without trapping.
3. Scanning RF amplitude or frequency to remove unwanted ion m/z values from an ion guide segment with or without trapping.
4. Controlling the release of trapped ions into TOF pulsing region 37 as described in U.S. Pat. No. 5,689,111.

Combinations of m/z selection and fragmentation techniques can be selected to optimize performance for a given analytical application. Some examples of combining techniques to achieve optimal MS or MS/MS$^n$ are given below.

Mass selection can be performed with trapping with and without cutting off the ions primary ion beam from entering a given segment where ion mass to charge selection or CID fragmentation is being conducted. Electrospray ion source 12 delivers a continues ion beam into vacuum. By trapping and release of ions in multipole ion guide 8, a continuous ion beam from ES source 12 can be efficiently converted into a pulsed ion beam into TOF pulsing region 37 with very high duty cycle as is described in U.S. Pat. No. 5,689,111. Segmented multipole ion guide 8 can be operated in non trapping or trapping mode where all segments or only selected segments are operated in trapping or non trapping modes. Specific examples of segmented ion guide operating modes will be described below as a means to achieve MS, MS/MS and MS/MS$^n$ analytical functions. In the simplest case, segmented ion guide 4 can be operated as a non segmented ion guide by applying the same AC and DC potentials to all segments of each pole. Single segment MS and MS/MS$^n$ TOF operating sequences are described in U.S. patent application Ser. No. 08/694,542 and need not be repeated here. Instead techniques using multiple segment ion guide operation will be described.

MS TOF Functions

Consider conducting an MS experiment with and without ion fragmentation. If a specific range of ion mass to charge is of interest, one or more multipole ion guide segments can be operated in m/z selection mode. Narrowing the m/z charge range of ions entering TOF pulsing region 37 can improve the duty cycle and TOF system performance in trapping and in non trapping mode. Narrowing the range of m/z values pulsed into TOF drift region 58 allows an increase in TOF pulse rate and duty cycle in non trapping ion guide operation. If a broad range of ion m/z values are pulsed into TOF drift region 58, the pulse rate is limited by the flight time of the heaviest ion m/z. If the next TOF pulse occurs before the all ions from the previous pulse impact on detector 47 then ions from the previous pulse will arrive during acquisition of the subsequent pulse causing chemical noise in the mass spectrum acquired. Restricting the range of m/z ions entering TOF drift region 58 allows the setting of a maximum TOF pulse rate while eliminating chemical noise contributions from adjacent pulses. Preventing unwanted ion m/z values from entering TOF drift region 58 also allows more efficient detector response for those ion m/z values of interest. When an ion impacts a channel of a multichannel plate detector, that channel requires a certain recovery time from its charge depletion. This charge depletion recovery time can be as long as one millisecond during which any ion impacting on this channel would not be detected or would result in reduced secondary electron yield. For example, the arrival of ions from a strong solvent peak signal at low m/z value may be of no interest in a particular analytical experiment but may deaden a significant number of detector channels in TOF each pulse prior to the arrival of higher m/z value ions in the same pulse. The impact of the solvent peak m/z ions on the detector may reduce the full signal from subsequently arriving ions. Rejecting undesired m/z value ions from the multipole ion guide prior to TOF pulsing to limit the ion population pulsed into flight tube drift region 56 to only those m/z values of analytical interest for a given application, helps to improve the TOF sensitivity, consistency in detector response and improves detector life.

Non trapping or trapping mass to charge selection can be conducted in multipole ion guide segment 1, 2 or 4. Consider an example where it is desirable to restrict the m/z range of ions entering TOF pulsing region 37 to the range from 300 to 500 m/z. This can be achieved by a number of methods, a few of which are described in the following examples;

1. Multipole ion guide segment 1 is operated in non trapping RF only mode, operate segment 2 with a low mass cutoff of 300 m/z by applying the appropriate DC an AC amplitudes, segment 3 is operated in non trapping RF only mode and segment 4 is operated in trapping mode with a high mass cutoff of 500 m/z with multiple resonant frequency ejection while retaining an m/z stability window for m/z values below 500 m/z. Ions are trapped in segment 4 and released into TOF pulsing region 37 by gating ions with lens 33, a combination of 33 and 34 or by switching values of the ion guide offset potentials. Such ion trapping and release techniques are described in U.S. Pat. No. 5,689,111. Ions trapped in segment 4 are prevented from moving back into segment 2 by applying the appropriate relative offset potentials to the poles of segments 2 and 3. In this manner, ions moving through segmented multipole ion guide 8 which have m/z values above 500 and below 300 will be rejected before entering TOF pulsing region 37.
2. Multipole ion guide segment 1 is operated in non trapping RF only mode to maximize ion transmission into segment 2. RF and DC amplitude values are applied to segment 2 to pass a m/z range approximately 300 to 500. Segment 4 is operated in RF only trap and release mode where the ion gate release and TOF pulse delay timing is set to pulse m/z values ranging from 300 to 500 into TOF drift region 58 pulsing at a rate of 10,000 Hz.
3. Multipole ion guide segment 1 is operated in non trapping RF only mode to maximize ion transmission into segment 2. A range of resonant frequencies are added to the RF of segment 1 to reject ions above m/z 500 and below m/z 300. Segment 4 is operated in RF only trap and release mode Pulsing at a rate of 10,000 Hz.

Other combinations of multipole ion guide segment operation can be performed to achieve the desired m/z range values released into TOF drift region 58. Based on analytical objectives, the choice of m/z selection or fragmentation in each multipole ion guide segment should be made to maximize performance, particularly ion transmission efficiency. The application of RF and DC to achieve mass selection in quadrupoles may decrease the effective entrance acceptance aperture, reducing ion transmission efficiency for the m,/z values of interest. If mass to charge selection can be achieved with resonant frequency rejection of unwanted ions the quadrupole is operating essentially in RF only mode so that the effective segment entrance acceptance area is not reduced. Mass to charge selection with resonant frequency rejection of unwanted ions also allows the selection of distinct multiple ion m/z values where ion m/z values falling between selected ion m/z values may be rejected. If a narrow m/z selection was desired say 1 m/z unit wide for an MS/MS experiment rather than the 200 m/z range given above, then the m/z selection technique which yields the highest transmission efficiency would be selected. Resonant frequency rejection or combined RF and DC m/z selection techniques with trapping to achieve higher resolution m/z selection can be applied uniformly or in combination to single or multiple segments of multipole ion guide 8. Ion trapping during m/z selection allows the ion population in a given segment to be exposed to more RF cycles before being released to an adjacent segment, effectively increasing m/z selection resolution. Ion collisions with the background neutral gas pressure in second vacuum stage 72 aids in maintaining stable trajectories in segments 1 through 4 for ions which fall in the ion guide stability window. Trapping ions in a given segment allows time for ions which fall outside the stability window, established by the voltages applied to the segment poles, to be rejected from the multipole ion guide even in the presence of ion to neutral gas collisions.

Although different RF frequencies can be set on each segment of multipole ion guide 8, applying the same RF frequency to segments 1 through 4 minimizes the fringing fields between segments and maximizes the efficiency of ion transfer from one segment to the next. Ion m/z values falling within the stability region can move freely from one multipole ion guide segment to the next when the same RF frequency is applied to all segments. The RF amplitude may be set to different values for each ion guide segment to achieve a range of analytical functions. However, reduction in cost of electronics can be achieved if the same RF frequency and amplitude is applied to each ion guide segment. Tradeoffs between system cost and performance flexibility can be decided based on specific analytical applications requirements. In the most flexible embodiment, each segment of multipole ion guide 8 will have it own independently controlled, DC, RF and resonant frequency supplies connected to the poles of each segment. A wide range of analytical functions can be achieved by independently controlling the RF frequency, amplitude, offset DC amplitude, +/− DC amplitude and resonant frequency amplitude and frequency spectrum. The amplitude and frequency components independently set by random wave form generator can be used to apply simple or complex AC wave forms to the poles of a given segment to achieve a range of simultaneous or sequential mass to charge selection and/or CID fragmentation analytical functions. Minimally, each multipole ion guide segment would have an independent DC offset supply or supplies where the DC offset value for a given segment can be rapidly switched during an analytical sequence.

Conversion dynode 39 with detector 55 has been configured to detect ions which traverse pulsing region 37 and are not pulsed into TOF drift region 58. Segments 2 or 4 of segmented multipole ion guide 8 can be operated in non trapping mass to charge selection scan mode with ions detected by detector 55. Alternatively ions can be fragmented with resonant frequency excitation in segment 2 while mass to charge scanning segment 4. Ions exiting segment four pass through TOF pulsing region 37 and through aperture 55 of lens 54 where they are detected on detector 38. Alternatively, ions can be detected using Faraday cup 56. Detector 38 and Faraday cup 56 can be used as diagnostic tools or in some analytical applications. The use of TOF as a full mass spectrum detector will yield higher analytical duty cycle and hence sensitivity than analytical techniques utilizing scanning modes with segments of multipole ion guide 8.

MS/MS$^n$ TOF Functions

The mass analyzer embodiment diagrammed in FIG. 1 comprises a four segment multipole ion guide where segments 1, 2 and 3 and the entrance end of segment 4 are located in the second vacuum pumping stage 72. By setting the appropriate skimmer orifice 27 size and vacuum pumping speed through vacuum port 29, the background pressure in second vacuum stage 72 can be maintained between $1\times10^{-4}$ to over 500 millitorr with reasonable vacuum pumping speeds. For many of the operational sequences described below a background pressure should be maintained where multiple collisions between ions and background gas occurs as ions traverse the on guide length but the mean free path is sufficiently large that ions can be rejected from multipole ion guide 8 with ion m/z selection with AC and DC or resonant frequency rejection within an experimentally useful time frames. The optimal background pressure will be a function of the multipole ion guide geometry including pole to pole spacing and individual segment lengths and the range of MS/MS$^n$ functions that the instrument will be required to perform. For purposes of discussion, consider that the background pressure in second vacuum stage 72 is maintained at pressure between one and ten millitorr. One to ten millitorr is a typical operating pressure found in of three dimensional quadrupole traps and the multipole ion guide collision cells of triple quadrupoles. The background gas in three dimensional ion traps is typically helium and the background gas introduced into the collision cell of a triple quadrupole is typically Argon. The background gas in second vacuum stage 72 will be the composition of countercurrent drying gas 21 from ES source 12. This is typically nitrogen. The composition of the background gas in second vacuum stage 2 can be controlled and maintained quite uniform at all times during MS operation. The pressure in ES source 12 atmospheric chamber is maintained close to atmospheric pressure and the temperature in capillary bore 57 is steady state during MS operation so that the choked gas flux through capillary orifice 57 is consistent for during MS operation. In the embodiment diagrammed in FIG. 1, skimmer orifice 27 is typically positioned inside the supersonic free jet zone of silence upstream of the normal shock. Consequently, the gas flux into second vacuum stage 72 is consistent over time during MS operation. The background pressure consistency in second vacuum stage 72 is primarily determined by the consistency of vacuum pumping speed through vacuum port 29. The use of turbomolecular vacuum pumps to evacuate second stage 72 provides consistent pumping speeds over extended time periods. With the ability to monitor turbomolecular pump RPM, the consistency of pumping speed can be monitored both through vacuum gauge reading and pumping speed verification. With a consistent composition and pressure for the neutral background gas in second vacuum stage 72, consistent and repeatable results can be obtained for a wide range of experimental sequences performed.

The background pressure present in second vacuum stage 72, ions is sufficiently high to be used for ion fragmentation through CID processes but not so high that m/z selection performance or ion transmission efficiency is compromised. The configuration of segmented multipole ion guide 8 combined with TOF mass analysis diagrammed in FIG. 1 allows for performing all MS and MS/MS functions of triple quadrupoles, all MS and MS/MS$^n$ functional sequences of three dimensional ion traps and can perform several MS and MS/MS$^n$ functions that are not possible with either triple quadrupoles or three dimensional quadrupole ion traps. The embodiment shown in FIG. 1 is a hybrid mass analyzer which can perform a wide range of mass analysis analytical functions than is available individually from commercially available triple quadrupoles and ion trap mass spectrometers. Examples of some MS/MS$^n$ functions that can be performed with the hybrid TOF embodiment diagrammed in FIG. 1 will be described below.

MS/MS Hybrid TOF Functions

Four primary MS/MS operating modes are used in triple quadrupoles which employs DC ion acceleration into an RF only collision cell to achieve CID fragmentation. These four modes include:

1. transmitting a selected m/z range in quadrupole 1, fragmented the selection ions in the RF only collision cell while scanning quadrupole 3,
2. neutral loss scan, where quadrupole 1 and 3 are scanned simultaneously with a fixed m/z offset,
3. scanning quadrupole 1 while setting quadrupole 3 to pass a selected m/z range, and
4. Setting both quadrupole 1 and 3 to pass different m/z values without scanning to monitor selected fragmentation events.

The embodiment of a hybrid TOF shown in FIG. 1 produce full spectrum fragment ion data at higher sensitivity and resolution for all four types of triple quadrupole operating modes listed above. First, some, segmented ion guide TOF operational sequences to achieve MS/MS data with fixed m/z range selection in the first quadrupole of a triple quadrupole and m/z scanning of quadrupole 3 will be described below. As full TOF mass spectrum acquisition is performed on the fragment ions, the same segmented ion guide TOF MS/MS operational sequence can accommodate triple quadrupole operating modes 1 and 4 above.

MS/MS analysis requires the steps of 1 mass to charge selection, 2 fragmentation of the selection m/z ion and 3 mass analysis of the first generation fragment or product ions. The mass to charge analysis step in any given MS/MS sequence will be performed with TOF mass analyzer 40. The mass to charge selection and ion fragmentation steps will be performed in segmented multipole ion guide 8 with additional ion fragmentation, when required, performed in the capillary to skimmer region. An MS/MS experimental sequence can be conducted which results in fragment ions similar to those produced in a triple quadrupole MS/MS experiment. Alternatively, using a different experimental sequence, fragment ion populations can result which are similar to those produced in an ion trap MS/MS experiment. First consider a triple quadrupole MS/MS experiment where a single parent ion species is selected using the first quadrupole, the selected m/z range ions are fragmented using CID in the triple quadrupole collision cell and the third quadrupole is scanned to detect the first generation fragment ions. Effectively replacing quadrupole three, TOF mass analyzer 40 is used with considerably higher duty cycle in the embodiment shown in FIG. 1 to simultaneously detect a full spectrum of the first generation fragment ions produced. The initial ion mass to charge selection and fragmentation steps are performed in segmented ion guide 8 using the following technique.

1. Segment 1 is operated in RF only non trapping and non mass selection mode (no resonant frequency excitation) passing a wide m/z range of ions. Segment 1 has the same RF amplitude and frequency as that applied to segment 2.
2. RF and DC voltages are applied to segment 2 which is operated close to the Mathieu stability for a selected m/z range of ions. Ions whose mass to charge values fall outside the Mathieu stability region will be rejected as they traverse the length of segment 2. The DC offset potential applied to segments 1 and 2 allow ions to pass from segment 1 into segment 2 with maximum ion transmission but no fragmentation.

3. Segments 3 and 4 of multipole ion guide 8 are operated in RF only mode with an RF frequency applied which equals that of segments 1 and 2. The RF amplitude applied to segments 3 and 4 may or may not match that of segments 1 and 2 depending on m/z range of the product ions. The DC offset potential applied between segments 2, 3 and 4 serve to accelerate ions from segment 2 through segment 3 and into segment 4 with sufficient energy to cause CID fragmentation of the ion species selected in segment 2. The background pressure in segment 3 and entrance end 62 of segment 4 (1 to 10 millitorr in this example) serves initially as the collision gas and then as the ion kinetic energy damping gas for the parent and fragment ion population traversing the length of segment 4. Potentials applied to exit lens 33 serve to trap and release ions from segment 4. Trapped ions which are released or gated from segment 4 pass into TOF pulsing region 37 where they are pulsed into TOF drift region 58 and mass to charge analyzed. Ion trapping in segment 4 causes ions to take multiple passes back and forth through ion guide segment 4 before being gated out. As trapped ions move back toward entrance end 62 of segment 4 they pass through the higher pressure background gas in the entrance end 62 where collisional damping of ion kinetic energy occurs. Even for high ion energy acceleration into segment 4 to cause CID fragmentation, the resulting fragment ion kinetic energy spread can be damped to create an a monoenergetic ion population in segment 4 with close to thermal energy spread. The mean kinetic energy of ions traversing segment 4 is determined by the DC offset potential applied to the poles of segment 4.

This sequence of mass selection, DC acceleration CID fragmentation and TOF mass analysis of the fragment ions, produces a result similar to an MS/MS experiment run on a triple quadrupole mass analyzer. The hybrid TOF embodiment shown in FIG. 1 acquires full fragment ion spectrum without scanning and is configured with a segmented multipole ion guide with no electrostatic lens elements in between segments. This embodiment results in higher sensitivity MS/MS experimental sequences with higher resolution and mass accuracy performance when compared to triple quadrupole operation. CID of parent ions is achieved in both hybrid TOF and triple quadrupoles by DC acceleration of ions into an RF only collision cell. Due to the collisional damping of ion kinetic energy in segments 1 and 2, the ion energy of the parent ion beam is determined by the DC offset potential of segment 2. The ion collisional energy is then set by the relative DC offset potentials applied to segments 2, 3 and 4. The background pressure in third vacuum stage 73 is maintained at $10^{-5}$ torr or lower so that ions exiting ion guide segment 4 at exit end 11 experience no further collisions with background gas as they move into TOF pulsing region 37. Ion molecule collisions in this region would cause scattering and defocusing of the ion beam being transferred into TOF pulsing region 37 reducing TOF performance. The poles of segment 4 extend continuously from the higher background pressure of second vacuum stage 72 into third vacuum stage 73. Stable trajectory ions traversing segment 4 are transferred from a higher to a lower background pressure and in reverse direction from lower to higher background pressure with very high efficiency. Ions with stable trajectories are transferred through the four segments of segmented ion guide 8 in the MS/MS sequence described above with little or no ion loss between segments.

Alternatively, the same MS/MS function can be achieved by mass to charge selecting with segment 1, fragmenting the selected ions by DC acceleration from segment 1 to segment 2, passing of the fragment ions into segment 4 where they are trapped and gated into TOF pulsing region 37. Segment 4 can also be operated in non trapping mode where ions traverse segment 4 with a single pass on the way to TOF pulsing region 37. A second alternative is to operate segments 1 and 2 in mass selective mode with selected m/z ions accelerated through segment 3 and into segment 4 by setting the appropriate DC offset potentials. A second technique can be employed to achieve mass to charge selection in segments 1 or 2 prior to CID fragmentation. Mass selection of one or more discrete m/z ranges can be achieved by applying a spectrum of resonant frequencies to reject unwanted ion m/z values from segment 1 and/or 2 while retaining selected m/z value ions. Combinations of RF, DC and resonant frequency ion ejection can be configured in segments 1 and 2 to achieve m/z range selection prior to CID ion fragmentation from DC acceleration of ions from one ion guide segment to another.

Segments 1 and 2 can also be operated in ion trapping mode during m/z separation. This technique will be employed in $MS/MS^n$ experimental sequences as will be described below but can also be used in an MS/MS sequence. To achieve ion trapping in segment 2, the DC offset potential applied to segment 3 is raised relative to the DC offset potential applied to segment 2. The DC offset potential of segment 3 can pulsed low to gate ions from segment 2 into segment 3. Segment 3 may be operated in non trapping or trapping mode. In trapping mode, ions can be gated into segment 4 at a rate which is independent of the rate that ions are gated into TOF pulsing region 37. The ion residence time in segment 4 can serve to damp out the pulsatile characteristics of the ion gating into segment 4. The trapping of ions in segment 2 will cause ions to traverse the length of ion guide segment 4 with more than a single pass. Ions traversing segment 2 with multiple passes experiences more RF cycles and hence higher m/z selection resolution can be achieved even in the presence of higher background pressure which may tend to delay ion ejection from segment 2. Similarly, ion trapping an m/z selection can be achieved in segment 1 by raising the DC offset potential of segment 2 above the offset potential applied to the poles of segment 1. The DC offset of segment 1 can track the DC offset potential applied to segment 2 effectively preventing ions from moving between segments 2 and 4 during ion trapping cycles.

The segmented ion guide TOF can be operation can be configured to simulate triple quadrupole MS/MS operating modes, such as in neutral loss scans, in which quadrupole 1 is scanned during data acquisition. In the segmented ion guide TOF operating sequence, full TOF spectra of fragment ions are acquired from which Reconstructed Ion Chromatographs (RIC) can be generated to match triple quadrupole like neutral loss type MS/MS data. To achieve this superset of data neutral loss data, the hybrid segmented ion guide, TOF embodiment shown in FIG. 1 can be configured to operate as follows;

1. segment 1 is operated in non trapping RF only mode with DC offset potentials applied that allow ions to pass into segment 2 at low energies with no CID fragmentation.

2. segment 2 is operated in non trapping ion m/z selection mode with the application of RF and DC potentials, resonant frequency excitation potentials or a combination of both. To simulate the scanning of the first quadrupole of a triple quadrupole mass analyzer, the m/z selection window of segment 2 is periodically stepped to a new value until the desired m/z range is covered. The m/z window stepping in segment 1 is synchronized with the TOF spectra acquisition so that the parent ion mass range of any given first generation daughter ion spectrum is known.
3. segment 3 is operated in trapping RF only mode. The DC offset potentials are applied to segments 2, 3 and 4 to accelerate ions from segment 2 into segment 4 with sufficient energy to cause the desired amount of CID ion fragmentation in segment 4. Ions gated from segment 4 into TOF pulsing region 37 are pulsed into TOF drift region 58 and mass analyzed.

Consider a neutral loss scan over the parent mass to charge range from 400 to 800. If the parent m/z window is 4 m/z wide, the m/z window selected by segment 2 would need to be covered in 100 steps to cover the m/z range from 400 to 800. If the TOF mass analyzer is pulsed at a rate of 10,000 times per second with 1,000 pulses added for each mass spectra saved to memory, then 10 mass spectra per second would be recorded. Under these TOF data acquisition conditions, a full simulated neutral loss scan would take 10 seconds to acquire. If TOF spectra were acquired at a rate of 40 spectra per second, total acquisition time for each full simulated neutral loss scan would be 2.5 seconds, approaching typical scan speeds used in triple quadrupole neutral loss scans. The TOF full spectrum data acquired in the above list operating technique data contains more analytical information than the combined information from a triple quadrupole neutral loss scan or the case where the first quadrupole is scan with the third quadrupole m/z range selection fixed. Hence either triple quadrupole experiment can be simulated with the above listed segmented ion guide TOF operating sequence. Variations in the above sequence can be used to achieve the same ends. For example, m/z range selection can be conducted in segment 1 or segment 1 and 2 in trapping or non trapping mode. Segment 4 can be operated in trapping or non trapping mode. In trapping mode, the trapping voltage applied to lens 33 can be held low when the m/z range in segments 1 or 2 is switched. Trapped ions from the previous m/z window are then allow to clear the trap. A small delay time may be added after a m/z range selection step to allow the segment 4 trap to fill prior to resuming TOF pulsing.

In the above simulated triple quadrupole neutral loss scan operating mode, DC ion acceleration is employed to achieve CID first generation ion fragmentation. Alternatively, resonant frequency excitation CID fragmentation can be employed in multipole ion guide segments 1 through 4 or combinations of DC ion acceleration and resonant frequency excitation. The preferred fragmentation technique will depend on the analytical information desired. Resonant frequency excitation can be used to fragment selected ions without adding internal energy to non selection m/z values, particularly fragment product ions. When DC ion acceleration CID is use, the internal energy of all accelerated ions is increased including that of the produced fragment ions. Resonant frequency excitation has the disadvantage that to achieve increased fragmentation energy the amplitude of the resonant frequency will be increased. To contain the ions being excited the RF amplitude must be increased proportionally which increases the low m/z cutoff. Typically, when operating ion traps in MS/MS mode, the bottom one third or more of the m/z scale may be ejected to achieve sufficient resonant frequency excitation fragmentation of the parent ion or ions of interest. Both DC ion acceleration and resonant frequency excitation can be combined simultaneously or sequentially to achieve optimal MS/MS or $MS/MS^n$ performance. Consequently, the hybrid segmented ion guide TOF embodiment diagrammed in FIG. 1 can be configured to achieve all triple quadrupole and ion trap $MS/MS^n$ functions and conduct additional experiments not possible using either a triple quadrupole or an ion trap.

$MS/MS^n$ Hybrid TOF Functions with a Continuous Primary Ion Beam

A wide range of $MS/MS^n$ functions can be achieved using the hybrid TOF embodiment shown in FIG. 1. To simplify the description of the operational sequences required to achieve specific $MS/MS^n$ functions the techniques used can be divided into two groups, those that require cutting of the continuous ion source generated primary ion beam and those that require no break in the primary ion beam during operation. First some $MS/MS^n$ techniques which accept a continuos ion beam from electrospray ion source 12 will be describe below.

Consider running an $MS/MS^2$ experiment with the embodiment shown in FIG. 1. The simplest functional sequence is an extension of the MS/MS case described above where DC accelerated ion fragmentation occurs between segments 1 and 2. Specifically segmented multipole ion guide TOF hybrid is operated in the following mode.

1. Segment 1 is operated in mass to charge selection mode. Selected mass to charge ions are accelerated into segment 2 with sufficient DC offset potential applied between segments 1 and 2 to cause CID fragmentation of the m/z selected ions.
2. Segment 2 is operated in mass to charge selection mode where one or more first generation product ions is selected. The m/z selected ions are then accelerated through segment 3 and into segment 4 by applying the appropriate relative DC offset potentials to segments 2, 3 and 4 to cause CID fragmentation of the selected first generation fragment ions.
3. Segment 4 is operated in RF only trapping mode from which ions are gated into TOF pulsing region 37. The second generation fragments ions are subsequently pulsed into TOF drift region 60 and mass to charge analyzed.

Ion mass to charge selection operation in segments 1 and 2 may employ AC and DC mass filtering, resonant frequency rejection of unwanted m/z ions or a combination of both as was described above. Ion fragmentation may be achieved using resonant frequency excitation instead of or in conjunction with DC ion acceleration fragmentation in segments 2 and 4. Resonant frequency excitation can occur simultaneously with ion m/z selection in segment 2. Segment 2 can alternatively be operated in trapping mode by applying the appropriate relative DC offset potentials to the poles of segment 2 to trap ions in segment 2 or release ions from segment 2 into segment 4. In all $MS/MS^n$ experiments, the relative capillary to skimmer potential can be raised to increase the internal energies of ions in the primary ion beam to facilitate ion fragmentation in segmented ion guide 8.

$MS/MS^2$ can alternatively be achieved by mixing DC ion acceleration and resonant frequency excitation ion fragmentation techniques by operating segmented multipole ion guide 8 in the following mode.

1. Segment 1 is operated in RF only ion pass mode. Ions are pass from segment 1 to segment 2 with low energy and causing no fragmentation.

2. Segment 2 is operated in mass to charge selection mode and ions are accelerated from segment 1 through segment 3 and into segment 4 with sufficient energy to cause CID fragmentation of the m/z selected ions.
3. Segment 4 is operated in trapping, m/z selection and resonant frequency excitation fragmentation of the selected first generation ion. Second generation fragment or product ions are gated into TOF pulsing region 37 and subsequently TOF mass analyzed.

Quasi $MS/MS^n$ experiments can be achieved with a continuos incoming ion beam using techniques described in U.S. patent application Ser. No. 08/694,542. In the techniques described, true m/z selection does not take place prior to ion fragmentation. Instead two spectra are acquired sequentially, the first with the or a combination of parent or fragment ions and the second with the next generation fragment ions. the first TOF mass spectrum acquired is subtracted from the second to give a spectrum the $MS/MS^n$ fragments. This method requires multiple component resonant frequency excitation CID ion fragmentation. Using this technique, an $MS/MS^4$ experiment could be conducted as described below. Mass spectrum 1 is acquired with the following segmented ion guide operating conditions.

1. Segment 1 is operated in mass to charge selection mode. The resulting ion population is accelerated into segment 2 with sufficient energy to cause CID fragmentation.
2. Two component resonant frequency excitation is applied to the poles of segment 2, to induce CID fragmentation of the selected second and third generation ions. The product ions are passed through segment 3 to segment 4 without further fragmentation.
3. Segment 3 is operated in trapping or nontrapping RF only mode with ions passed into TOF pulsing region 37. Ions are subsequently pulsed into drift region 58 of TOF mass analyzer 40 and mass to charge analyzed.

A second TOF mass spectrum is generated with three component resonant frequency excitation applied to segment 2 or a single resonant excitation frequency applied to the poles of segment 4 to fragment the third generation product ion having the selected resonant frequency. The first mass spectrum acquired is subtracted from the second mass spectrum resulting in a mass spectrum containing fourth generation fragment or product ions and their specific parent ion.

An alternative $MS/MS^n$ analysis technique can be used which may use either a continuos or non continuous primary ion beam depended in the specific analytical application. With this technique, ions are moved from one segment to an adjacent segment in blocks. All ions trapped in one segment are transferred to the next sequential segment before accepted a group to ions from the previous segment. Each segment can independently perform single or multiple m/z selection and/or resonant frequency excitation CID ion fragmentation or ions can fragmented using DC acceleration CID as ions are transferred between segments. The steps of an $MS/MS^3$ analysis using this technique are listed below.

1. Segment 1 is operated in RF only mode with m/z selection using multifrequency resonant frequency ejection of unwanted ions. The relative DC offset potentials applied to the poles of segments 1 and 2 are set to accelerate ions from segment 1 into segment 2 with sufficient kinetic energy to cause DC acceleration CID ion fragmentation. The primary beam remains on at all times and ions continuously enter segment 1.
2. The relative DC offset potentials applied to segments 2 and 3 are set to trap ions in segment 2 for a given time period. Segment 2 is operated in m/z selection mode and selected m/z value first generation fragment ions are trapped in segment 2 for the given time period.
3. The DC offset potentials applied to segment 3 are then switched low to pass ions from segment 1 through segment 3 and into segment 4 for a time period of a duration long enough to substantially empty segment 2 of trapped ions. Ions are accelerated from segment 2 through 3 and into 4 with sufficient kinetic energy to cause DC acceleration CID ion fragmentation. After the ion transfer period, the DC offset potential applied to the poles of segment 3 is switched high trapping ions in segment 2 and preventing trapped ions in segment 4 from re-entering segment 2 in the reverse direction.
4. Segment 4 is initially operated in m/z selection mode while ions are being transferred into segment 4 from segment 2 through segment 3. The potential applied to lens 33 is initially set to trap and hold ions in segment 4. After the DC offset potential applied to segment 3 is raised to cut off ion flow from segment 2, the potentials applied to the poles of segment 4 are switched such that segment 4 is operated in RF only mode with resonant frequency excitation CID fragmentation of the selected m/z value second generation fragment ions trapped in segment 4. If an $MS/MS^3$ experiment is desired, the resulting third generation product or fragment ions trapped in segment 4 are released, by switching the voltage applied to lens 33, in gated ion packets into TOF pulsing region 37 and subsequently TOF mass analyzed. Alternatively, additional sequential m/z selection and CID fragmentation steps can be continued with the ions trapped in segment 4, prior to releasing ions into TOF pulsing region 37, if higher order $MS/MS^n$ steps are required. TOF spectra of a portion of the products ions can be acquired at each MS/MS step or at the end of the $MS/MS^n$ sequence. While MS/MS steps are being conducted with ions trapped in segment 4, selected first generation product ions continue to accumulate in segment 2.
5. When all n generation product ions trapped in segment 4 have been gated into TOF pulsing region 37 and subsequently TOF mass analyzed, the DC offset applied to segment 3 is lowered and steps 3 and 4 above are repeated.

$MS/MS^n$ Hybrid TOF Functions with a Non-Continuous Primary Ion Beam

Several segmented ion guide TOF functional sequences are possible to achieve $MS/MS^n$ operation with a non-continuos primary ion beam. U.S. patent application Ser. No. 08/694,542 describes the configuration of multipole ion guide TOF mass analyzer where the multipole ion guide is operated in trapping mode with sequential m/z ion selection and resonant frequency excitation steps prior to TOF mass analysis. The addition of multiple segments to a multipole ion guide configured in a higher background pressure region allows variations of the single segment two dimensional trap TOF $MS/MS^n$ sequences with a non-continuous primary ion beam. Unlike three dimensional ion traps or FTMS mass analyzers, the segmented ion guide TOF hybrid configuration can achieve $MS/MS^n$ functionality with ability to conduct higher energy DC acceleration ion fragmentation at each ion m/z selection and fragmentation step. Alternatively, segmented ion guide 8 can be configured to conduct resonant frequency excitation fragmentation or combinations or both CID fragmentation techniques during an $MS/MS^n$ experiment to optimize performance for a given analysis. One example of a $MS/MS^n$ experiment conducted with ion DC acceleration ion fragmentation using the segmented ion guide TOF hybrid shown in FIG. 1 is described below.

1. Segment 1 is operated in RF only non mass selection mode with ions being passed into segment 2 with no fragmentation.
2. Segment 1 is operated in trapping or non trapping mass to charge selection mode and the resulting ion population is accelerated through segment 3 into segment 4 with sufficient kinetic energy to cause CID fragmentation.
3. Segment 3 is operated in trapping mass to charge selection mode and a selected m/z range of first generation ions is collected in multipole ion segment 4 with no ion gating into pulsing region 37. After collecting selected m/z first generation fragment ions for a specified time period or with occasional TOF monitoring of the segment 4 ion population to prevent saturation, the primary ion beam is prevented from entering segment 1 of segmented ion guide 8 by decreasing the potential on capillary exit 14 relative to the potential applied to skimmer 26. Ions exiting capillary 23 are prevented from passing through skimmer opening 27 due to the retarding electric field applied in the capillary to skimmer region.
4. Ions trapped in segment 4 are then DC accelerated in the reverse direction through segment 3 into segment 2 by applying the appropriate relative DC offset potentials to segments 2, 3 and 4 to cause CID of ions accelerated into segment 2. Ions accelerated in the reverse direction into segment 2 are prevented from entering segment 1 by increasing the relative DC bias potentials of segments 1 and 2. If a short MS/MS$^n$ analysis time is required, ions may be prevented from entering segment 1 to decrease the time required to empty segment 2 of ions at each MS/MS step. Alternatively ions may be allowed to enter segment 1 as an extension of segment 2 to increase the segment 1 volume. Ions are prevented from exiting segment 1 in the reverse direction through entrance end 9 by applying a DC retarding field between skimmer 26 and the poles of segment 1. The neutral gas molecules from the free jet expansion continuing to enter second vacuum stage 2 through skimmer aperture 27, serve to damp reverse ion axial trajectories which aids in preventing trapped ions from being lost through entrance ion guide entrance end 9. The potentials applied to segment 2 and segment 1 just prior to receiving the ion population from segment 4 are switched such that segments 1 and 2 are operated in m/z selection mode.
5. A selected m/z range of second generation fragment ions is collected in segment 2. The resulting population of second generation fragment ions is re-accelerated through segment 3 into segment 4 with sufficient kinetic energy to cause CID fragmentation of the selected second generation ion population.
6. Segment 4 is again operated in trap mode. If the experiment is to end at third generation ions, the resulting ion population in segment 3 can be TOF mass analyzed. If n generation product ions beyond MS/MS$^3$ are required, step 4 or steps 4 and 5 are repeated to produce MS/MS$^n$ generation fragment or product ions and so on. The trapped ion population can be sampled at each MS/MS step and TOF mass analyzed consuming only a small portion of the trapped ion population. TOF mass analysis is conducted after the last MS/MS$^{nth}$ step until the entire ion population is emptied from multipole ion guide 8.
7. The voltage applied to capillary exit end 14 is raised to allow ions in the primary ion beam to again pass through skimmer aperture 27 and into segmented ion guide 8 at entrance end 9.
8. Sequence 1 through 7 is repeated. Any number of MS/MS$^n$ steps can be configured in this manner with TOF mass analysis.

Another example of MS/MS$^n$ analysis utilizing a mixture of resonant frequency excitation fragmentation and DC ion acceleration CID fragmentation is described below with non-continuous primary ion beam operation.

1. Operate segment 1 in non m/z selection RF only mode to pass ions into segment 2 without CID fragmentation.
2. Segment 2 is operated in mass selection mode with trapping or non trapping, passing selected m/z ions through segment 3 and into segment 4 with no DC acceleration fragmentation.
3. Segment 3 is operated in trapping mode with resonant frequency excitation fragmentation of the m/z selected patent ions. A supplemental set of resonant frequencies is simultaneously applied to reject undesired first generation fragment ions while retaining selected m/z value ions. The internal energy of the m/z selected first generation fragment ions does increase in segment 4 during parent ion CID fragmentation. First generation m/z selected fragment ions are accumulated in segment 4 for a set time period or until a desired ion population density is reached, checked by short duration TOF ion sampling.
4. When segment four has been filled to the desired ion density level, the primary ion beam is prevented from passing through skimmer aperture 27 by lowering the potential applied to the capillary exit electrode.
5. The selected first generation fragmentation ions are accelerated in the reverse direction from segment 4 through segment 3 into segment 2 with sufficient kinetic energy to cause CID fragmentation.
6. Prior to receiving the first generation ions and second generation fragment ions, the potentials applied to the poles of segment 1 are switched to operate in mass selection mode for mass selection of second generation fragment ions.
7. If further MS/MS fragmentation is desired, steps 2 through 6 can be repeated or TOF mass analysis can be performed on the entire ion population trapped in multipole ion guide 8.
8. When TOF mass analysis is completed and multipole ion guide 8 has been emptied, the primary ion beam is again allowed to pass through skimmer aperture 27 and into segment 1 of multipole ion guide 8. Steps 1 through 7 can be repeated to continue an MS/MS$^n$ analysis.

As is described in U.S. patent application Ser. No. 08/694,542 higher energy CID fragmentation can be achieved by accelerating ions back into multipole ion guide 8 from exit end 11 in the low pressure region of third vacuum pumping stage 73. Ions gated into the gap between lenses 33 and 34 are raised in potential by rapidly increasing voltage applied to lenses 33 and 34. The potential applied to lens 33 is then decreased to accelerate ions back into multipole ion guide 8. The reverse direction DC accelerated ions impact the background gas in multipole ion guide 8 as they traverse the length of ion guide 8 or individual segments 1 through 4. In a similar manner, segment 3 or a combination segment 3 and 4 can be used to reverse accelerate ions into segment 2 in a repetitive manner to rapidly increase the internal energy of an ion population. Ion acceleration from segment 3, however, occurs in the presence of background collision gas so ion terminal velocities achievable may be lower than can those velocities attained by accelerated ions from the collision free region at ion guide exit end 11. Unlike a three dimensional or FTMS systems which can conduct $MS/MS^n$ experiments, the segmented ion guide TOF hybrid shown in FIG. 1 can deliver a broader range of collisional energies to achieve ion fragmentation. The control $MS/MS^n$ function sequences is simplified by direct computer control of DC and AC voltage switches and power supplies.

Rapid switching of DC offset potentials can be achieved by switching between two power supplies DC power supplies set at the appropriate potentials. The poles of each segment are connected to a set of AC and DC power supplies through switches. The primary RF applied to the poles of each may be connected through capacitive coupling directly from individual RF supplies. The DC voltage components are added after the RF coupling capacitor and the resonant frequency AC can be capacitively coupled into the each pole by connecting after the RF coupling capacitor. The state of each switch can be controlled through a computer program which can simultaneously change the status all switches required to achieve a change of instrument state. RF and DC power supply amplitudes and frequencies can be set through interfaces such as Digital to Analog converters using the same computer control program. With such a computer controlled system, $MS/MS^n$ experimental sequences are achieved by programming specific sets of switch, control signal and delay patterns. Control sequences can be user selected before initiating a data acquisition run and state changes can be programmed to occur during the run based on data received. Data dependent software decisions may be used for example to select the largest peak in a parent mass spectrum. The largest amplitude parent peak is then m/z selected and subsequently fragmented.

Segment 3 of multipole ion guide 8 serves to decouple segments 2 and 4 electrically and functionally. Ions can be trapped in segment 2 and released when the DC offset potentials applied to segment 3 are increased to trap ions and lowered to pass ions from segment 2 into segment 3. FIG. 2 shows an alternative embodiment of a segmented multipole ion guide TOF hybrid instrument where multipole ion guide 204 is comprised of 3 segments. Segment 3 of ion segmented ion guide 8 has been removed to simplify operational sequences and cost of electronic components. Most $MS/MS^n$ sequences described for the embodiment shown in FIG. 1 can be run with the three segment multipole ion guide embodiment shown in FIG. 2. The segmented ion guide TOF hybrid instrument shown in FIG. 2 is comprised of Electrospray ion source 212, four vacuum pumping stages 208, 209, 210 and 211, segmented ion guide 204 and TOF mass analyzer 261. In the embodiment shown, TOF mass analyzer 214 is configured with steering lens set 262 to adjust the position of ion impact on detector 212. Segmented multipole ion guide 204 is comprised of first segment 201, second segment 202 and third segment 203. The poles of segments 201 and 202 are joined but electrically insulated from each other at joint 206. Similarly, the poles of segments 202 and 203 are joined but electrically insulated from each other at joint 207. Segment 203 extends continuously from second vacuum pumping stage 209 into 210. Each multipole ion guide segment 201, 202 and 203 can be operated independently in single or multiple m/z range selection and/or resonant frequency excitation modes.

The background pressure in second stage 209 is maintained above 0.1 millitorr to allow collisional damping of stable trajectory ion energies and to enable CID fragmentation of ions in each multipole ion guide segment. The local pressure at entrance en 213 of segment 201 is be higher due to the free jet expansion and aid in increasing the ion guide capture efficiency at entrance of multipole ion guide 204. By setting the appropriate relative DC offset potentials between segments, ions can be transferred in either direction from one multipole ion guide segment to another with or without causing CID fragmentation. With the elimination of the short segment in between segments 202 and 203, segment 203 requires more closely tied operation with segment 202. For example segment 202 can not be operated in ion trap and release mode without varying the relative offset potentials between segments 202 and 203. This to some extent simplifies instrument operation and cost by reducing variables and components, the tradeoff is reduced overall system functional flexibility.

Figure 3:
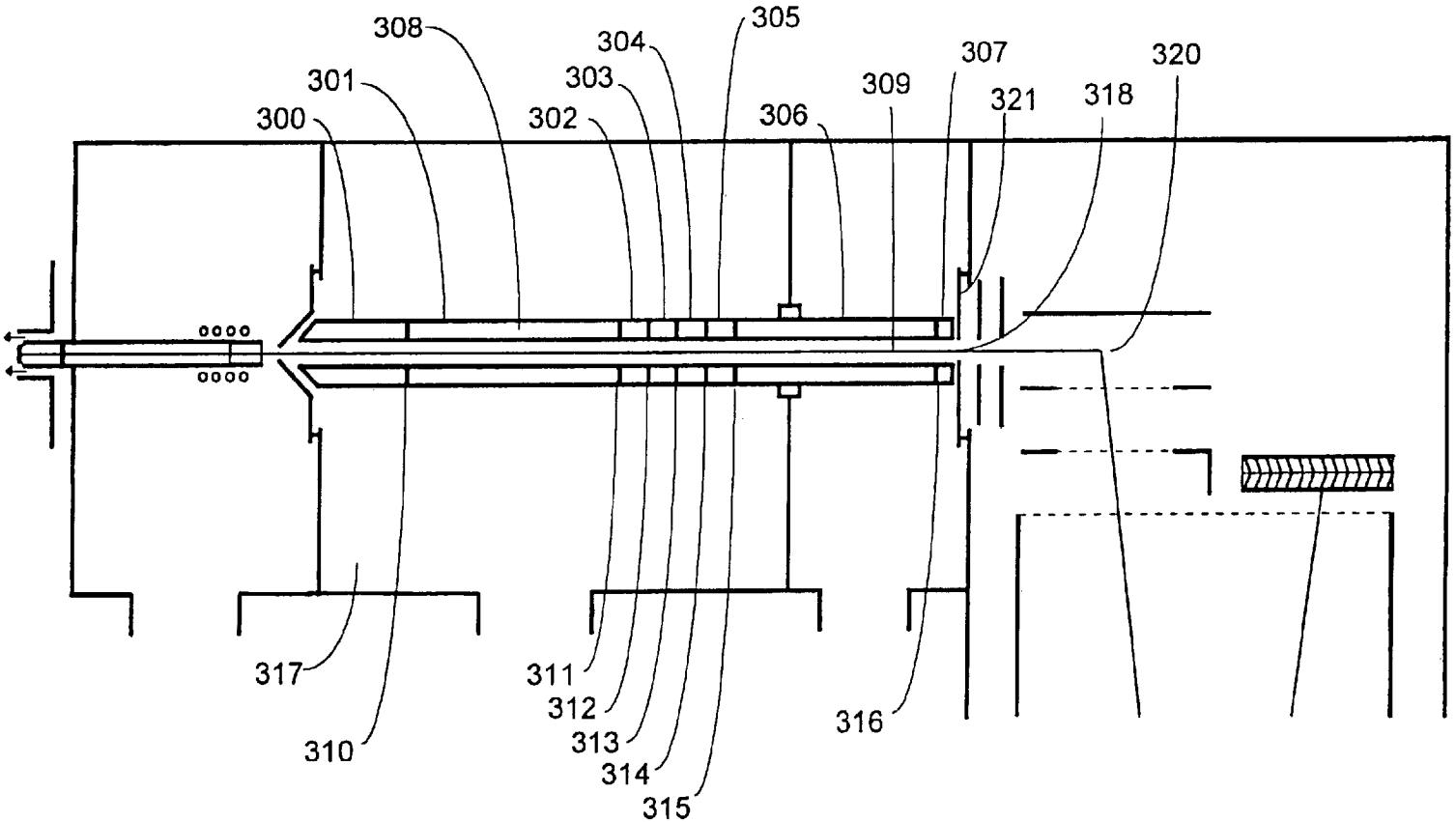
FIG. 3 is a diagram of a alternative embodiment of an Electrospray ion source TOF mass analyzer with orthogonal pulsing configured with two segmented multipole ion guides.

System flexibility and to some extent complexity can be increased to achieve additional functionality by increasing the number of segments in the segmented ion guide 308 as shown in FIG. 3. Segmented ion guide 308 is comprised of 8 segments 300 through 307 insulated from each other by electrically insulting junctions 310 through 316 respectively. First and second segments 300 and 301 can be operated using techniques described for segments 1 and 2 in FIG. 1. Segments 302, 303, 304, 305 have been configured between segments 301 and 306 and located in second vacuum stage 317. The DC offset applied segments 302 through 305 operating in RF only mode can be set to cause a more sustained and higher energy DC acceleration to achieve ion fragmentation in either direction along segmented ion guide 308. Alternatively, segments 302 through 305 can be operated as a single segment in m/z selection or resonant frequency excitation ion fragmentation mode. Combining segment 302 through 305 operation in m/z selection mode allows the conducting of $MS/MS^3$ experiments with continuos primary ion beam 209 to maximize sensitivity. Increasing the number of in multipole ion guide segments configured in vacuum stage 2 allows an increased ion transfer rate through multipole ion 308 even at higher background pressures in second vacuum stage 317. A low voltage DC offset gradient applied between segments 300 through 306 would move help to move ions in the axial direction without increasing ion internal energy through more energetic collisions with the background gas. Segment 307 has been added at exit end 318 of multipole ion guide 308 to serve as an alternative means to trap ions in segment 306 and gate ions from multipole ion guide 308 into TOF pulsing region 320. Trapping with DC offset potentials applied to the poles of segment 307 compared with using retarding potentials applied to lens 321 reduces any defocusing effects which may occur due to exit end fringing field effects. Segment 307 is operated primarily in RF only ion transfer mode which reduce or eliminate asymmetric DC fringing field effects at exit end 318 of multipole ion guide 308. Segment 306 may be operated in m/z selection mode with AC and DC applied to the poles. Segment 307 effectively decouples the fringing fields created by segment 306 from the ion focusing and acceleration region exit end 318 of multipole ion guide 308. Segment 307 allows the focusing of ions into TOF pulsing region 320 to be optimized independent of the segment 306 operating conditions. The embodiment shown in FIG. 3 offers a high degree of flexibility in conducting a of $MS/MS^n$ experiments including a range of m/z selection and ion fragmentation techniques.

Figure 4A:
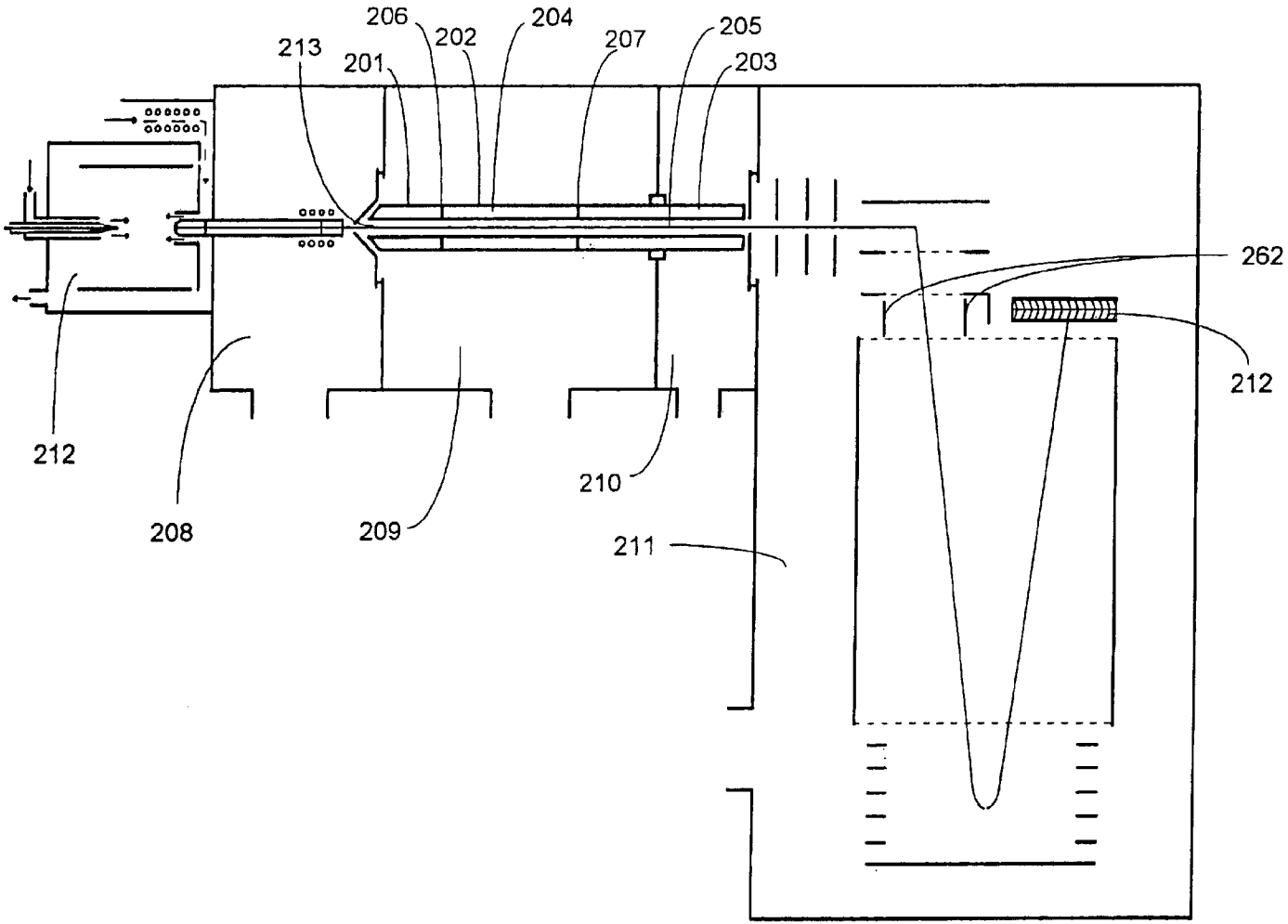
FIG. 4A is a diagram of an Electrospray ion source TOF mass analyzer with orthogonal pulsing configured with two multipole ion guides, the second of which extends continuously into two vacuum pumping stages.
Figure 4B:
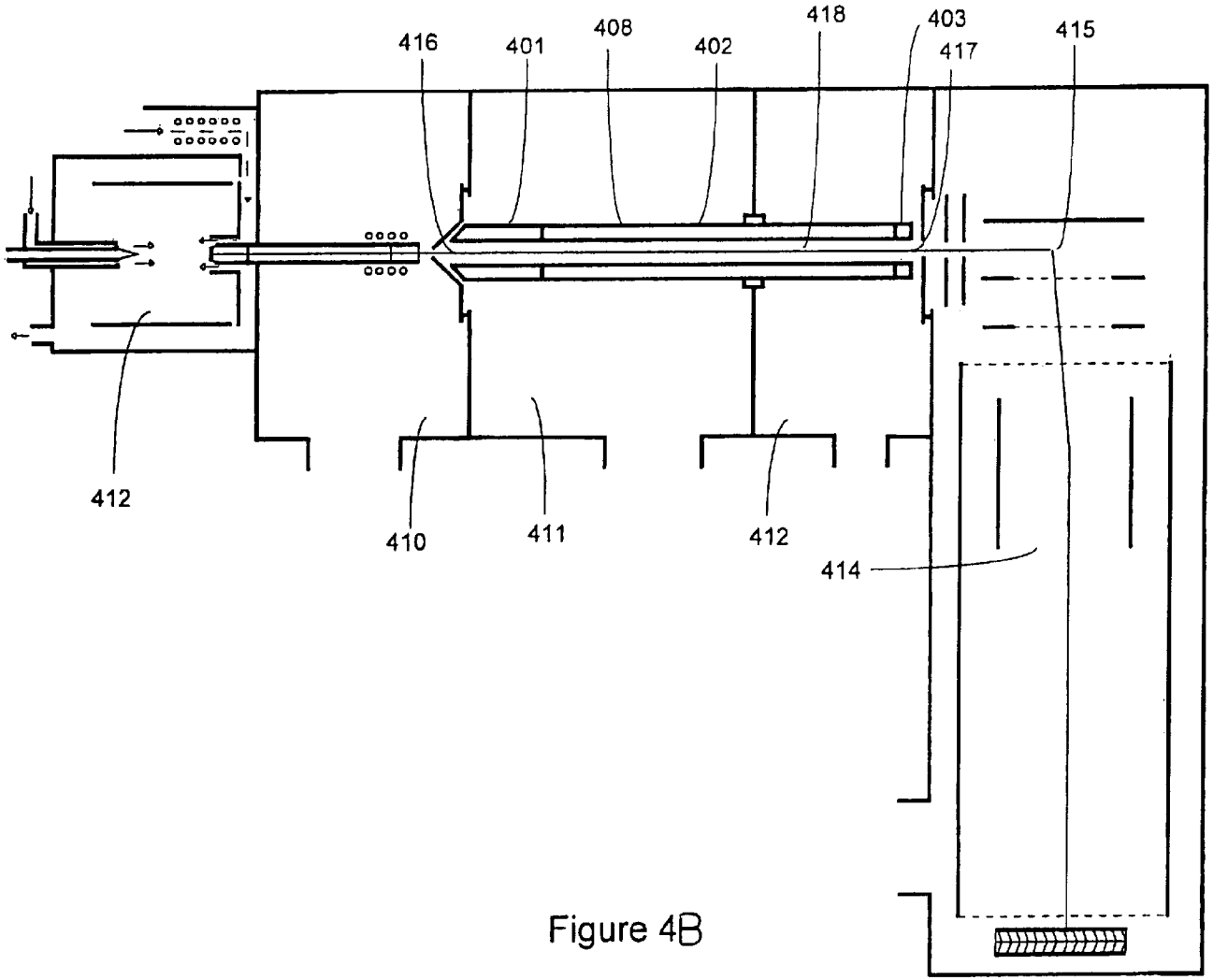
FIG. 4B is a diagram of an Electrospray ion source, orthogonal pulsing Time-Of-Flight mass analyzer with a linear flight tube geometry, configured with a three segment multipole ion guide which extends continuously into two vacuum pumping stages.
Figure 4C:
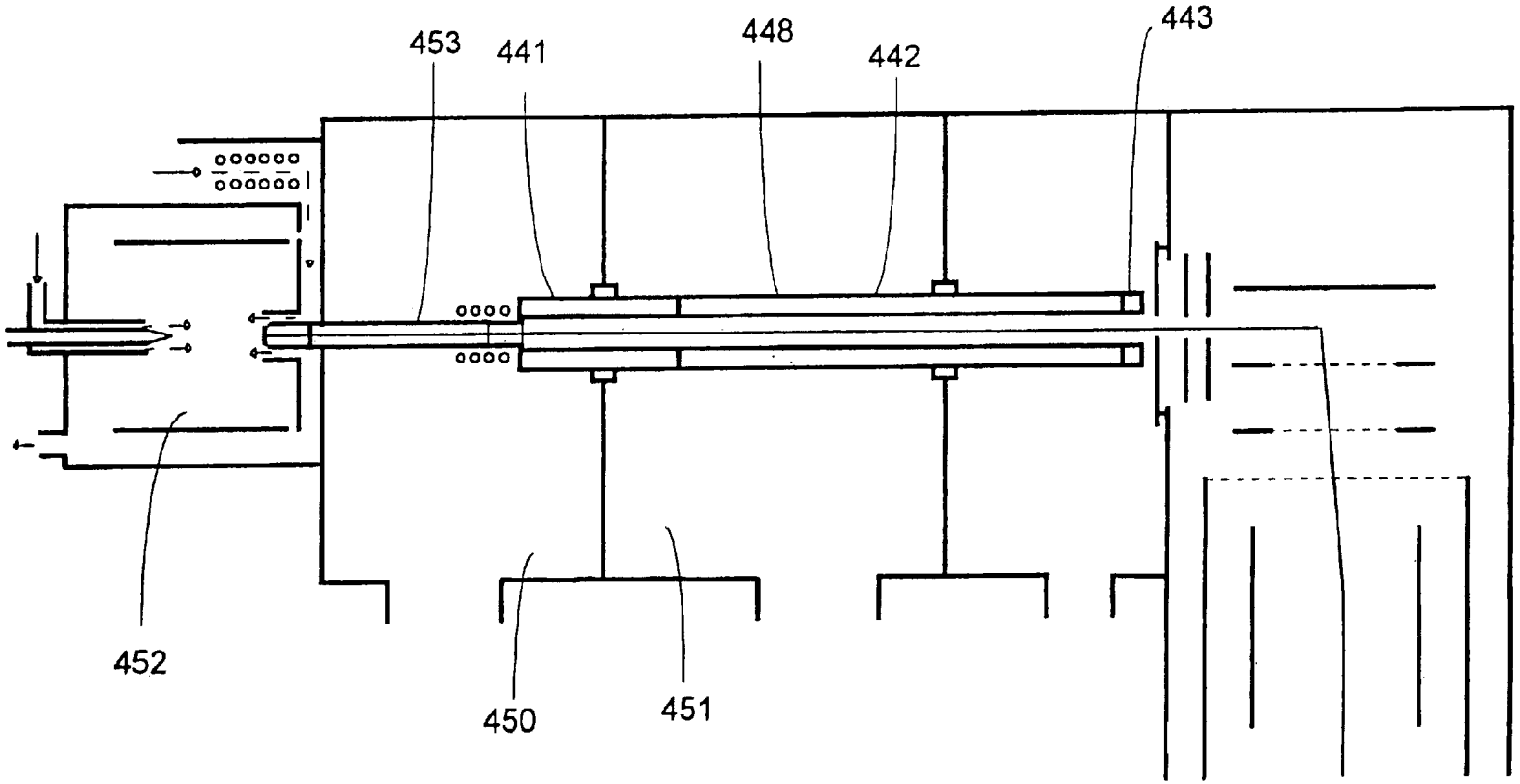
FIG. 4C is a diagram of an Electrospray ion source, orthogonal pulsing Time-Of-Flight mass analyzer configured with a three segment multipole ion guide which extends continuously into 3 vacuum pumping stages.

FIG. 4 an embodiment of the invention in which three segment multipole ion guide multipole ion guide 408 is configured in a hybrid API TOF mass analyzer. Three segment multipole ion guide 408 extends continuously from higher background pressure vacuum stage 411 into lower background pressure vacuum stage 412. Segment 402 can be operated in RF only mode to transfer ions into TOF pulsing region 415 or as a two dimensional trap configured with full $MS/MS^n$ function capability when coupled with TOF mass analysis as is described in U.S. patent application Ser. No. 08/694,542. The embodiment in FIG. 4 includes two additional segments from the embodiment described in U.S. patent application Ser. No. 08/694/542. Segments 401 and 403 can be operated in a mode which serves to decouple the effects of segment 408 operating modes from effecting the trajectories of ions entering or exiting multipole ion guide 408 at entrance and exit ends 416 and 417 respectively. For example segment 401 can be operated in R only mode to efficiently transfer ions from entrance region 416 into segment 408. The kinetic energies and trajectories of ions entering multipole ion guide 408 at entrance end 416 are damped by the collisional interaction with the background gas. Ions traversing segment 401 enter segment 408 closer to centerline 418 where the defocusing effects of DC fringing fields will have little effect on ion transmission efficiency. The DC offset potentials applied to segment 403 can be switched to trap ions in segment 402 or gate ions from segment 402 into TOF pulsing region 415. Ions traversing pulsing region 402 are pulsed into TOF drift region 414 and mass analyzed. A linear TOF flight tube geometry is shown in FIG. 4 as an alternative embodiment to flight tube geometry which includes an ion reflector geometry.

Segment 403 operating in RF only mode establishes consistent ion trajectories from multipole ion guide exit region 417 into TOF pulsing region 415 by shielding differences in fringing fields at the exit end of segment 2 which can occur during different operating modes of segment 402. Segment 401 can also be operated in m/z selection and/or fragmentation mode and parent or product ions can be transferred forward or in reverse between segments 401 and 402. Consequently, ions can be fragmented with DC ion acceleration between segments 401 and 402 complementing resonant frequency CID functions described in previous embodiments and in U.S. patent application Ser. No. 08/694, 542. Ions traversing segment 403 may be accelerating back into segment 402 to cause CID ion fragmentation in that portion of segment 402 which extends into vacuum stage 411. Pulsing ions in the reverse direction from segment 403 into 402 can be accomplished by switching the DC potentials applied to the poles of segment 403 and lens 418 in a synchronous manner to initially raise the ion energy of the ions in exit region 417 and accelerating the ions into segment 402. Some DC field penetration into segment 403 from lens 418 and the poles of segment 402 will occur with voltage differences applied between the two elements to aid accelerating the ions from segment 403 into 402. The embodiment diagrammed in FIG. 4 allows full $MS/MS^n$ functionality in a cost effective configuration with some tradeoffs in functional flexibility due to the reduced number of multipole ion guide segments.

An alternative embodiment of a three segment multipole ion guide FIG. 4*b* in which segmented multipole ion guide 448 is configured to extend into first vacuum pumping stage 450. Ions produced in Electrospray ion source 452 move into first vacuum pumping stage 450 through capillary 453. Ions exiting capillary 453 at exit end 454, enter the first multipole ion guide segment 441 where they are radially confined by the RF fields applied to the poles on segment 441. Ions with m/z values which fall within the stability window determined by the electric fields applied to the poles of segment 441 move through segment 441 and can be transferred into segment 442. $MS/MS^n$ functions with TOF mass to charge analysis can be achieved using techniques similar to those described for the three segment ion guide shown in FIG. 4. Alternatives to segmented ion guide 448 may include extending segment 442 into vacuum stage 450. Additional multipole ion guide segments can be added the that portion of multipole ion guide 448 which extends into vacuum stage 454. This configuration allows mass to charge selection and ion fragmentation functions at higher background pressures which may be preferable to lower pressure operation for analysis. Additional variations to configuration of the segmented multipole ion guide are shown in FIGS. 5 through 7.

Figure 5:
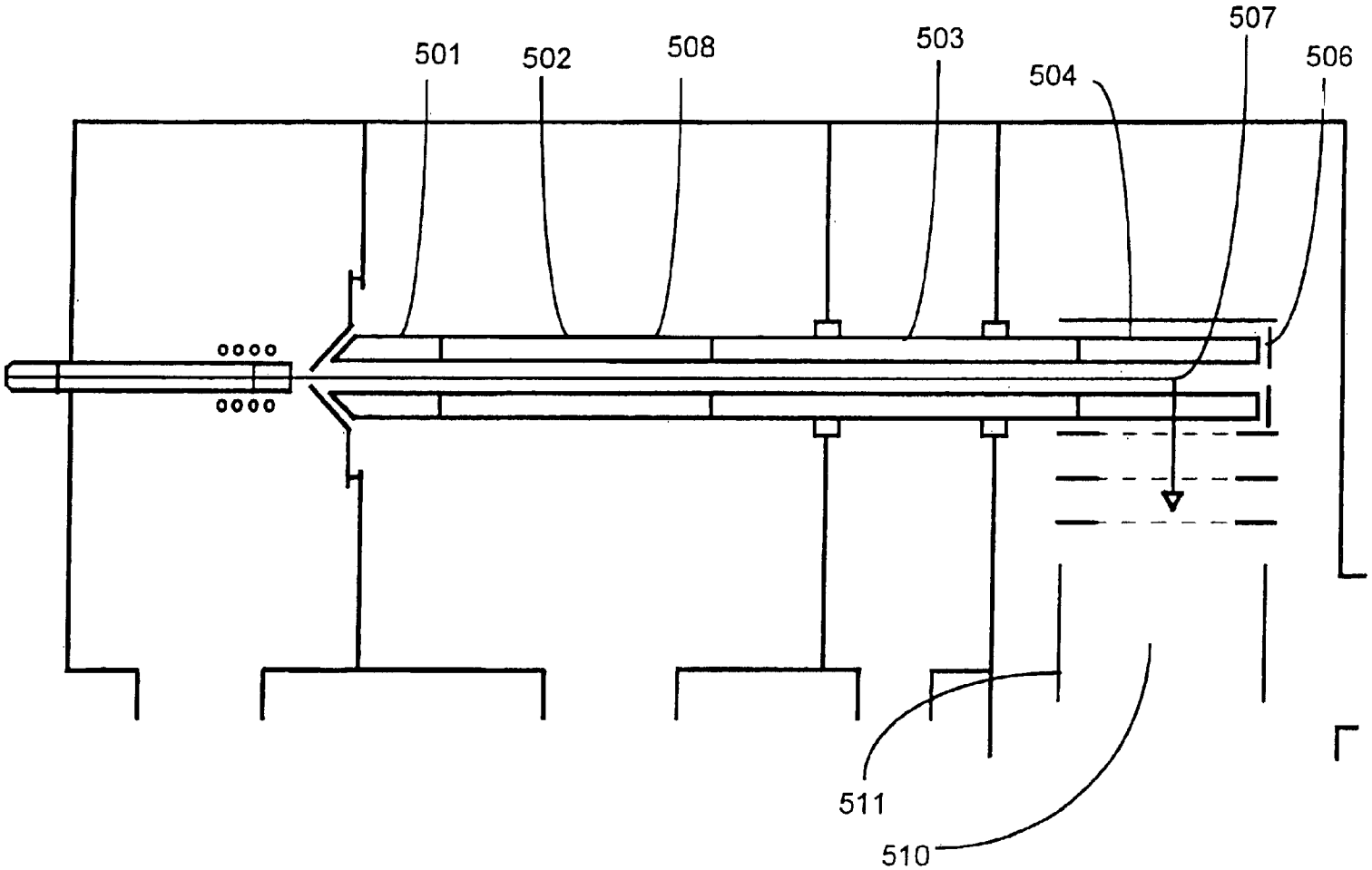
FIG. 5 is a diagram of an API TOF mass analyzer with orthogonal pulsing configured with three multipole ion guide assemblies the second of which extends from vacuum stage two into vacuum stage three the third of which is configured in the orthogonal pulsing region of the TOF mass analyzer.

The segmented multipole ion guide embodiment shown in FIG. 5 is configured to extend into TOF pulsing region 507. Ions traversing the length of multipole ion guide 508 pass through segments 501, 502 and 503 and are transferred into segment 507. The relative DC voltages applied to the poles of segments 503 and 504 and lens 507 trap ions in segment 504. Ions trapped in segment 504 are pulsed into TOF drift region 510 by cutting off the RF voltage component and applying an asymmetric DC potential to the poles of segment 504 to accelerate ions radially through the gap between two poles. Full $MS/MS^n$ functions with TOF mass to charge analysis can be achieved with the embodiment shown in FIG. 5. Segments 501, 502 and 503 can be operated individually or in complementary fashion to achieve m/z selection and/or ion CID fragmentation of ions prior to TOF mass to charge analysis. The ions trapped in segment 6 prior to pulsing may be traveling in either direction axially along the length of segment 6. As segment 6 is residing in a low pressure region, few ion collisions will occur with the background gas. Consequently, no ion axial ion velocity damping will occur in segment 6 prior to pulsing into TOF drift region 510. To increase the number of ions which have the required trajectory to impact the detector in the TOF tube, ions must be pulsed from segment 506 during the initial first pass or ions must be transferred into segment 6 with very low axial kinetic energy. The latter has the disadvantage that the pulsing region fill time might be quite long resulting in the slowing down of the TOF pulse rate. Radial ion motion in segment 6 due to the RF field prior to pulsing can contribute to spatial and energy spread of ions pulsed into TOF drift region 510. An additional constant which must be considered when operating with a two dimensional trap configured as the pulsing region is that a multichannel plate detector commonly used in TOF analyzers has a limited instantaneous charge depletion dynamic range, typically on the order of 100. If too many ions of like m/z value arrive at the detector within a 2 nanosecond time window, the detector output may reach saturation resulting in signal amplitude distortion. Reducing ion accumulation time in segment 506 prior to pulsing the trapped ions into TOF drift region 510 can help to avoid detector saturation. Configuring steering lens set 511 may help in optimizing ion pulsed ion trajectories to impact on the TOF detector.

Figure 6:
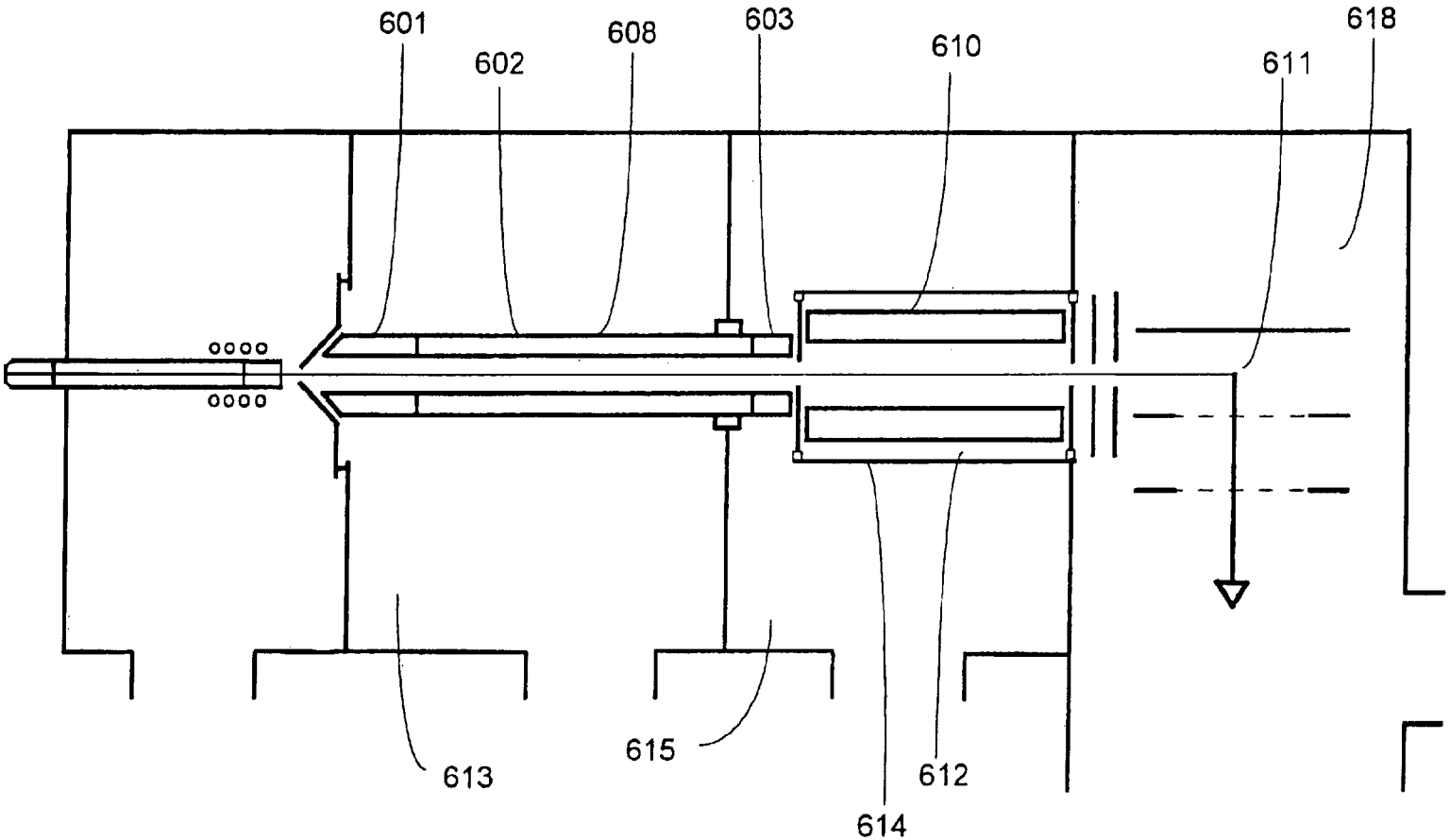
FIG. 6 is a diagram of an API source TOF mass analyzer with orthogonal pulsing configured with a two multipole ion guide assemblies the first of which is configured as a three segment ion guide that extends into the second and third vacuum pumping stages which is configured in the third vacuum stage.

An alternative embodiment of a hybrid API source multipole ion guide TOF is diagrammed in FIG. 6. Referring to FIG. 6, an additional multipole ion guide 610 has been configured between segmented multipole ion guide 608 and TOF pulsing region 611. Multipole ion guide 610 can be operated as a collision cell when gas is added to region 612 surrounded by partition 614 or in m/z selection mode. Segments 601, 602 and 603 comprising segmented ion guide 608 can be operated individually or collectively in m/z selection and/or CID ion fragmentation modes to achieve MS/MS$^n$ functions with TOF mass to charge analysis. Each segment of multipole ion guide 608 can be operated in single pass or ion trapping mode. In addition, ions can be m/z selected to fragmented with CID in ion multipole ion guide 610. Multipole ion guide 608 extends continuously into lower pressure vacuum stage 615 where ions exiting from segment 603 are not subjected to collisional scattering from background gas collisions. Ion transfer efficiency into multipole ion guide 610 is not effected by the background pressure in vacuum stage 613. The configuration of second and distinct CID ion fragmentation region 612 comprising multipole ion guide 610 allows for the introduction of a different collision or reactive background gas than is present in second vacuum stage 613. The embodiment shown in FIG. 6 allows studies of gas phase ion neutral reactions or the use of different gases for CID fragmentation of ions with full MS/MS$^n$ operating mode capability. Multipole ion guide can be operated in single pass or trap mode releasing ions continuously or by gating into TOF pulsing region 611. An additional RF multipole ion guide may be configured in vacuum stage 615 between multipole ion guide 610 and TOF pulsing region 611 to reduce the pressure between CID region 612 and fourth vacuum stage 618 which is maintained at low pressure. Multipole ion guide 608 may also be configured to extend into poles of ion guide 610 to improve ion transmission efficiency as is described in U.S. patent application Ser. No. 60/017,619. The dual multipole ion guide embodiment shown in FIG. 6 allows for some specialized operating modes but may reduce overall functional flexibility when compared with earlier embodiments described.

Figure 7:
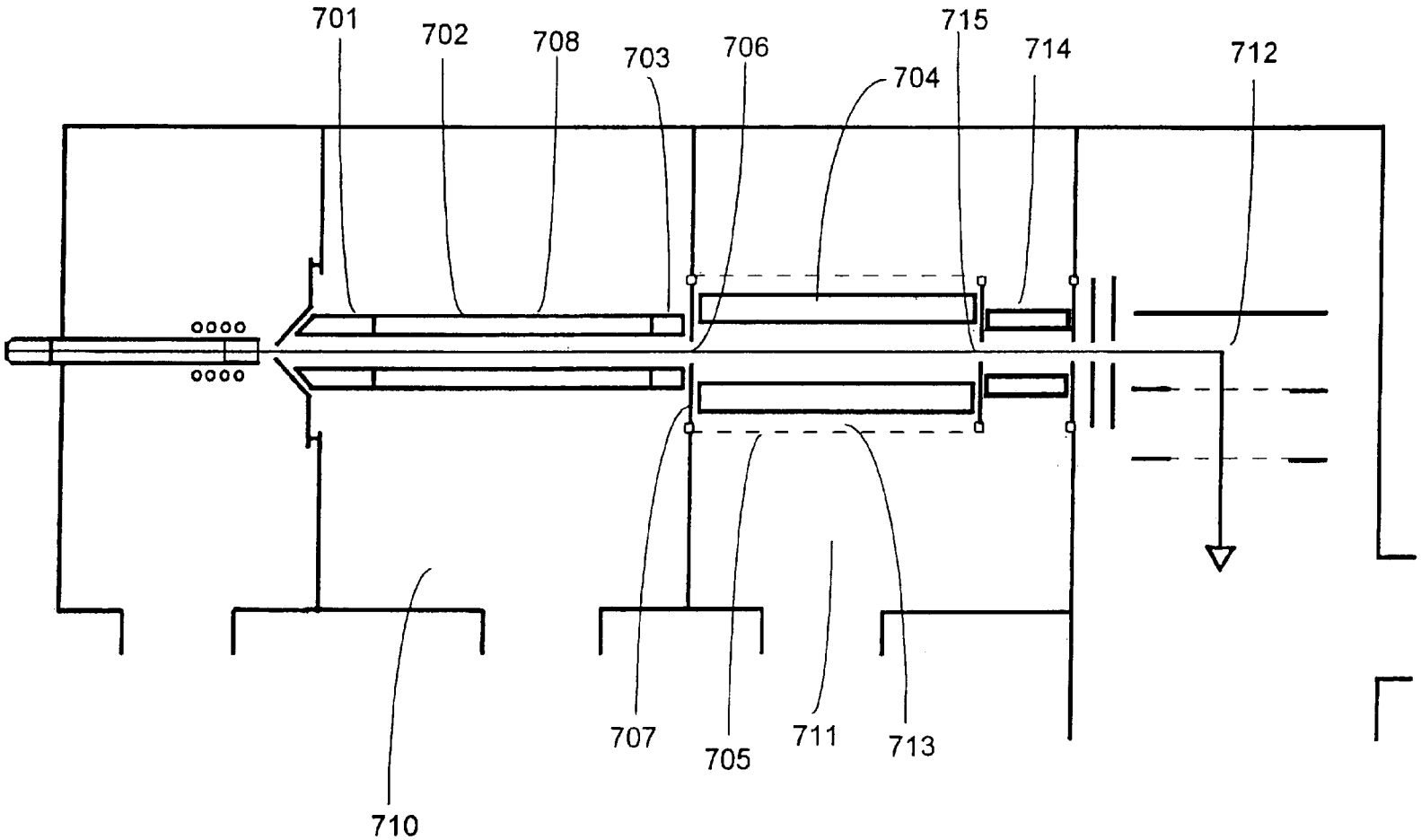
FIG. 7 is a diagram of and API TOF mass analyzer with orthogonal pulsing which includes a segmented ion guide assembly located in vacuum stage two and a second and third multipole ion guide assembly located in vacuum stage three.
Figure 8:
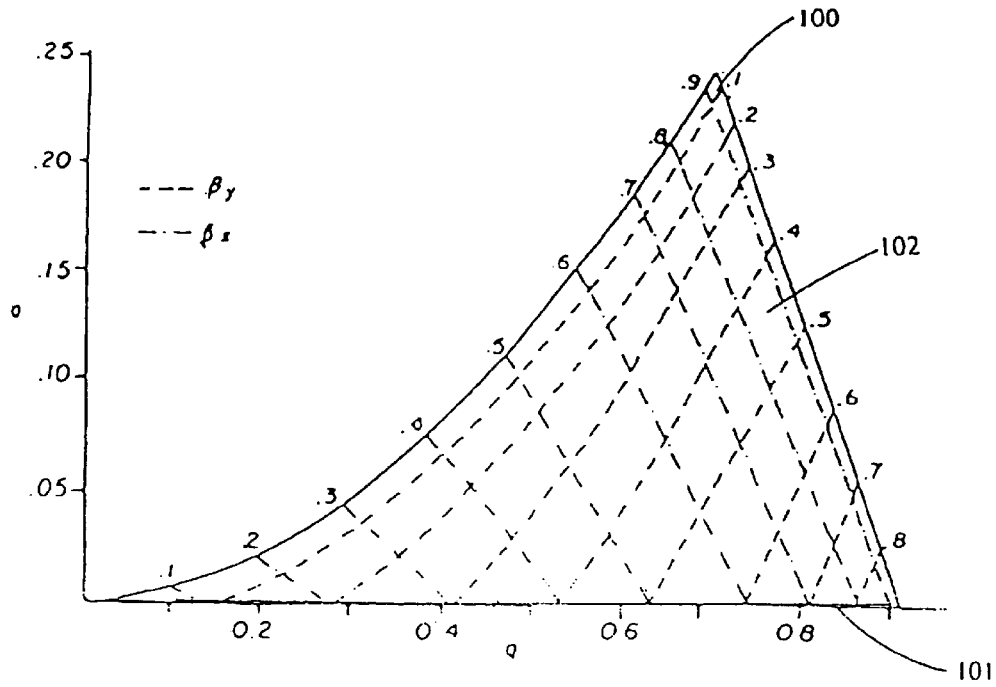
FIG. 8 is a portion of the stability diagram for a quadrupole ion guide.

FIG. 7 shows an alternative embodiment for a multipole ion guide hybrid TOF mass analyzer which can be operated in MS/MS$^n$ analysis mode. Segmented multipole ion guide 708, configured with segments 701, 702 and 703, is positioned in second vacuum stage 710. A second multipole ion guide 704 located in vacuum stage 711 is surrounded by gas partition 713. Gas partition 713 allows the addition of collision gas into region 713 to raise the pressure in region 713 when it is desirable to operate ion guide 704 as a collision cell. A third multipole ion guide 714 is positioned in vacuum stage 711 to efficiently transfer ions from multipole ion guide 704 into pulsing region 712 allowing sufficient vacuum pumping between higher pressure collision region 713 and lower pressure TOF pulsing region 712. Multipole ion guide may be operated in single pass or ion trapping mode with gating into TOF pulsing region 712. Separating multipole ion guides 703 and 704 into distinct vacuum stages allows increased flexibility in multipole ion guide geometries particularly for multipole ion guide 708.

Multipole ion guides which extend into more than one vacuum stage are configured with relatively small inner diameters (small $r_0$) to minimize the neutral gas conductance from one vacuum stage to the next. Minimizing gas conductance reduces vacuum pumping costs for a given background pressure target. The poles of multipole ion guides 708, 704 and 714 begin and end vacuum stages 710 and 711 respectively so there are no vacuum pumping constraints imposed on either multipole ion guide geometry. The inner radius ($r_0$) of ion guide 708, 704 or 714 are not constrained due to vacuum pumping requirements in the embodiment shown in FIG. 7.

Analogous to previously described embodiments, the background pressure in vacuum stage 7 is maintained sufficiently high to insure that collisions between background gas and ions occur as ions traverse the length of multipole ion guide 708. The background pressure in vacuum stage 710 allows CID ion fragmentation of ions traversing multipole ion guide 708 using resonant frequency excitation or intersegment DC ion acceleration techniques. Each segment in multipole ion guide 708 can be operated independently or in conjunction with other segments in m/z selection or CID ion fragmentation operating modes. Voltages applied to vacuum partition and electrostatic lens 707 can be set to pass ions from segment 703 into multipole ion guide 704 or can be set to trap ions in multipole ion guide segment 703. Each segment in multipole ion guide 708 can be operated in trapping or nontrapping mode by setting the appropriate relative DC offset potentials to the poles of adjacent segments. Similarly multipole ion guide 704 can be operated in m/z selection or resonant frequency excitation CID ion fragmentation mode when collision gas is present in region 713. Ions can also be DC accelerated into multipole ion guide 704 with sufficient kinetic energy to cause CID fragmentation. Combinations m/z selection and CID ion fragmentation steps conducted with multipole ion guides 708 and 704 can be configured to achieve a variety of MS/MS$^n$ analytical functions with TOF mass analysis. As with the embodiment shown in FIG. 6, collision gas or reactant gas can be introduce into region 713 which is different than the background gas in vacuum stage 710. Selected ion-molecule reactions can be studied by added the appropriate reactant gas into region 713 with multipole ion guide 708 delivering m/z selected and/or fragmented product ions into multipole ion guide 704. The resulting ion population flowing through or trapped in multipole ion guide 704 is subsequently TOF mass analyzed.

The embodiments shown in FIGS. 1 through 7 are some examples of configurations of multipole ion guide TOF hybrid mass analyzers where mass to charge selection and selection and ion fragmentation occurs in a higher pressure region. The invention is not limited to the specific embodiments shown and techniques described. For example, instead of a segmented ion guide, individual ion guides may be positioned in the higher background pressure region and used to conduct m/z and ion fragmentation steps in an MS/MS$^n$ analysis. This arrangement would allow different RF frequencies to be applied to each separate multipole ion guide potentially increasing flexibility, however, system cost and complexity would increase proportionally as well. The four vacuum pumping stage embodiment shown can be re-configured as a two, three or five stage vacuum system with m/z selection and/or CID fragmentation conducted with multipole ion guides in a higher background pressure vacuum region. Different ion sources can be configured with the multipole ion guide TOF hybrid instrument. Even ion sources which operate in vacuum can be configured with multipole ion guides operating at higher background vacuum pressures. With ion sources that operate in vacuum, gas may be added to the vacuum region containing the multipole ion guide to operate in higher pressure m/z selection and ion fragmentation modes. The invention can be applied to variations of TOF mass analyzer geometries. For example, the TOF mass analyzer may be configured with an in line pulsing region, a curved field ion reflector or a discrete dynode multiplier. In alternative embodiments, the portions of a segmented multipole ion guides or individual multipole ion guides located in a higher pressure regions can also be configured to operate in ion transfer, ion trapping, and any of the fragmentation modes already discussed as well as m/z analysis or m/z selection mode or combinations of these individual operating modes. To one skilled in the art, all the fragmentation, CID, mass selection, and MS/MS methods discussed in the embodiments described in FIGS. 1 through 7 can be implemented in alternative embodiments of the invention.

Ion Guide Higher Pressure MS/MS$^n$ Quadrupole

As has already been stated with API source and a Time-Of-flight mass analyzer an important feature of multipole ion guides is that ions can be released from one end of an ion guide or segment simultaneously while ions are entering the opposite end of the ion guide or individual segment. Due to this feature, a segmented ion guide receiving a continuous ion beam can be selectively release only a portion of the ions located in the ion guide into a mass analyzer which performs mass analysis on the released ions. In this manner ions are not lost in between mass analysis steps. Another specific embodiment of this aspect of the invention is the configuration of an API source with segmented multipole ion guide where the multipole ion guide which may or may not be combined with additional quadrupole mass analyzers or multipole ion guide collision cells. In this embodiment of the invention, a quadrupole segmented ion guide is itself configured as an MS or MS/MS$^n$ mass analyzer with a portion of the segmented ion guide length operated in pressures above $10^{-4}$ torr. If required, the electron multiplier detector may be configured and operated lower background pressure region in the embodiments shown. Segmented multipole ion guides configured as mass analyzers or as a portion of a mass analyzer can achieve an increased performance and analytical capability for a lower cost and complexity than separate multipole ion guides configured in series.

Figure 10:
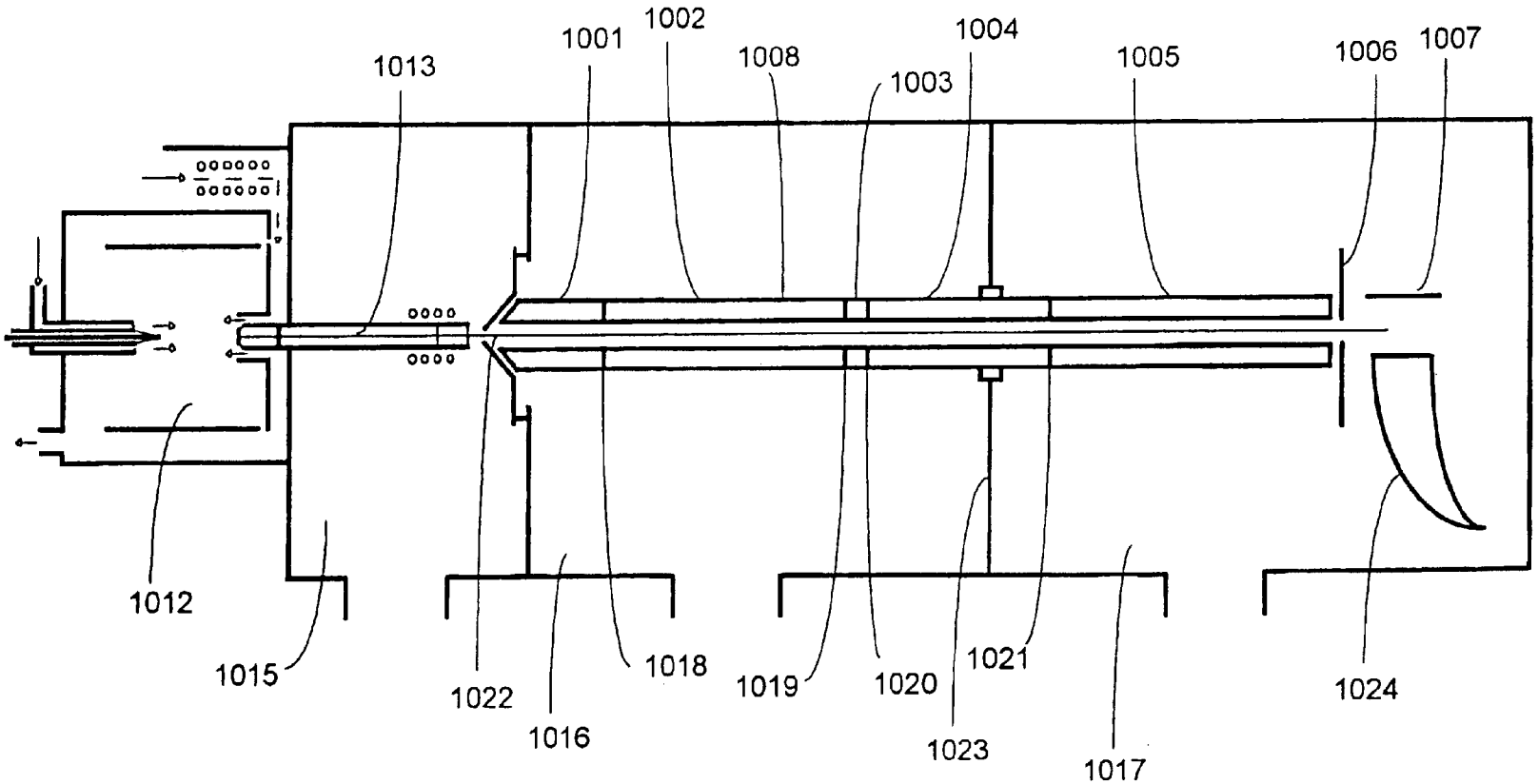
FIG. 10 is a diagram of an Electrospray ion source quadrupole mass analyzer configured with three quadrupole ion guides with the second quadrupole ion guide extending continuously from the second into the third vacuum pumping stage.

FIG. 10 shows an embodiment of the invention where a five segment quadrupole segmented ion guide is configured as a mass analyzer in an API MS instrument. Multipole ion guide 1008 is configured with segments 1001, 1002, 1003, 1004 and 1005 with electrically insulated junctions 1018, 1019, 1020 and 1017 separating each segment respectively. Through to vacuum partition 1023 in second vacuum stage 1016, Electrospray source 1012 and segmented multipole ion guide 1008 configuration is similar to the embodiment described in FIG. 1. Second vacuum stage 1016 is operated with a background maintained above of $10^{-4}$ torr. A common RF frequency with, in some cases, different RF amplitudes can be applied to all segments in multipole ion guide 1008 to maximize intersegment ion transfer efficiency. In the embodiment diagrammed in FIG. 10, the TOF mass analyzer has been replaced by additional multipole ion guide segment 1005. Multipole ion guide segment 1005 is located in third vacuum stage 1017 which is maintained at a background pressure below $10^{-4}$ torr. As segment 1005 is a quadrupole mass analyzer and may be operated in scanning or selected ion monitoring mode. The embodiment shown in FIG. 10 can perform all analytical functions performed by traditional triple quadrupole configurations as well as additional MS/MS analytical functions. The four basic MS/MS mode traditional triple quadrupole analytical functions as listed in a previous section are repeated below for convenience. Triple quadrupoles can operated with the following techniques;

1. transmitting a selected m/z range in quadrupole 1, fragmented the selection ions in the RF only collision cell while scanning quadrupole 3,
2. neutral loss scan, where quadrupole 1 and 3 are scanned simultaneously with a fixed m/z offset,
3. scanning quadrupole 1 while setting quadrupole 3 to pass a selected m/z range, and
4. Setting both quadrupole 1 and 3 to pass different m/z values without scanning to monitor selected fragmentation events.

All the above analytical techniques can be achieved with the embodiment shown in FIG. 10 by using the following configuration.

1. Operate segment 1001 in single pass (non trapping) RF only mode with the applied RF amplitude set to pass the desired range of m/z values.
2. Operate segment 1002 in single pass (non trapping) m/z selection mode. For functions 2 and 3 above segment 2 will be scanned repetitively in m/z selection mode at the desired scan speed and over the desired range of ion m/z values. The relative DC offset potentials applied to segments 1002, 1003, 1004 1005 are set to accelerate mass to charge selected ions through segments 1003 and 1004 and into segment 1005 with sufficient energy to cause CID fragmentation of accelerated ions in segments 1003 and 1004. The background pressure in the entrance end of segment 1004 can be maintained sufficiently high to damp axial ion trajectories after fragmentation to achieve an ion beam with low energy spread. In this manner, the ion energy of ions entering segment 1005 is determined by the relative DC offset potentials of applied to segments 1004 and 1005.
3. Segment 1005 is operated in mass to charge selection mode. The ion mass to charge value selection range may be fixed as in triple quadrupole MS/MS techniques 3 and 4 listed above or scanned as is required in techniques 1 and 2 above. The m/z selection scanning ramps of segments 1002 and 1005 can be synchronized to achieve neutral loss scans, technique 2 above, or monitoring of selected fragmentation events, technique 4 above.
4. Detecting ions passing from segment 1005 through lens 1006 by accelerating the ions into conversion dynode 1007 and detecting the resulting products with electron multiplier 1024.

The embodiment shown in FIG. 10 is capable of conducting additional analytical functions not possible with traditional triple quadrupole geometries where both analytical quadrupoles 1 and 3 are operated in a low vacuum region to minimize ion collisions with the background gas. For example non-trapping continuous ion beam MS/MS$^2$ analysis can be achieved by operating segment 1001 in mass to charge selection mode and accelerating the selected ions into segment 1002 with sufficient energy to cause CID fragmentation in segment 2. Segment 1001 can be operated in static or scanning m/z selective mode. Alternatively, MS/MS$^2$ analysis can be conducted with resonant frequency excitation CID ion fragmentation if it is desirable to not increase the internal energy of product ions. This can be achieved in scanning or non scanning modes as follows;

1. Operate segment 1001 in single pass (non trapping) RF only mode with the applied RF amplitude set to pass the desired range of m/z values.
2. Operate segment 1002 in single pass (non trapping) m/z selection mode. For functions 2 and 3 above segment 2 will be scanned repetitively in m/z selection mode at the desired scan speed and over the desired range of ion m/z values.
3. The relative DC offset potentials applied to segments 1002, 1003 and 1004 are set to accelerate mass to charge selected ions through segment 1003 and into segment 1004 without causing DC acceleration CID fragmentation. Segment 1004 is operated in resonant frequency excitation fragmentation mode to fragment the m/z value ions selected by segment 1002. The first generation fragment ions produced in segment 1004 pass into segment 1005 with the appropriate relative DC offset potentials set to optimally pass ions through maximum m/z selection resolution. The background pressure in the entrance end of segment 1004 can be maintained sufficiently high to damp axial ion trajectories after fragmentation to achieve an ion beam with low energy spread. In this manner, the ion energy of ions entering segment 1005 is determined by the relative DC offset potentials of applied to segments 1004 and 1005.

3. Segment 1005 is operated in mass to charge selection mode. The ion mass to charge value selection range may be fixed as in triple quadrupole MS/MS techniques 3 and 4 listed above or scanned as is required in techniques 1 and 2 above. The m/z selection scanning ramps of segments 1002 and 1005 can be synchronized to achieve neutral loss scans, technique 2 above, or monitoring of selected fragmentation events, technique 4 above.
4. Detecting ions passing from segment 1005 through lens 1006 by accelerating the ions into conversion dynode 1007 and detecting the resulting products with electron multiplier 1024.

Due to the common RF frequency, ions can be transferred efficiently from segment 1004 to 1005 with low energy to achieve higher resolution mass to charge selection. Ions can be temporarily trapped in any segment of multipole ion guide 1008 to increase the ion resident time to achieve higher resolution m/z selection or resonant frequency excitation CID fragmentation. The scan speeds can be matched to the ion trap and release rates, for example with discrete m/z value scan steps to improve $MS/MS^n$ performance. If a higher pressure detector is used, the entire segmented multipole ion guide 1008 can be configured in one higher background pressure vacuum stage. Elimination of a vacuum pumping stage will reduce instrument cost, size and complexity while imposing little or no reduction in system flexibility or performance. Configuring segmented multipole ion guide 1008 in a single vacuum pumping stage eliminates any size constraint on the internal diameter to minimize neutral gas conductance between multiple vacuum pumping stages. Alternatively, multipole ion guide 1008 can also be configured to extend into first vacuum stage 1025 in a two or three vacuum stage system. Additional alternative embodiments for triple quadrupole like mass analyzers configured with a multipole ion guide operated in mass to charge selection mode in a higher pressure vacuum region are shown in FIGS. 11 through 13.

Figure 11:
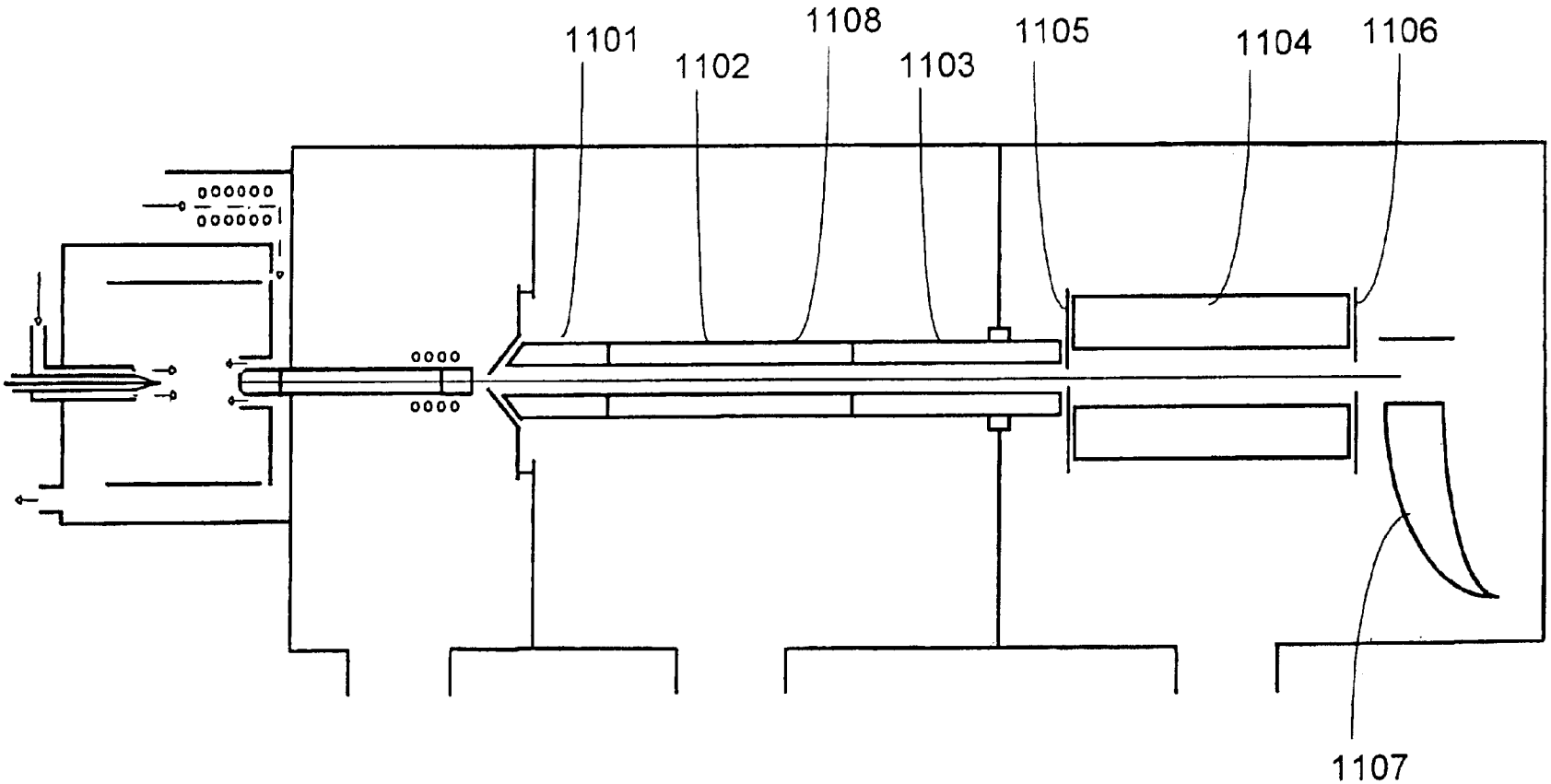
FIG. 11 is a diagram of an API source quadrupole mass analyzer configured with three quadrupole ion guides. The third quadrupole ion guide is positioned in low vacuum pressure vacuum stage three operated with a different RF amplitude and phase compared with the RF applied to quadrupoles one and two.

FIG. 11 is a diagram of an alternative embodiment of the invention in which three segment multipole ion guide 1108 is configured with a separate multipole ion guide 1104. The embodiment shown in FIG. 11 is a variation of the embodiment shown in FIG. 10 where quadrupole 1104 can be configured with poles of a different geometry than those of segmented multipole ion guide 1108 comprised of segments 1101, 1102 and 1103. Multipole ion guide 1004 can be operated with a different RF frequency than that applied to multipole ion guide 1108. Full triple quadrupole MS and MS/MS function analysis can be achieved with the embodiment of the invention diagrammed in FIG. 11 using the techniques described in the above sections.

Figure 12:
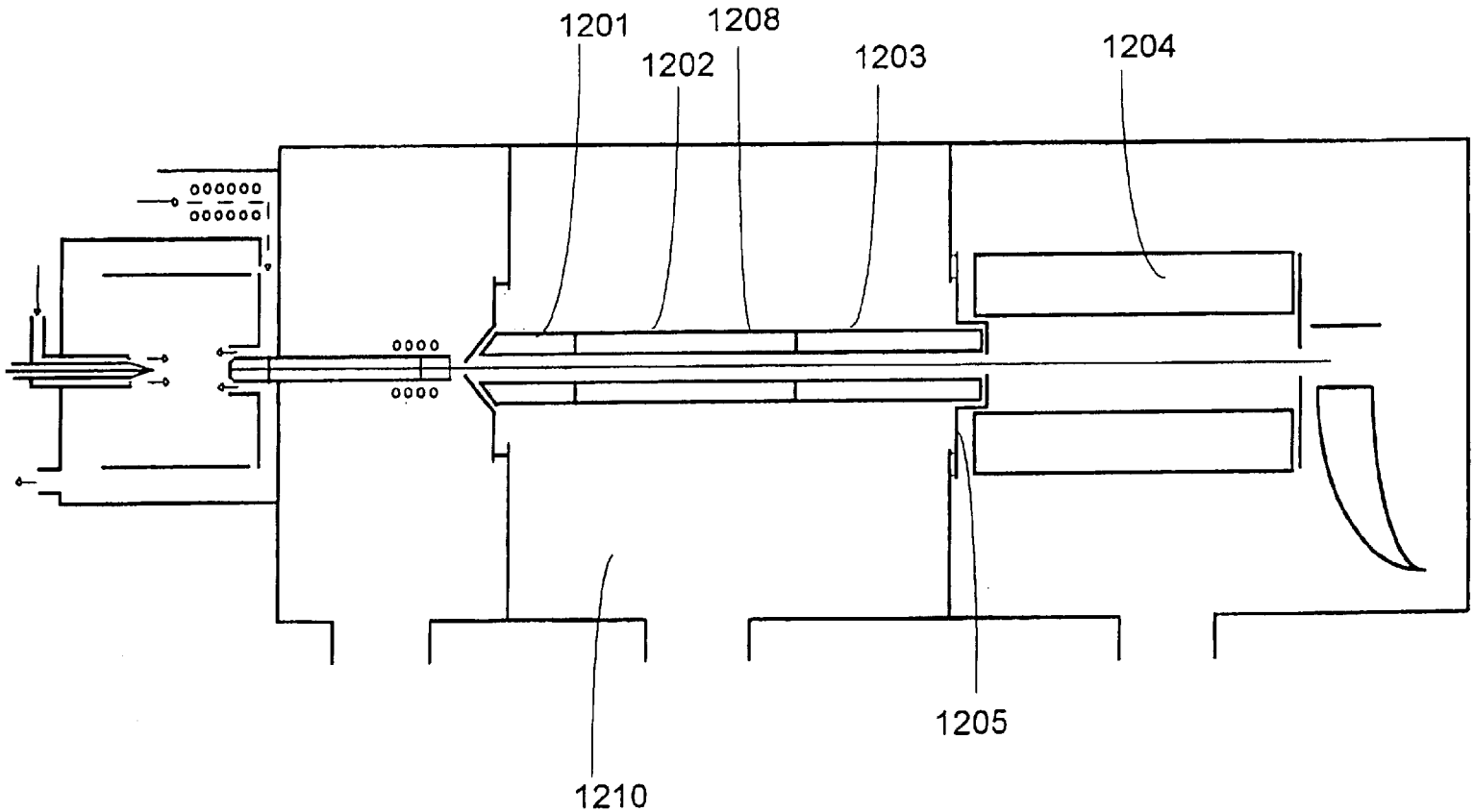
FIG. 12 is a diagram of an API source quadrupole mass analyzer configured with a three segment multipole ion guide assembly located in the higher pressure second vacuum pumping stage with its exit end extending into a second ion guide positioned in low pressure vacuum stage three.

An alternative embodiment is shown in FIG. 12 in which segmented multipole ion guide 1208 is configured in higher vacuum pressure stage 1210 and extends into the rod volume described by separate multipole ion guide 1204. Multipole ion guide segment 1203 extends into exit lens 1205 through which ions can be efficiently transferred, even at low energies, into multipole ion guide 1204. Full tripled quadrupole MS and MS/MS functions can be achieved by operating segments 1201, 1202, 1203 and quadrupole 1204 in scanning and static m/z selection and CID fragmentation modes as described in the above sections.

Figure 13:
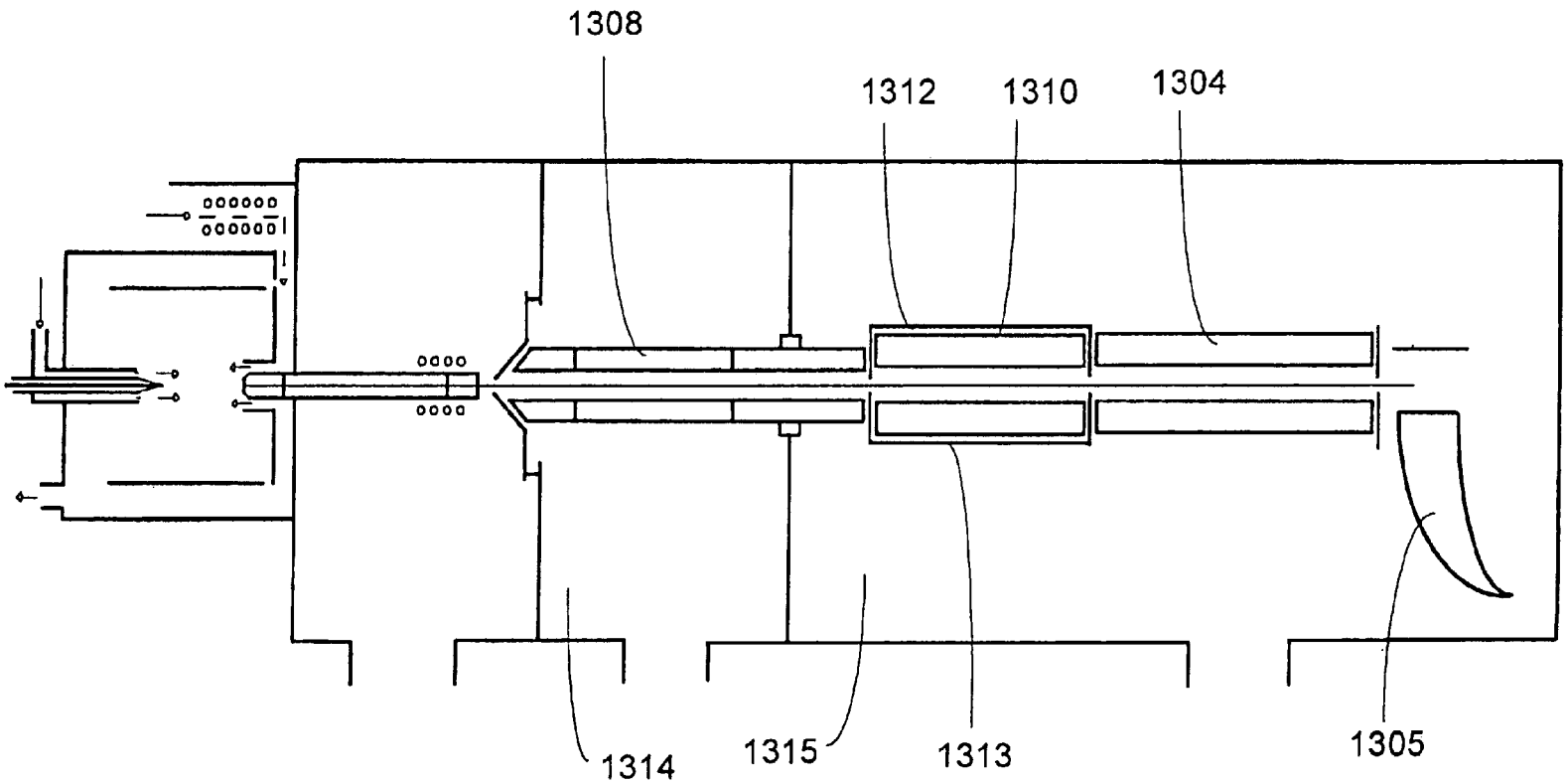
FIG. 13 is a diagram of an API source quadrupole mass analyzer configured with a three segment segmented multipole ion guide assembly with the third segment extending continuously from the second into the third vacuum pumping stage and a second and third ion guide and detector located in vacuum stage three.

An alternative embodiment of the invention is shown in FIG. 13 in which an additional multipole in guide collision cell 1312 has been added to a three vacuum pumping stage multipole ion guide mass analyzer. Three segment multipole ion guide 1308 is configured in higher vacuum pressure vacuum stage extending into lower pressure vacuum stage 1315. Mass to charge selected an/or fragment ions are transferred from multipole ion guide 1308 into multipole ion guide 1310 which in configured in collision region 1312 surrounded by gas partition 1313. Multipole ion guide 1304 serves as the final quadrupole mass analyzer before ions are detected with detector 1305. Analogous to the added multipole ion guide in the API TOF hybrid embodiment shown in FIG. 6, collision or reactive gas can be introduced into region 1312 which is different than the background gas in vacuum stage 1314. Added multipole ion guide 1310 positioned in independent collision region 1312 allows increased experimental flexibility in $MS/MS^n$ analysis. Continuous beam $MS/MS^3$ experiments can be achieved with the embodiment shown in FIG. 13 operating with DC acceleration or resonant frequency excitation CID ion fragmentation techniques.

Ion Guide Higher Pressure Quadrupole

One aspect of the present invention incorporates a non-segmented or segmented ion guide into a high pressure mass analyzer. Segmented multipole ion guides configured as mass analyzers or as a portion of a mass analyzer can achieve an increase performance and analytical capability.

Figure 14:
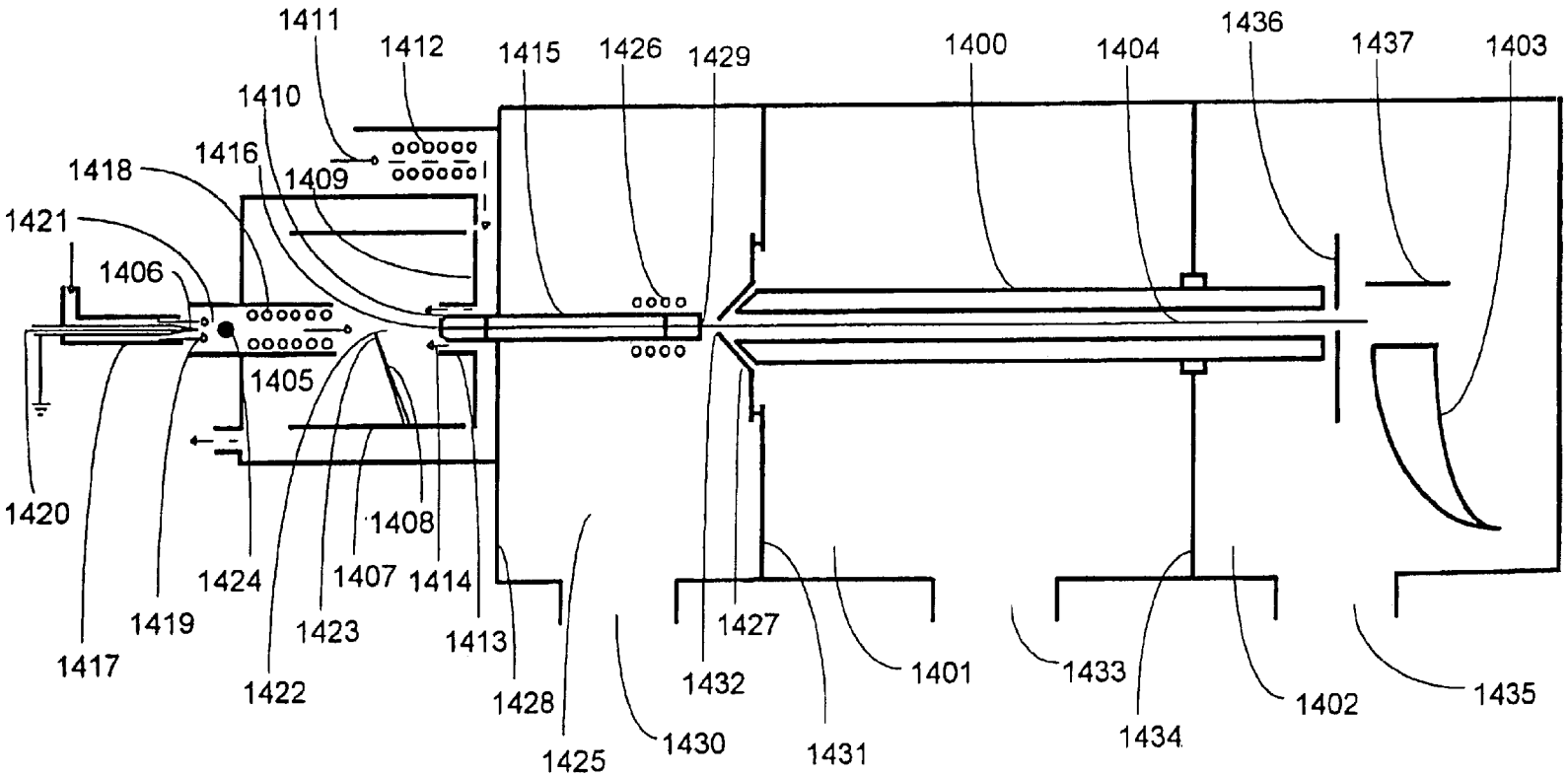
FIG. 14 is a diagram of an Atmospheric Pressure Chemical Ionization Source quadrupole mass analyzer configured with a single segment multipole ion guide that extends continuously from the second into the third vacuum pumping stage.

FIG. 14 shows a high pressure operation non-segmented multipole ion guide or mass analyzer 1400 which extends continuously from pumping stage two 1401 where the pressure is greater than $1\times10^{-4}$ torr, substantially at a pressure where ions traversing the multipole ion guide length will encounter collisions with the neutral background gas, into pumping stage three 1402 where the detector 1403 is located. The mass analyzer can be configured with four, six, eight or more rods or poles, however, the m/z selection resolving power which can be achieved using multipole ion guides decreases as the number of poles increases, consequently, quadrupoles have been commonly used as mass analyzers. Thus, for the mass analyzer diagrammed in this embodiment a quadrupoles will be the configuration presented. The quadrupole multipole ion guide assembly 1400 diagrammed in FIG. 14 is composed of four parallel poles or rods equally spaced around a common centerline 1404. In an ideal quadrupole mass analyzer the pole shapes would be hyperbolic but commonly, for ease of manufacture, round rods are used. A cross section of a quadrupole with round rods 104, 105, 106, and 107 is diagrammed in FIG. 9. The same AC and DC potentials are applied to opposite rods sets (104, 106 and 105, 107) for most quadrupole operating modes. Adjacent rods have the same AC and DC amplitude but opposite polarity. In addition, a common DC offset can be applied to all rods 104, 105, 106, and 107.

In this embodiment of the invention the non-segmented quadrupole mass analyzer begins in pumping stage two 1401 where the pressure greater than $1\times10^{-4}$ torr, substantially at a pressure where ions traversing the multipole ion guide length will encounter collisions with the neutral background gas. The multipole ion guide mass to charge analysis or selection operation can be achieved by applying a combination of RF and DC potentials, select resonant frequency to reject unwanted ion m/z values, scanning the RF frequency or amplitude values or combinations of these methods. In m/z analysis or m/z selection operating mode ion collisions with the background gas slows down the selected ion m/z trajectories in the radial and axial directions as the ions traverse the multipole ion guide length in single pass. Ions spending increased time in the multipole ion guide are exposed to an increased number of RF cycles. In this manner higher m/z selection resolution can be achieved for shorter multipole ion guide lengths than can be attained using a quadrupole mass analyzer with the more conventional method of operating in low background pressure. Operating multipole ion guides in analytical mode with higher pressure background gas in an API MS system allows the configuration of smaller more compact systems with reduced vacuum pumping speed requirements. A smaller multipole ion guide configuration reduces the cost of driver electronics and the higher pressure operation reduces the vacuum system costs. Such a system can achieve improvement in the API MS system performance when compared to an instrument which includes a quadrupole mass analyzer operated at background pressure maintained low enough to avoid or minimize ion collisions with neutral background gas.

Atmospheric Pressure Chemical Ionization (APCI) source 1405 can be configured where solvent is delivered to the APCI nebulizer 1417 tip 1406 at flow rates below 500 nl/min to above 2 ml/min. This embodiment could be reconfigured with any of the following alternative sources but is not limited to Electrospray (ES), Inductively Coupled Plasma (ICP), Glow Discharge (GD) source, multiple similar probes in one source, or combinations of different probes in one source. Sample bearing solution can be introduced into the APCI source 1405 with liquid delivery systems. Liquid delivery systems may include but are not limited to, liquid pumps with or without auto injectors, separation systems such as liquid chromatography or capillary electrophoresis, syringe pumps, pressure vessels, gravity feed vessels or solution reservoirs. APCI source 1405 is operated by applying potentials to cylindrical electrode 1407 and corona needle 1408, endplate electrode 1409 and capillary entrance electrode 1410. Counter current drying gas 1411 is directed to flow through heater 1412 and into APCI source chamber 1405 through endplate nosepiece 1413 opening 1414.

The orifice into vacuum as shown in FIG. 14 is a dielectric capillary tube 1415 with entrance orifice 1416. The potential of an ion being swept through dielectric capillary tube 1415 into vacuum is described in U.S. Pat. No. 4,542,293. To produce positive ions, negative kilovolt potentials are applied to endplate electrode 1409 with attached electrode nosepiece 1413 and capillary entrance electrode 1410 and positive kilovolt potentials are applied to cylindrical electrode 1407 and corona needle 1408. APCI nebulizer 1417 and APCI heater 1418 remains at ground potential during operation. To produce negative ions, the polarity of the just mentioned electrodes are reversed. Alternatively, if a nozzle or conductive (metal) capillaries are used as orifices into vacuum, kilovolt potentials can be applied to APCI corona needle 1408 and cylindrical electrode 1407 during operation. Heated capillaries can be configured as the orifice into vacuum used with or without counter current drying gas.

Unlike an ES source, an APCI source creates sample and solvent molecule vapor prior to ionization. The APCI ionization process, unlike Electrospray, requires gas phase molecule ion charge exchange reactions. Sample solution is introduced through connecting tube 1420 into APCI probe 1417 and is sprayed with pneumatic nebulization from APCI inlet probe tip 1406. The sprayed liquid droplets traverse cavity 1421 and flow into APCI vaporizer 1418. In the embodiment shown, cavity 1421 is configured with a droplet separator ball. Separator ball 1424 removes larger droplets from the sprays produced by the nebulizer inlet probes to prevent them from entering vaporizer 1418. Separator ball 1424 can be removed when lower solution flow rates are introduced to improve sensitivity. The liquid droplets are evaporated in vaporizer 1418 forming a vapor prior to entering the corona discharge region 1422 around and/or downstream of corona discharge needle tip 1423. Additional makeup gas flow may be added independently or through APCI inlet probe assembly to aid in transporting the droplets and resulting vapor through the APCI source assembly. An electric field is formed in APCI source 1405 by applying electrical potentials to cylindrical lens 1407, corona discharge needle 1408, endplate 1409 with nosepiece 1413 and capillary entrance electrode 1410. The applied electrical potentials, counter current gas flow 1411, and the total gas flow through vaporizer 1418 are set to establish a stable corona discharge in region 1422 around and/or downstream of corona needle tip 1423. The ions produced in corona discharge region 1422 by atmospheric pressure chemical ionization are driven by the electric field against counter current bath gas 1411 towards capillary orifice 1416. Ions are swept into vacuum through capillary orifice 1416 and pass through capillary 1415 and into the first vacuum stage 1425. If a capillary is configured with a heater 1426 as an orifice into vacuum with or without counter current drying gas, additional energy can be transferred to the gas and ions in the capillary. This additional energy is some time useful for additional drying or additional energy for fragmentation. A portion of the ions entering the first stage vacuum 1425 are directed through the skimmer 1427 and into the second vacuum stage 1401.

Ions are produced at or near atmospheric pressure from sample bearing liquid in atmospheric pressure ion source 1405. The ions are delivered into vacuum through dielectric capillary tube 1415 carried along by the neutral background gas, which pass through vacuum partition 1428. The neutral background gas forms supersonic jet as it expands into vacuum from an exit orifice 1429 and accelerates the entrained ions through multiple collisions during the expansion. Vacuum systems incorporating one or more vacuum pumping stages have been configured to remove background neutral gas as the ions of interest traverse from the API source orifice to the mass analyzer entrance. The cost and size of an API/MS instrument can be reduced if multiple vacuum pumping stages are configured and the pumping speed required for each stage is minimized. Typically, three to four vacuum pumping stages are employed in the lower cost or benchtop API/MS instruments. With the development of multiple vacuum stage turbomolecular vacuum pumps, three and even four stage vacuum systems require only one rotary and one turbomolecular pump to achieve satisfactory background pressures in each stage. Multipole ion guides operated in the AC or RF only mode have been used extensively in API/MS instruments to transport ions efficiently through the second 1401 and/or third 1402 vacuum pumping stages. In this embodiment, a rotary vacuum pump is used to evacuate the first vacuum stage 1425 through pump port 1430 the background pressure is maintained between 0.2 and 2 torr. A portion of the free jet expansion passes through a skimmer 1427 which is part of the vacuum partition 1431 and into second vacuum stage 1401 where background pressures can range from $10^{-4}$ to $10^{-1}$ torr depending on the skimmer orifice 1432 size and the pumping speed employed in vacuum stage two 1401 through pump port 1433. Ions are deliverer to pumping stage three 1402 through the mass analyzer ion guide which pass through vacuum partition 1434 and this stage is evacuated through pump port 1435. Ion then exit the mass analyzer and pass through a exit lens 1436 which focus the ions into the detector 1403. Repeller plate 1437 also act to focus ions into the detector. This high pressure quadrupole system has three pumping stages. The mass to charge analysis or selection operation can be achieved by applying a combination of RF and DC potentials, select resonant frequency to reject unwanted ion m/z values, scanning the RF frequency or amplitude values or combinations of these methods. In addition, only the traditional CID process can be performed. This CID process fragment all ions that come through the capillary however due to different bond strengths of different molecules different amounts of fragmentation can occur.

Figure 15:
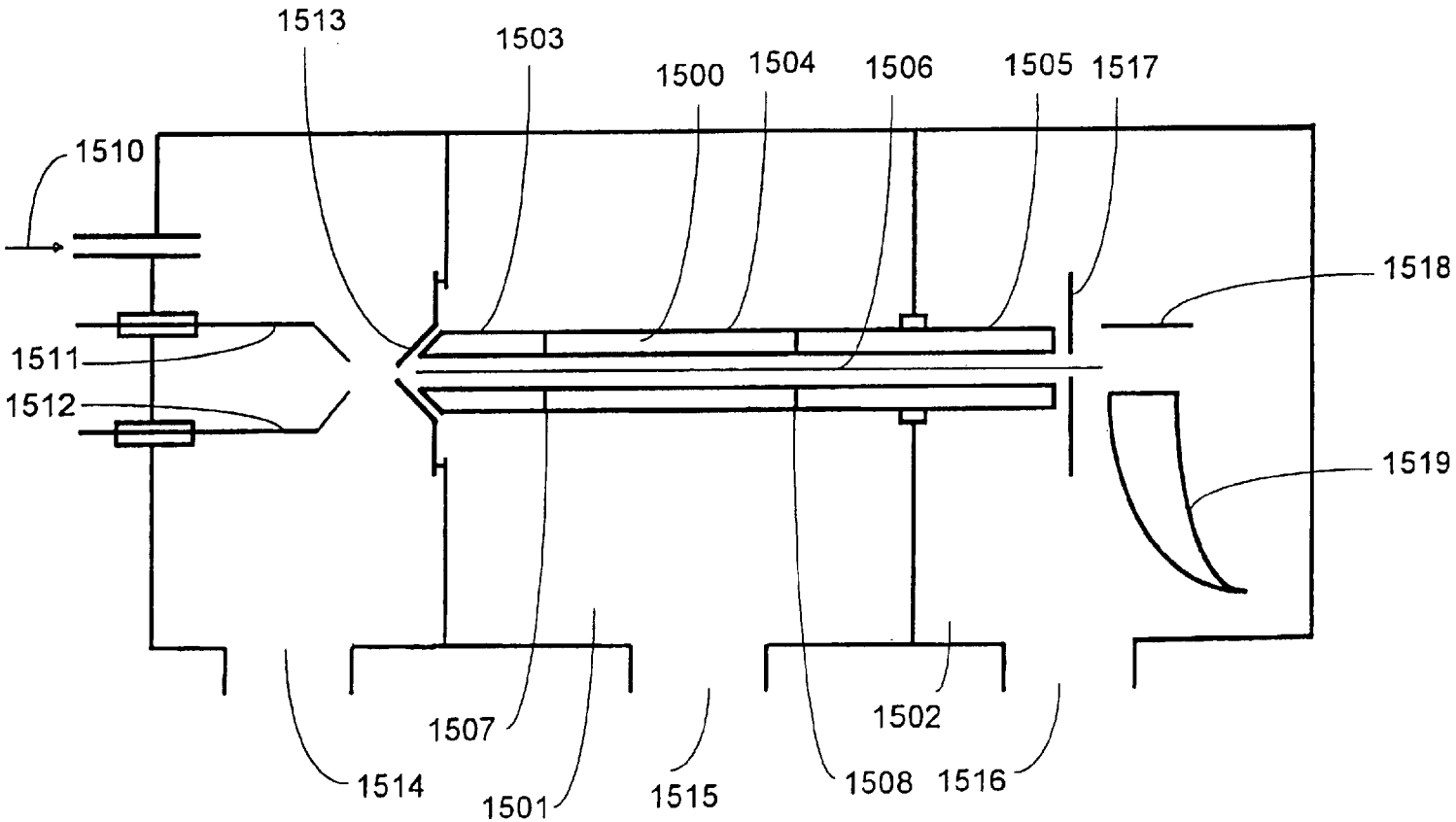
FIG. 15 is a diagram of an Glow Discharge Ionization Source quadrupole mass analyzer configured with a three segment multipole ion guide where the third segment extends continuously from the second into the third vacuum pumping stag.

A farther extension of the embodiment shown in FIG. 14 is shown in FIG. 15, demonstrating a segment mass analyzer ion guide 1500 which extends continuously from pumping stage two where the pressure is greater than $1\times10^{-4}$ torr, substantially at a pressure where ions traversing the multipole ion guide length will encounter collisions with the neutral background gas, into pumping stage three where the detector is located. Only the additional embodiment will be outlined here however all that has been explained for FIG. 14 is directly transferable to FIG. 15. The mass analyzer assembly 1500 which extends continuously from the second vacuum stage 1501 into the third vacuum stage 1502. Again a quadrupole is used as the mass analyzer as has been discussed previously and the four parallel poles or rods are equally spaced around a common centerline 1506. When an ion guide is segmented into sections each rod is broken up into sections which when assembled align as a single continuous rod. Each segment within a rod assembly is electrically insulated from its adjacent segments. The insulation is configured with the rod sections to minimize space charge effects which could distort the electric fields within the region bounded by the rods. As shown in FIG. 15 the four continuous rods are broken in to segments 1503, 1504, and 1505 and are electrically insulated from adjacent segments at insulating junction 1507 and 1508.

This embodiment is shown with a Glow Discharge (GD) source 1409. This embodiment could be reconfigured with any of the following alternative sources but is not limited to Electrospray (ES), Inductively Coupled Plasma (ICP), Atmospheric Pressure Chemical Ionization (APCI) source, multiple similar probes in one source, or combinations of different probes in one source. Gases sample can be introduced through port 1510 substantially at or below atmospheric pressure. GD source chamber is maintained at this pressure by a pump attached to pump port 1514. GD source 1509 is operated by applying potentials to discharge needles 1511 and 1512. The orifice into vacuum as shown in FIG. 15 is a nozzle or skimmer 1513. Ions are formed in the GD source 1509 and pass through skimmer 1513 and into the mass analyzer.

Mass selection can be performed, for example, segment 1503 and 1505 can be a RF only segment for ion transport, and segment 1504 is configured to operate in mass selective mode. The multipole ion guide mass to charge analysis or selection operation can be achieved by applying a combination of RF and DC potentials, select resonant frequency to reject unwanted ion m/z values, scanning the RF frequency or amplitude values or combinations of these methods.

Figure 16:
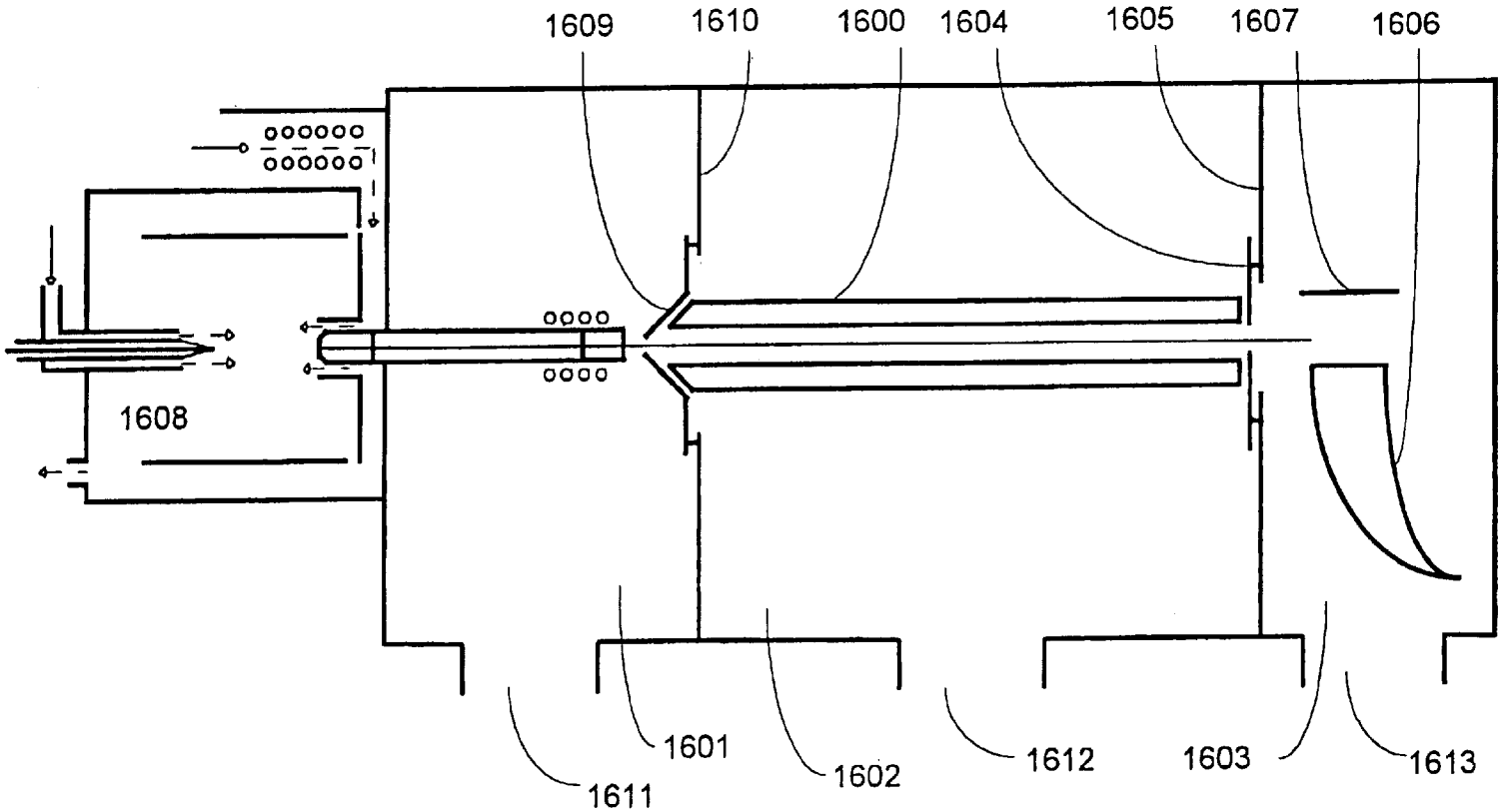
FIG. 16 is a diagram of an API source quadrupole mass analyzer configured with a quadrupole located in the higher pressure region of the second vacuum pumping stage and a detector located in lower pressure vacuum pumping stage 3.

FIG. 16 demonstrates a non-segmented mass analyzer ion guide 1600 exclusively housed in pumping stage two 1602 where the pressure is greater than $1\times10^{-4}$ torr, substantially at a pressure where ions traversing the multipole ion guide length will encounter collisions with the neutral background gas. To one skilled in the art one can see that this embodiment can claim all that was claimed with the embodiment attached to FIG. 14 with the additions that the mass analyzer 1600 exclusively housed in pumping stage two 1602. An Electrospray source 1608 is configured on this system however the system could be reconfigured with any of the following alternative sources but is not limited to Atmospheric Pressure Chemical Ionization (APCI), Inductively Coupled Plasma (ICP), Glow Discharge (GD) source, multiple similar probes in one source, or combinations of different probes in one source. Details of the Electrospray source 1608 have already been discussed along with ion formation and transportation from the Electrospray source 1608 to the entrance of the skimmer 1609, along with other variations on this hardware and thus, will not be repeated. A portion of the free jet expansion passes through a skimmer 1609 which is part of the vacuum partition 1610 and into second vacuum stage 1602 where background pressures can range from $10^{-4}$ to $10^{-1}$ torr depending on the skimmer orifice size and the pumping speed employed in vacuum stage two 1602 through pump port 1612. Ions travel through the mass analyzer 1600 and exit the mass analyzer in stage two. Ion that exit the mass analyzer are focused through a lens 1604 which is part of the vacuum partition 1605. Ions are deliverer to pumping stage three 1603 through this lens 1604 and are focused into the detector 1606 by repeller plate 1607 and this stage is evacuated through pump port 1613. This high pressure quadrupole system has three pumping stages. The mass to charge analysis or mass selection operation can be achieved by applying a combination of RF and DC potentials, scanning the RF frequency or amplitude values or combinations of these methods.

Figure 17:
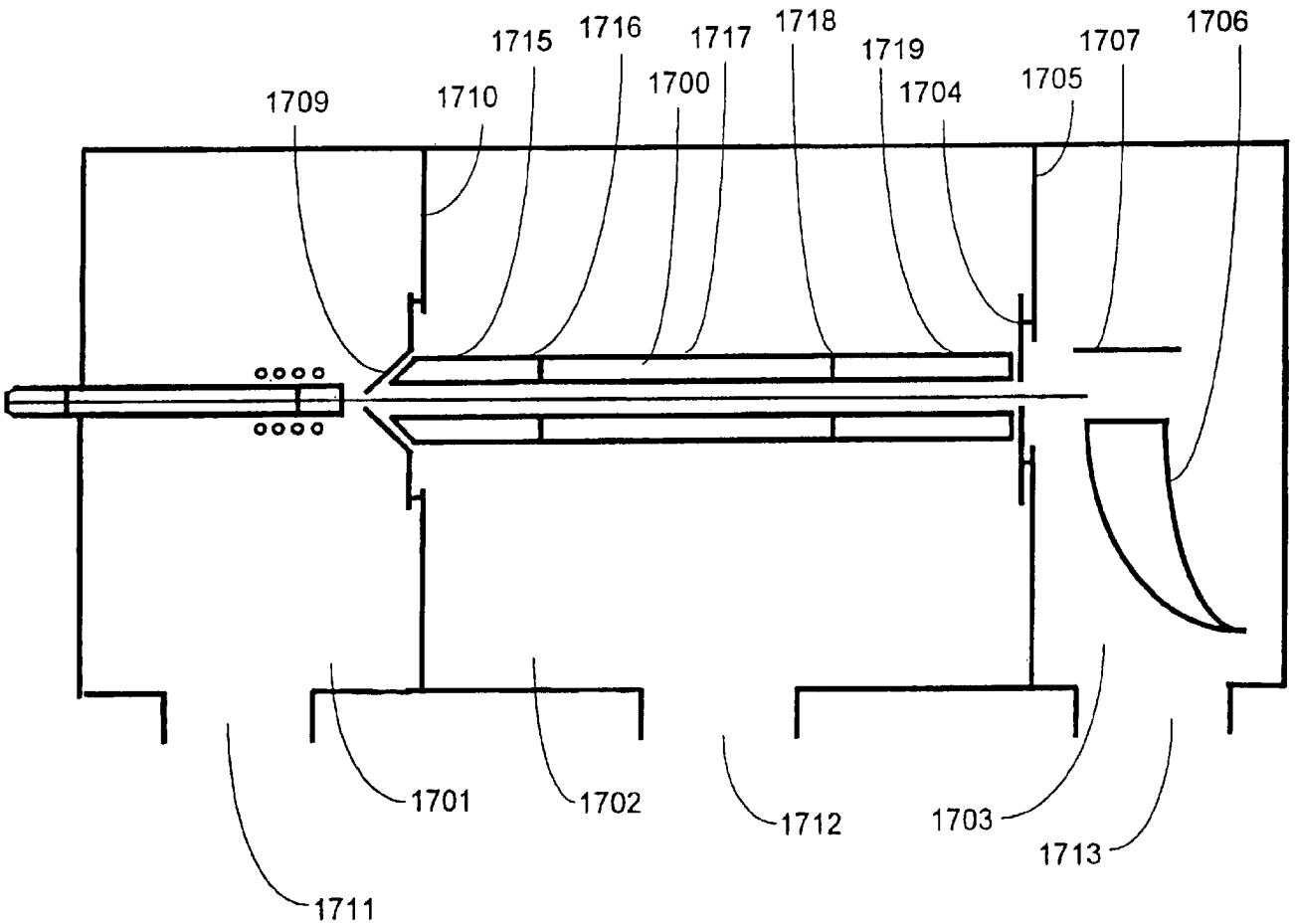
FIG. 17 is a diagram of an API source quadrupole mass analyzer configured with a three segment ion guide located in the higher pressure region of vacuum stage two and a detector located in lower pressure vacuum stage three.

FIG. 17 demonstrates a segmented mass analyzer multipole ion guide 1700 exclusively housed in pumping stage two 1702 where the pressure is greater than $1\times10^{-4}$ torr, substantially at a pressure where ions traversing the multipole ion guide length will encounter collisions with the neutral background gas. To one skilled in the art one can see that this embodiment can claim all that was claimed with the embodiment attached to FIG. 15 with the additions that the segmented mass analyzer 1700 exclusively housed in pumping stage two 1702. Any of the following sources can be configured on this system Electrospray (ES), Atmospheric Pressure Chemical Ionization (APCI), Inductively Coupled Plasma (ICP), Glow Discharge (GD) source, multiple similar probes in one source, or combinations of different probes in one source. Details of the source have already been discussed along with ion formation and transportation from the source to the entrance of the skimmer 1609, along with other variations on this hardware and thus, will not be repeated. A portion of the free jet expansion passes through a skimmer 1709 which is part of the vacuum partition 1710 and into second vacuum stage 1702 where background pressures can range from $10^{-4}$ to $10^{-1}$ torr depending on the skimmer orifice size and the pumping speed employed in vacuum stage two 1702 through pump port 1712. Ions travel through the segmented mass analyzer 1700 and exit the mass analyzer in stage two 1712. The ions pass through the four continuous rods that are broken into segments 1715, 1717, and 1719 and are electrically insulated from adjacent segments at insulating junction 1716 and 1718. Ion that exit the mass analyzer are focused through a lens 1704 which is part of the vacuum partition 1705. Ions are deliverer to pumping stage three 1703 through this lens 1704 and are focused into the detector 1706 by repeller plate 1707 and this stage is evacuated through pump port 1713. This high pressure quadrupole system has three pumping stages. The mass to charge analysis or mass selection operation can be achieved by applying a combination of RF and DC potentials, scanning the RF frequency or amplitude values or combinations of these methods.

Figure 18:
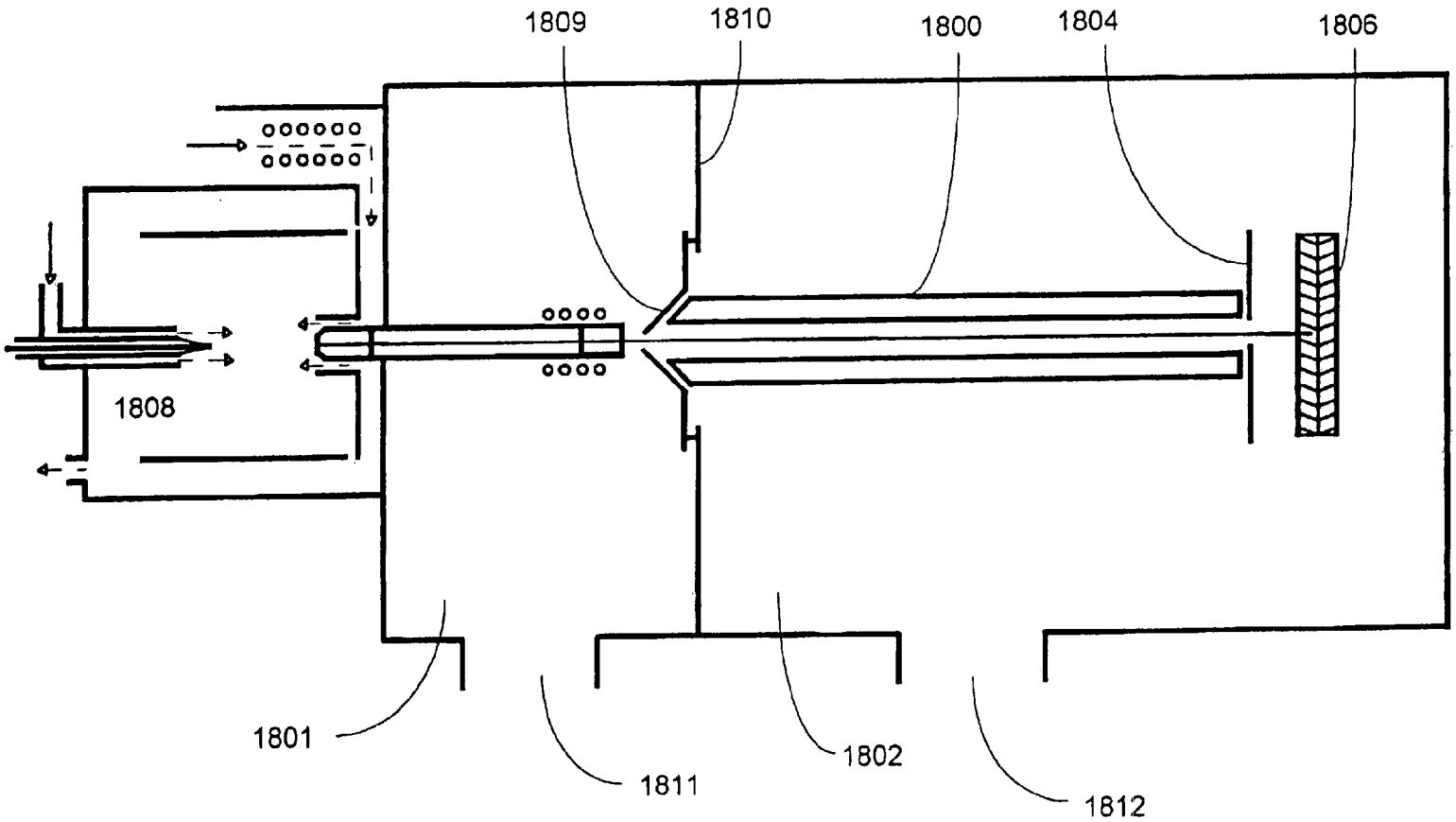
FIG. 18 is a diagram of an API source quadrupole mass analyzer configured with a quadrupole located in the higher pressure region of the second vacuum pumping stage and a detector also located in vacuum pumping stage two.

FIG. 18 demonstrates a non-segmented mass analyzer multipole ion guide 1800 exclusively housed in pumping stage two 1802 along with a detector 1806 where the pressure is greater than $1\times10^{-4}$ torr, substantially at a pressure where ions traversing the multipole ion guide length will encounter collisions with the neutral background gas. To one skilled in the art one can see that this embodiment can claim all that was claimed with the embodiment attached to FIG. 16 with the additions that the mass analyzer 1800 exclusively housed in pumping stage two 1802 along with a Microchannel Plate (MCP) detector 1806. An Electrospray source 1808 is configured on this system however the system could be reconfigured with any of the following alternative sources but is not limited to Atmospheric Pressure Chemical Ionization (APCI), Inductively Coupled Plasma (ICP), Glow Discharge (GD) source, multiple similar probes in one source, or combinations of different probes in one source. Details of the Electrospray source 1808 have already been discussed along with ion formation and transportation from the Electrospray source 1808 to the entrance of the skimmer 1809, along with other variations on this hardware and thus, will not be repeated. A portion of the free jet expansion passes through a skimmer 1809 which is part of the vacuum partition 1810 and into second vacuum stage 1802 where background pressures can range from $10^{-4}$ to $10^{-1}$ torr depending on the skimmer orifice size and the pumping speed employed in vacuum stage two 1802 through pump port 1812. Ions travel through the mass analyzer 1800 and exit the mass analyzer in stage two. Ion that exit the mass analyzer are focused through a lens 1804 ions are deliverer to the detector 1806. The ions exit the mass analyzer 1800 through a lens 1804 and in this same pumping stage the ions collide with a MCP detector which can be operated in the low millitorr range or below. This high pressure quadrupole and detector system has only two pumping stages which can farther reduce the cost and size of an API/MS instrument. This vacuum systems may be configured with one small single stage turbomolecular pump on stage two and one rotary pump to achieve the desired background pressures in each stage and in fact may be alternatively configured with only rotary pumps. The mass to charge analysis or mass selection operation can be achieved by applying a combination of RF and DC potentials, scanning the RF frequency or amplitude values or combinations of these methods.

Figure 19:
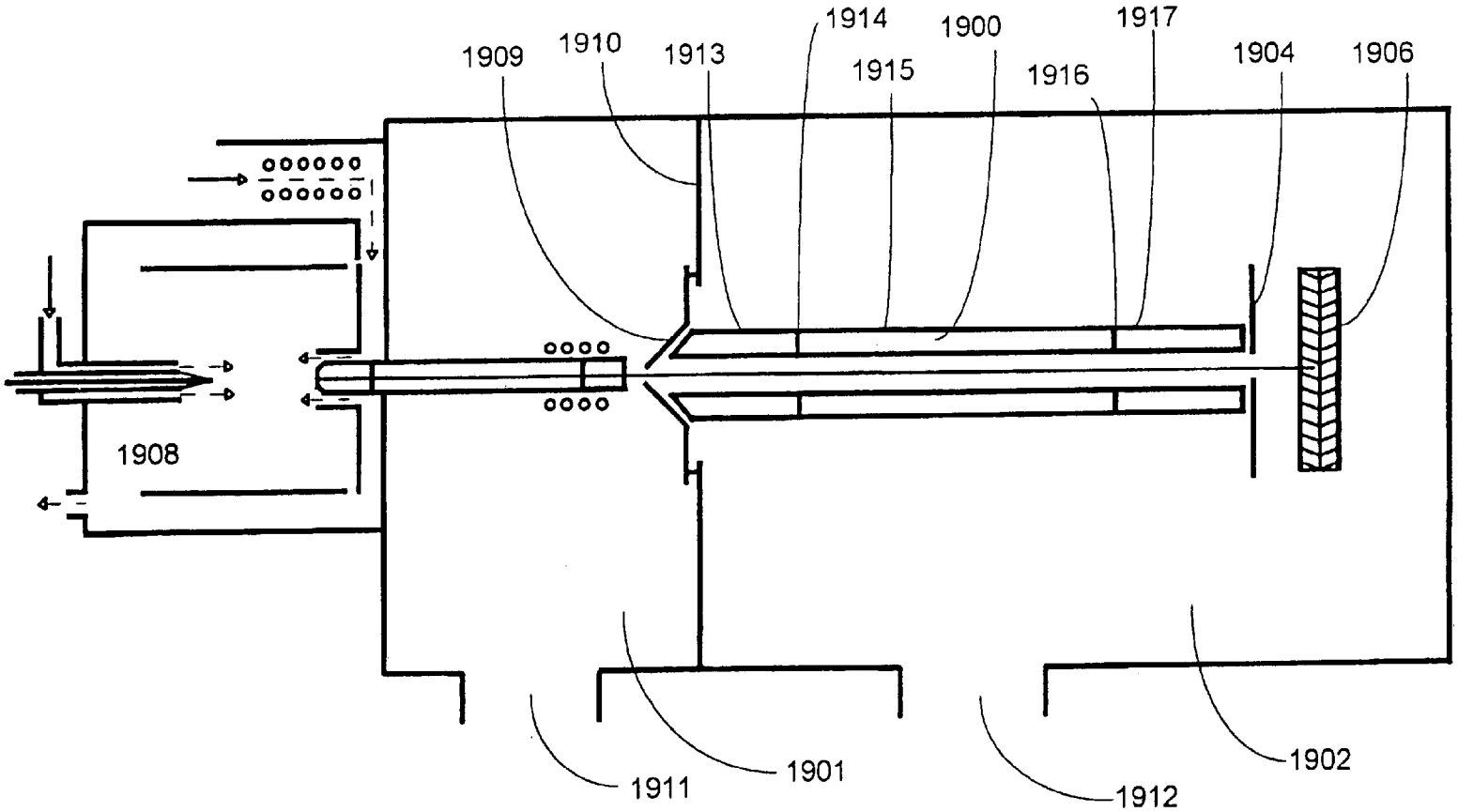
FIG. 19 is a diagram of an API source quadrupole mass analyzer configured with a three segment ion guide located in the higher pressure region of vacuum stage two and a detector also located in vacuum stage two.
Figure 20:
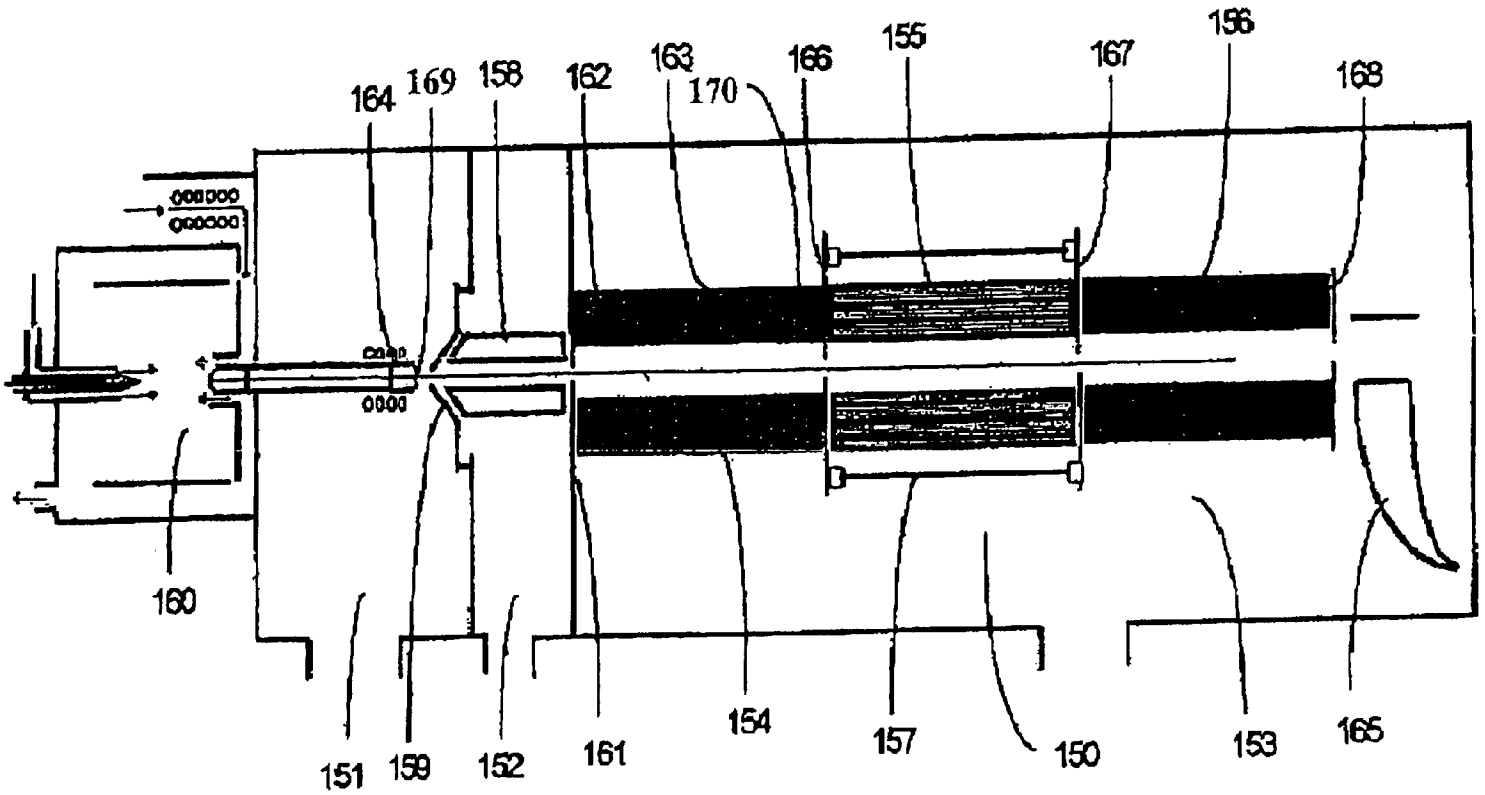
Figure 20 Prior Art
FIG. 20 is a diagram of a prior art multipole ion guide configuration of a typical triple quadrupole mass analyzer interfaced to an Atmospheric Pressure Ion source.

FIG. 19 demonstrates a segment mass analyzer ion guide 1900 exclusively housed in pumping stage two 1902 along with a detector 1906 where the pressure is greater than $1\times10^{-4}$ torr, substantially at a pressure where ions traversing the multipole ion guide length will encounter collisions with the neutral background gas. To one skilled in the art one can see that this embodiment can claim all that was claimed with the embodiment attached to FIG. 17 with the additions that the mass analyzer 1900 exclusively housed in pumping stage two 1902 along with a Microchannel Plate (MCP) detector 1906. An Electrospray source 1908 is configured on this system however the system could be reconfigured with any of the following alternative sources but is not limited to Atmospheric Pressure Chemical Ionization (APCI), Inductively Coupled Plasma (ICP), Glow Discharge (GD) source, multiple similar probes in one source, or combinations of different probes in one source. Details of the Electrospray source 1908 have already been discussed along with ion formation and transportation from the Electrospray source 1908 to the entrance of the skimmer 1909, along with other variations on this hardware and thus, will not be repeated. A portion of the free jet expansion passes through a skimmer 1909 which is part of the vacuum partition 1910 and into second vacuum stage 1902 where background pressures can range from $10^{-4}$ to $10^{-1}$ torr depending on the skimmer orifice size and the pumping speed employed in vacuum stage two 1902 through pump port 1912. Ions travel through the mass analyzer 1900 and exit the mass analyzer in stage two. The ions pass through the four continuous rods that are broken into segments 1913, 1915, and 1917 and are electrically insulated from adjacent segments at insulating junction 1914 and 1916. Ion that exit the mass analyzer are focused through a lens 1904 ions are deliverer to the detector 1906. The ions exit the mass analyzer 1900 through a lens 1904 and in this same pumping stage the ions collide with a MCP detector which can be operated in the low millitorr range or below. This high pressure quadrupole and detector system has only two pumping stages which can farther reduce the cost and size of an API/MS instrument. This vacuum systems may be configured with one small single stage turbomolecular pump on stage two and one rotary pump to achieve the desired background pressures in each stage and in fact may be alternatively configured with only rotary pumps. The mass to charge analysis or mass selection operation can be achieved by applying a combination of RF and DC potentials, scanning the RF frequency or amplitude values or combinations of these methods.

References Cited

The following references are referred to above, the disclosures of which are hereby incorporated herein by reference:

U.S. Patent Documents:

U.S. Pat. No. 5,401,962 Mar. 28, 1995 Ferran, Robert.

U.S. Pat. No. 5,613,294 Mar. 25, 1997 Ferran, Robert.

U.S. Pat. No. 4,234,791 Nov. 18, 1980 Enke, Christie; Yost, Richard; Morrison, James.

U.S. Pat. No. 4,963,736 Oct. 16, 1990 Douglas, Donald; French, John.

U.S. Pat. No. 5,179,278 Jan. 12, 1993 Douglas, Donald.

U.S. Pat. No. 5,689,111 Nov. 18, 1997 Dresch, Thomas; Gulcicek, Erol; Whitehouse, Craig.

U.S. Pat. No. 5,652,427 Jul. 29, 1997 Whitehouse, Craig; Gulcicek, Erol.

Ser. No. 08/694,542 Aug. 9, 1996 Whitehouse, Craig; Dresch, Thomas; Andrien, Bruce.

U.S. Pat. No. 4,542,293 Sep. 17, 1985 Fenn, John; Yamashita, Masamichi; Whitehouse, Craig.

Publications

K. L. Duffin, T. Wachs, J. D. Henion, "Atmospheric Pressure Ion-Sampling System for Liquid Chromatography/Mass Spectrometry Analyses on a Benchtop Mass Spectrometer", Analyt. Chem., vol. 64, pp. 61–68, (1992).

C. F. Ijames, 44th ASMS Conference Proceedings on Mass Spectrometry, 795, 1996.

Having described this invention with regard to specific embodiments, it is to be understood that the description is not meant as a limitation since further modifications and variations may be apparent or may suggest themselves. It is intended that the present application cover all such modifications and variations, including those as fall within the scope of the appended claims.

We claim:

1. An apparatus for analyzing chemical species, comprising:

(a) an ion source for operation at substantially atmospheric pressure to produce ions from a sample substance;

(b) at least two vacuum stages, each of said vacuum stages having means for pumping away gas to produce a partial vacuum, the first vacuum stage comprising a vacuum pressure such that said ions produce by said ion source can move out of said ion source and into said first vacuum stage, said at least two vacuum stages being in communication with each other such that said ions can move through a sequence of said at least two vacuum stages;

(c) a mass analyzer and detector located in at least one of said vacuum stages;

(d) a multipole ion guide having at least two segments, each segment having a plurality of poles, respectively;

(e) RF frequency and DC voltage sources applied to each of said at least two segments;

(f) wherein at least a second one of said at least two segments of said multipole ion guide is configured for ion mass to charge selection of said ions and is located in one of said vacuum stages, and wherein the vacuum stage in which said at least a second one of said at least two segments is located in has a background pressure of at least $1\times10^{-2}$ torr, sufficiently high such that ions traversing the length of said at least a second one of said at least two segments will encounter collisions with neutral background gas; and (g) wherein said RF frequency and DC voltages applied to each of said at least two segments are controlled independently of each other.

2. An apparatus according to claim 1, wherein said ion source is an Electrospray ion source.

3. An apparatus according to claim 1, wherein said ion source is an Atmospheric Pressure Chemical Ionization ion source.

4. An apparatus according to claim 1, wherein said ion source is an Inductively Coupled Plasma ion source.

5. An apparatus according to claim 1, wherein said ion source is an Glow Discharge ion source.

6. An apparatus according to claim 1, wherein at least one of said multipole ion guide segments is a quadrupole.

7. An apparatus according to claim 1, wherein at least one of said multipole ion guide segments is a hexapole.

8. An apparatus according to claim 1, wherein at least one of said multipole ion guide segments is an octapole.

9. An apparatus according to claim 1, wherein at least one of said multipole ion guide segments has more than eight poles.

10. An apparatus according to claim 1, wherein said analyzer is a quadrupole mass spectrometer.

11. An apparatus according to claim 10, wherein said quadrupole mass spectrometer has curved rods.

12. An apparatus according to claim 1, wherein said analyzer is a triple quadrupole mass spectrometer.

13. An apparatus according to claim 12, wherein said triple quadrupole mass spectrometer has curved rods.

14. An apparatus according to claim 1, wherein said analyzer is a magnetic sector mass spectrometer.

15. An apparatus according to claim 1, wherein said analyzer is a Fourier Transform mass spectrometer.

16. An apparatus according to claim 1, wherein said analyzer is a ion trap mass spectrometer.

17. An apparatus according to claim 1, wherein said analyzer is a hybrid mass spectrometer.

18. An apparatus according to claim 1, wherein said analyzer is a Time-Of-Flight mass spectrometer.

19. An apparatus according to claim 18, wherein said Time-Of-Flight mass spectrometer is an orthogonal pulsing Time-Of-Flight mass spectrometer.

20. An apparatus according to claim 18, wherein said Time-Of-Flight mass spectrometer is an Linear Time-Of-Flight mass spectrometer.

21. An apparatus according to claim 18, wherein said Time-Of-Flight mass spectrometer is an Reflection Time-Of-Flight mass spectrometer.

22. An apparatus according to claim 1, comprising three of said vacuum stages.

23. An apparatus according to claim 1, comprising four of said vacuum stages.

24. An apparatus according to claim 1, comprising more than four of said vacuum stages.

25. An apparatus according to claim 1, comprising two of said multipole ion guide segments.

26. An apparatus according to claim 1, comprising three of said multipole ion guide segments.

27. An apparatus according to claim 1, comprising four of said multipole ion guide segments.

28. An apparatus according to claim 1, comprising five of said multipole ion guide segments.

29. An apparatus according to claim 1, comprising six of said multipole ion guide segments.

30. An apparatus according to claim 1, comprising more than six of said multipole ion guide segments.

31. An apparatus according to claim 1, wherein said apparatus comprises at least three vacuum stages, and wherein said first segment of said multipole ion guide begins in the second vacuum stage of said vacuum stages and extends continuously into the third vacuum stage of said stages.

32. An apparatus according to claim 1, wherein said first segment of said multipole ion guide begins in said first vacuum stage and extends continuously into the second vacuum stage of said at least two vacuum stages.

33. An apparatus according to claim 1, wherein said first segment of said multipole ion extends continuously through three vacuum stages.

34. An apparatus according to claim 1, wherein said multipole ion guide begins in said first vacuum stage.

35. An apparatus according to claim 1, wherein said multipole ion guide begins in the second vacuum stage of said at least two vacuum stages.

36. An apparatus for analyzing chemical species as claimed in claim 1, wherein at least another of said segments of said multipole ion guide configured for operation to perform ion mass to charge selection of said ions is located in a vacuum stage wherein background pressure is at least $1\times10^{-4}$ torr.

37. An apparatus for analyzing chemical species as claimed in claim 1, wherein said at least one segment of said multipole ion guide configured for operation to perform ion mass to charge selection of said ions is located in a vacuum stage wherein the background pressure is at least one millitorr.

* * * * *